US009238378B2

(12) United States Patent
Olejniczak et al.

(10) Patent No.: US 9,238,378 B2
(45) Date of Patent: Jan. 19, 2016

(54) SYSTEM AND METHOD FOR PRINTING ON A FLEXIBLE BODY

(71) Applicant: Illinois Tool Works Inc., Glenview, IL (US)

(72) Inventors: Gregory B. Olejniczak, Carol Stream, IL (US); Marc C. Piscitello, Carol Stream, IL (US); Christopher J. Sobaszek, Carol Stream, IL (US); Graham P. Vlcek, Carol Stream, IL (US); Sean M. O'Neil, Carol Stream, IL (US); Peter P. Dell'Aquila, Carol Stream, IL (US); Steve Waszkowiak, Elmhurst, IL (US); Samuel Peterson, Glenview, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 14/623,136

(22) Filed: Feb. 16, 2015

(65) Prior Publication Data

US 2015/0158310 A1 Jun. 11, 2015

Related U.S. Application Data

(63) Continuation-in-part of application No. 13/473,208, filed on May 16, 2012, now Pat. No. 8,955,963.

(60) Provisional application No. 61/639,301, filed on Apr. 27, 2012.

(51) Int. Cl.

| | |
|---|---|
| ***B41J 11/06*** | (2006.01) |
| ***B41F 17/00*** | (2006.01) |
| ***B41J 3/407*** | (2006.01) |

(52) U.S. Cl.
CPC ..... *B41J 11/06* (2013.01); *B41F 17/001* (2013.01); *B41F 17/002* (2013.01); *B41F 17/006* (2013.01); *B41J 3/407* (2013.01)

(58) Field of Classification Search
CPC ..... B41J 11/06; B41J 3/407; B41F 17/001; B41F 17/002; B41F 17/006
See application file for complete search history.

(56) References Cited

U.S. PATENT DOCUMENTS

| | | | | |
|---|---|---|---|---|
| 6,504,606 | B2 * | 1/2003 | Yagita | G01N 21/9081 250/223 B |
| 7,021,036 | B2 * | 4/2006 | Hiramoto | B65B 43/04 493/186 |
| 2010/0200451 | A1 * | 8/2010 | Uptergrove | B41J 3/4073 206/459.5 |

*Primary Examiner* — Geoffrey Mruk
*Assistant Examiner* — Scott A Richmond
(74) *Attorney, Agent, or Firm* — The Small Patent Law Group LLC; Christopher R. Carroll

(57) ABSTRACT

A printing system includes carriage assemblies, a preparation station, a printing station, and a selection station. The carriage assemblies receive flexible bodies and are coupled to a conveyance assembly that moves the carriage assemblies along a direction of travel. The preparation station receives the flexible bodies from the loading station and manipulates the flexible bodies to at least partially flatten printing surfaces of the flexible bodies. The printing station prints images on the flexible bodies. The selection station examines the images on the flexible bodies and selects one or more of the flexible bodies based on the images. The selection station also individually grips and removes selected flexible bodies from the carriage assemblies and conveys the selected flexible bodies to a first collection location while the other flexible bodies remain on the carriage assemblies and are conveyed to a different, second collection location.

20 Claims, 29 Drawing Sheets

SYSTEM AND METHOD FOR PRINTING ON A FLEXIBLE BODY

CROSS-REFERENCE TO RELATED APPLICATIONS

This application is a continuation-in-part of U.S. application Ser. No. 13/473,208, which was filed on 16 May 2012, and claims priority to U.S. Application No. 61/639,601, which was filed on 27 Apr. 2012, the entire disclosures of which are incorporated herein by reference.

BACKGROUND

A variety of objects have printed information on one or more surfaces of the objects. The information can be printed on the objects using one or more techniques. Some objects, however, can be difficult to print the information on surfaces of the objects. For example, flexible (e.g., non-rigid) objects can be difficult to print on due to the flexible nature of the objects and the tendency for the objects to shift, move, and the like, during the printing process.

Some flexible objects present additional difficulties involved with printing on the objects. For example, three dimensional flexible objects can be difficult to print on if there is not a relatively flat surface on which to print. Rounded enclosures, such as intravenous (IV) bags that are filled with a fluid can be difficult to print on. For this reason, some printing systems and methods print on the IV bags prior to filling the IV bags with fluid. Due to the need to sanitize the IV bags after the printing process, however, the inks used to print on the IV bags may be exposed to harsh environments, such as caustic materials, heat, and the like. As a result, relatively expensive inks may need to be used and/or another method for presenting the information on the IV bags other than printing may need to be used.

BRIEF SUMMARY

In one embodiment, a printing system includes carriage assemblies, a preparation station, a printing station, and a selection station. The carriage assemblies are configured to receive flexible bodies and are coupled to a conveyance assembly that is configured to move the carriage assemblies and the flexible bodies along a direction of travel. The preparation station is configured for receiving the flexible bodies from the loading station and for manipulating the flexible bodies to at least partially flatten printing surfaces of the flexible bodies. The printing station is configured for printing images on the printing surfaces of the flexible bodies that are at least partially flattened. The selection station is configured for examining the images on the printing surfaces of the flexible bodies and for selecting one or more of the flexible bodies based on the images that are examined. The selection station also is configured to individually grip and remove the one or more of the flexible bodies that are selected from the carriage assemblies and to convey the one or more of the flexible bodies that are selected to a first collection location while the flexible bodies that remain on the carriage assemblies are conveyed to a different, second collection location.

In one embodiment, a printing method includes positioning flexible bodies on carriage assemblies that are coupled to a conveyance assembly that moves the carriage assemblies and the flexible bodies along a direction of travel, manipulating the flexible bodies to at least partially flatten printing surfaces of the flexible bodies, printing images on the printing surfaces of the flexible bodies that are at least partially flattened, examining the images on the printing surfaces of the flexible bodies, and selecting one or more of the flexible bodies based on the images that are examined by individually gripping and removing the one or more of the flexible bodies that are selected from the carriage assemblies. The one or more of the flexible bodies that are selected are conveyed to a first collection location while the flexible bodies that remain on the carriage assemblies are conveyed to a different, second collection location.

In one embodiment, a carriage assembly of a printing system includes a bed and a fixation device. The bed is configured to receive a flexible body and extends along a first direction from a fixation end to an open end. The fixation device is disposed proximate to the fixation end of the bed. The fixation device is configured to engage a first end of the flexible body to prevent the flexible body from being removed from the bed when an opposite second end of the flexible body is pulled along the first direction to at least partially flatten a printing surface of the flexible body.

In another embodiment, a method for securing a flexible body in carriage assembly of a printing system is provided. The method includes providing a bed configured to receive a flexible body. The bed extends along a first direction from a fixation end to an open end. The method also includes positioning a fixation device proximate to the fixation end of the bed and securing a first end of the flexible body into the fixation device by placing the first end of the flexible body into the fixation device. The fixation device prevents the flexible body from being removed from the bed when an opposite second end of the flexible body is pulled along the first direction to at least partially flatten a printing surface of the flexible body.

In another embodiment, a manipulation assembly of a printing system includes a housing and a moving arm. The housing is configured to be disposed proximate to a conveyance assembly that moves carriage assemblies carrying flexible bodies along a direction of travel. The moveable arm is connected with the housing and is configured to engage the flexible bodies as the flexible bodies move along the direction of travel and to pull the flexible bodies in a pulling direction that differs from the direction of travel to at least partially flatten printing surfaces of the flexible bodies prior to the flexible bodies entering a printing assembly to have images printed on the printing surfaces.

In another embodiment, a method for manipulating flexible bodies for being printed upon by a printing system includes engaging the flexible bodies having printing surfaces as the flexible bodies move in carriage assemblies along a direction of travel, pulling the flexible bodies in a pulling direction that differs from the direction of travel, and releasing the flexible bodies subsequent to pulling the flexible bodies and prior to the flexible bodies entering a printing assembly that prints images on the printing surfaces. Pulling the flexible bodies at least partially flattens the printing surfaces of the flexible bodies prior to the printing assembly printing the images on the printing surfaces.

In another embodiment, a gripping assembly of a printing system includes a gripping device and a vacuum manifold. The gripping device includes one or more engagement members configured to move and contact a surface of a flexible body as the flexible body moves in a direction of travel. The gripping device includes a conduit that is fluidly coupled with the one or more engagement members. The vacuum manifold is configured to be fluidly coupled with a vacuum pump and with the conduit of the gripping device. The vacuum manifold includes several vacuum cells in which at least a partial vacuum is generated by the vacuum pump. The gripping device is configured to move along the vacuum manifold as the flexible body moves in the direction of travel such that the conduit of the gripping device is fluidly coupled with different ones of the vacuum cells at different times while the one or more engagement members of the flexible body remain engaged with the surface of the flexible body. The vacuum cells of the vacuum manifold are configured to be individually controlled as to when the at least a partial vacuum is established in the vacuum cells, the at least a partial vacuum established in the cells to which the conduit of the gripping device is fluidly coupled as the gripping device moves along the vacuum manifold to cause the flexible body to remain secured to the one or more engagement members by the at least a partial vacuum.

In another embodiment, another gripping assembly of a printing system is provided. The gripping assembly includes a carousel device, and a vacuum manifold. The carousel device includes plural gripping devices that are configured to move along a path of the carousel device proximate to a conveyance assembly that moves plural flexible bodies along a direction of travel. The carousel device is configured to move the gripping devices to contact surfaces of the flexible bodies as the flexible bodies move in the direction of travel. The vacuum manifold is configured to be fluidly coupled with a vacuum pump and with the gripping devices as the gripping devices move through at least a portion of the looped path of the carousel device. The vacuum manifold includes a sequence of vacuum cells that are configured to be individually controlled as to when at least a partial vacuum is generated by the vacuum pump in each of the vacuum cells in the sequence of the vacuum cells. The carousel device is configured to move the gripping devices along the vacuum manifold as the flexible bodies move in the direction of travel such that the gripping devices engage the flexible bodies and the gripping devices are fluidly coupled with different ones of the vacuum cells during different time periods. The vacuum cells of the vacuum manifold are configured to be individually controlled as to when the at least a partial vacuum is established in the vacuum cells. The at least a partial vacuum is established in the vacuum cells during time periods at which selected ones of the gripping devices are fluidly coupled with the vacuum cells such that the selected ones of the gripping devices draw the at least a partial vacuum on the flexible bodies to secure selected ones of the flexible bodies to the gripping devices.

In another embodiment, a method for gripping flexible bodies in a printing system is provided. The method includes moving a gripping device having one or more engagement members to contact a surface of a flexible body as the flexible body moves in a direction of travel. The gripping device includes a conduit that is fluidly coupled with the one or more engagement members. The method also includes translating the gripping device along a vacuum manifold configured to be fluidly coupled with a vacuum pump and having several vacuum cells in which at least a partial vacuum is generated by the vacuum pump. The gripping device moves along the vacuum manifold as the flexible body moves in the direction of travel such that the conduit of the gripping device is fluidly coupled with different ones of the vacuum cells at different times while the one or more engagement members of the flexible body remain engaged with the surface of the flexible body. The method further includes individually controlling when the at least a partial vacuum is established in the vacuum cells such that the at least a partial vacuum established in the cells to which the conduit of the gripping device is fluidly coupled as the gripping device moves along the vacuum manifold to cause the flexible body to remain secured to the one or more engagement members by the at least a partial vacuum.

In another embodiment, another method for gripping flexible bodies in a printing system includes moving plural gripping devices along a path disposed proximate to a conveyance assembly that moves plural flexible bodies along a direction of travel. The gripping devices are moved to contact surfaces of the flexible bodies as the flexible bodies move in the direction of travel. The method also includes translating the gripping devices along a vacuum manifold that is fluidly coupled with a vacuum pump and the gripping devices. The vacuum manifold includes a sequence of vacuum cells that are arranged such that the gripping devices are fluidly coupled with different ones of the vacuum cells during different time periods as the gripping devices are translated along the vacuum manifold. The method also includes individually controlling when at least a partial vacuum is established in each of the vacuum cells. The at least a partial vacuum is established in the vacuum cells during time periods at which selected ones of the gripping devices are fluidly coupled with the vacuum cells such that the selected ones of the gripping devices draw the at least a partial vacuum on the flexible bodies to secure selected ones of the flexible bodies to the gripping devices.

BRIEF DESCRIPTION OF THE DRAWINGS

Reference is now made briefly to the accompanying drawings, in which.

DETAILED DESCRIPTION

One or more embodiments of the inventive subject matter described herein relate to systems and methods for printing images on flexible bodies. The examples provided herein focus on inkjet printing an image including text and/or graphics, but additionally or alternatively may use one or more other techniques for printing the image. The examples also focus on printing the images on flexible fluid-containing bodies, such as intravenous therapy bags, or IV bags. Additionally or alternatively, however, one or more embodiments of the systems and methods described herein may be used to print on other objects, such as flexible sheets, flexible solid objects, and the like.

Figure 1:
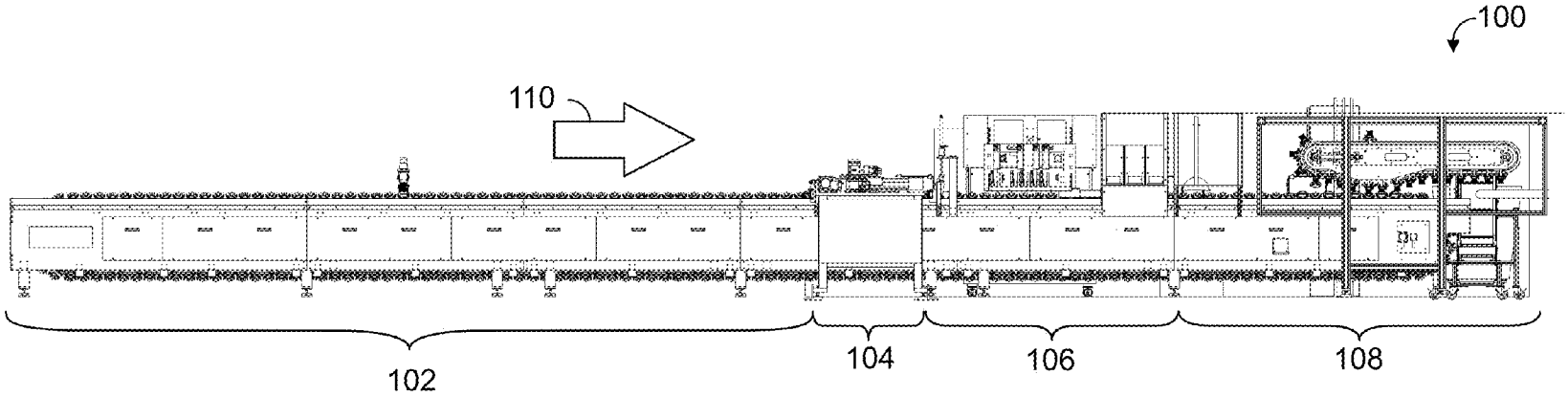
FIG. 1 illustrates a plan view of one embodiment of a printing system.
Figure 2:
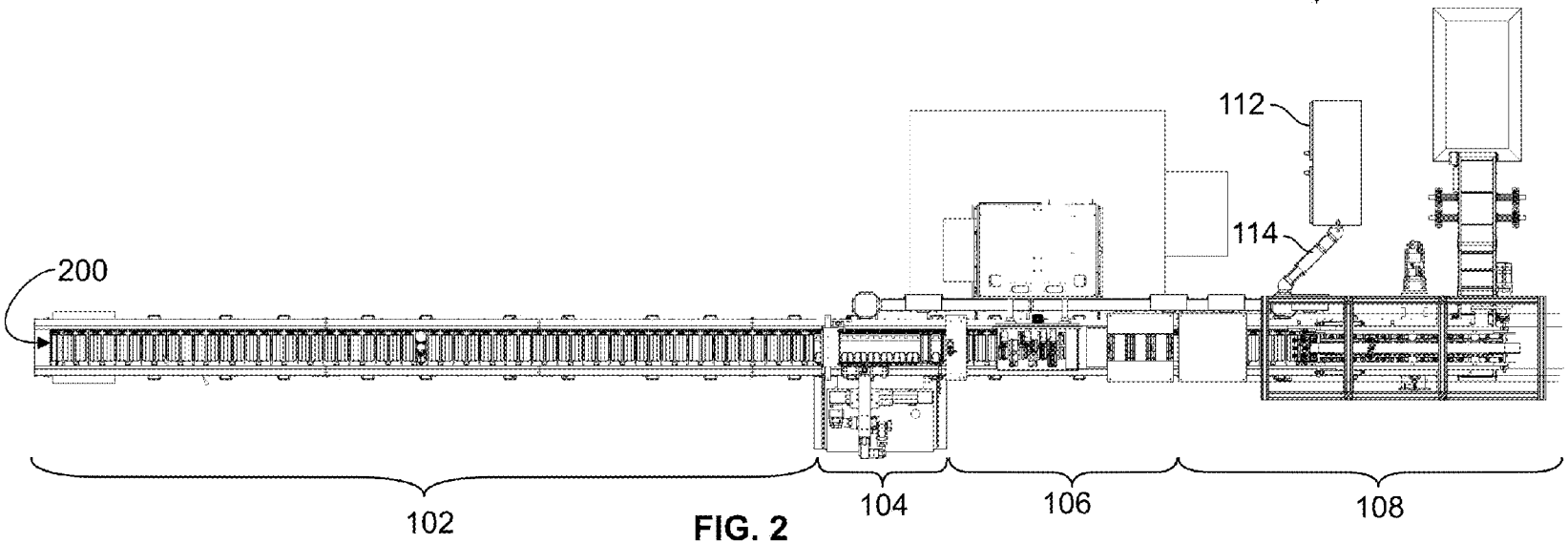
FIG. 2 illustrates a top view of the printing system shown in FIG. 1.

FIG. 1 illustrates a plan view of one embodiment of a printing system 100. FIG. 2 illustrates a top view of the printing system 100 shown in FIG. 1. The printing system 100 includes several stations that perform various operations in connection with manipulating flexible bodies (described below) in order to produce a relatively flat printing surface on the flexible bodies, print on the flattened printing surfaces of the flexible bodies, inspect the printing on the flexible bodies, and select the flexible bodies having acceptable printing thereon to separate those flexible bodies from other flexible bodies (e.g., with unacceptable printing thereon, such as images that include incorrect information, images that are smeared, images that are incomplete, and the like).

A loading station 102 of the printing system 100 receives the flexible bodies into the printing system 100. The loading station 102 includes carriage assemblies (described below) that hold the flexible bodies to prevent the flexible bodies from moving (e.g., rolling) during subsequent printing processes. The flexible bodies may be loaded into the carriage assemblies using one or more of a variety of techniques, included manual or automated dumping of the flexible bodies onto the carriage assemblies, manual or automated placing (e.g., using a robotic arm) of the flexible bodies onto the carriage assemblies, and the like. A preparation station 104 of the printing system 100 receives the flexible bodies from the loading station 102. The preparation station 104 flattens flexible printing surfaces (described below) of the flexible bodies in order to prepare the surfaces to receive an ink-printed image thereon. By "flatten" (and various forms thereof), it is meant that the flexible printing surfaces are manipulated to be made to be more flat or planar than prior to manipulating the surfaces. Such manipulation does not necessarily require that the flexible printing surfaces be made perfectly flat or planar. For example, "flattening" a fluid-containing flexible body or a flexible sheet can include manipulating a three-dimensional body or sheet having three-dimensional features such that a designated portion of the surface of the body or sheet is made more flat than before manipulating the body or sheet, such as by removing wrinkles, folds, undulations, and the like, from the body or sheet and/or by changing the shape of the body such that the designated portion of the surface of the body is made to be more flat or planar.

The printing system 100 also includes a printing station 106 that receives the flexible bodies having the flattened printing surfaces and deposits ink onto the printing surfaces to form the ink-printed image. The image may include text and/or graphics, such as text and/or graphics that describe or identify the fluid contents of the flexible body, the provider (e.g., manufacturer or distributor) of the fluid contents of the flexible body, decoration related to or representative of the product, bar codes, pictures, logos, and the like. In one embodiment, the printing station 106 deposits the image using an inkjet printer assembly. Alternatively, another printing assembly or technology may be used, such as pad printing.

The printing station 106 also may pre- and/or post-treat the flexible bodies before or after printing on the bodies, respectively. With respect to pre-treating the bodies, the printing station 106 can treat the printing surfaces of the bodies prior to applying the ink to form the images thereon to change an electrical and/or chemical characteristic of the surfaces to improve or enable the surfaces to receive the ink used to form the image. For example, the bodies can be exposed to heat (e.g., by a flame generated by the printing station 106) to change chemical properties (e.g., adhesion) of the printing surfaces to the ink. As another example, the bodies can be exposed to an electric current, conductively coupled with a ground reference, exposed to heat, and the like, to discharge static electricity from the printing surfaces of the bodies.

With respect to post-treating the bodies, the printing station 106 can expose the bodies to energy after printing the images thereon in order to cure the ink. The energy to which the printed bodies are exposed can include light of a designated wavelength or range of wavelengths (e.g., ultraviolet light), heat, electric current, electric fields, and the like. The energy can cure the ink to prevent the ink from smearing, blurring, and the like, during subsequent handling of the bodies.

The printing system 100 includes a selection station 108 that receives the printed flexible bodies from the printing station 106. The selection station 108 can examine the images printed on the flexible bodies and determine whether the images are acceptable or unacceptable. Acceptable images may include those images that include the correct (e.g., designated) information, images that are clear (e.g., images that are readable and not smeared or blurred), images that are oriented properly (e.g., oriented and positioned in a designated manner), and the like. Unacceptable images include those images having incorrect information, images that are not readable, images that are smeared or blurred, images that are incorrectly oriented on the bodies, and the like.

In one embodiment, the selection station 108 may grip and remove those printed bodies having acceptable images from the carriage assemblies and move the printed bodies to a conveyor or other device that moves the printed bodies to another location for packaging the printed bodies for shipping to a purchaser or other consumer of the bodies. The bodies having unacceptable images may not be selected by the selection station 108 or removed from the carriage assemblies. These bodies can then be discarded. Alternatively, the selection station 108 may grip and remove those printed bodies having unacceptable images from the carriage assemblies while allowing the printed bodies having acceptable images to proceed along and be placed onto a conveyor or other device that moves the printed bodies to another location for packaging the printed bodies for shipping to a purchaser or other consumer of the bodies. The bodies having unacceptable images may be moved to another location to be discarded.

The selection station 108 may include a vacuum pump 112 that is fluidly coupled with gripping devices (described below) of the selection station 108 by one or more conduits 114, which may include hoses, manifolds, and the like. The vacuum pump 112 can generate a vacuum or partial vacuum by reducing the pressure in the gripping devices so that the gripping devices can grip the flexible bodies using the vacuum, as described below.

A conveyance assembly 200 (shown in FIG. 1) may move the flexible bodies through the stations 102, 104, 106, 108 of the printing system 100 along a direction of travel 110 (shown in FIG. 1). The conveyance assembly 200 may include a chain, conveyor, or other device, that is coupled with the carriage assemblies holding the flexible bodies for moving the bodies through the system 100.

Figure 3:
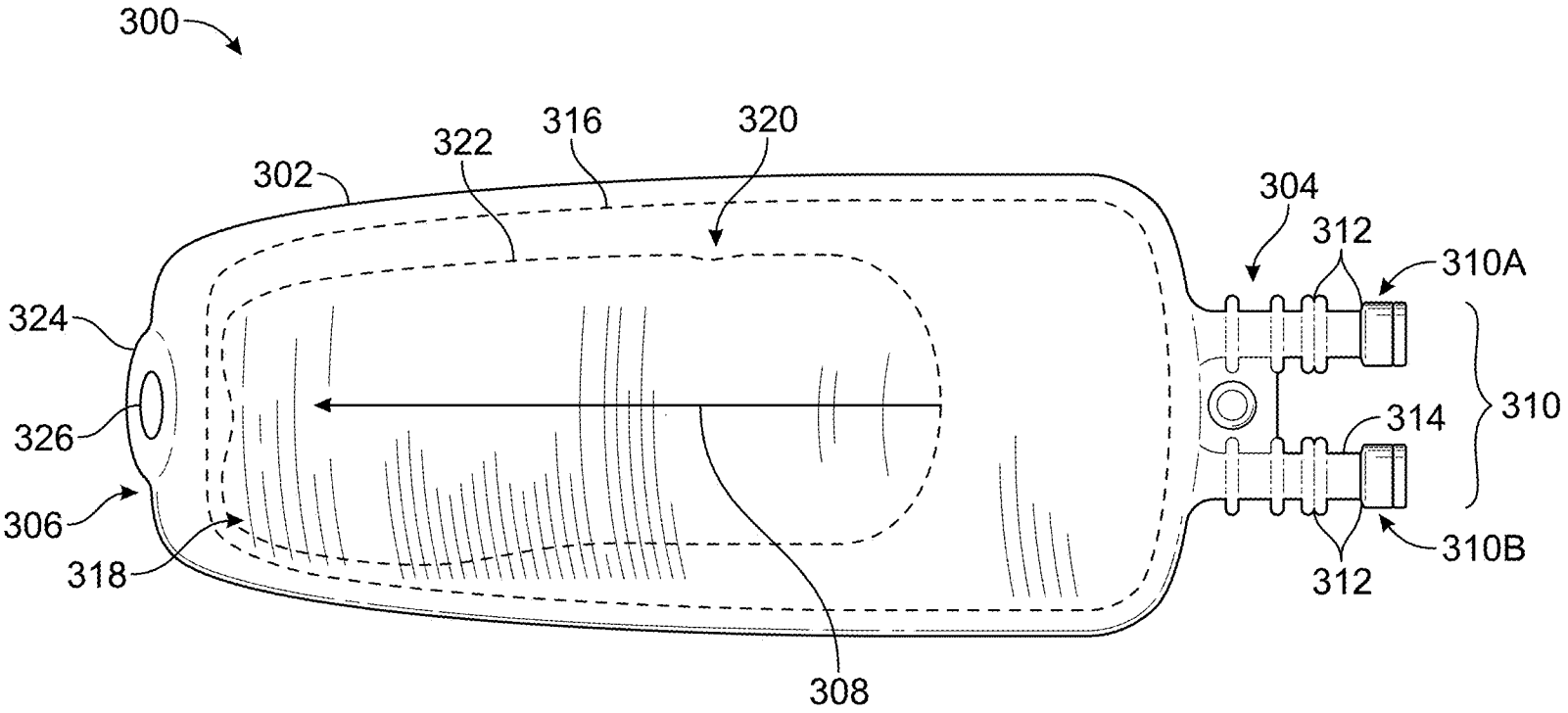
FIG. 3 is a top view of one example of a flexible body that may be printed on by the printing system shown in FIG. 1.

FIG. 3 is a top view of one example of a flexible body 300 that may be printed on by the printing system 100 shown in FIG. 1. The flexible body 300 may include a flexible outer surface 302 that forms a three-dimensional shape when at least partially filled by a fluid, such as a liquid or gas. The printing system 100 (shown in FIG. 1) receives the flexible bodies 300 that already have been filled or at least partially filled with a fluid, such as a liquid or gas, and then prints images onto the bodies 300. The bodies 300 may be filled with the fluid prior to printing on the bodies 300 such that no additional fluid is loaded into the bodies 300 subsequent to the printing system 100 printing the images onto the bodies 300. The flexible bodies 300 are shown as IV bags in the illustrated example, but alternatively may be other objects. The flexible body 300 extends from a first end 304 to an opposite second end 306 along an elongation direction 308 of the flexible body 300. The first end 304 includes ports 310 (e.g., ports 310A, 310B) that provide inlets and/or outlets to load fluid into and/or receive fluid out of an interior chamber of the flexible body 300. As shown in FIG. 3, one or more of the ports 310 may be staged in outside diameters to form larger diameter features 312 that protrude outside of (e.g., have larger diameters than) remaining portions of the ports 310, such as tubes 314 of the ports 310. The second end 306 may include an engagement portion 324, such as a tab formed by an opening 326 in the second end 306. The engagement portion 324 may be used to hang the flexible body 300. For example, with respect to IV bags, the engagement portion 324 may be used to hang the IV bag onto a hook by placing the hook through the opening 326.

The body 300 is shown with a printed image 316 on a portion of the surface 302 that includes text 318, graphics 320, and the like. In one embodiment, the body 300 may have a three-dimensional shape when a fluid is loaded into the interior chamber of the body 300 through the ports 310 such that the image 316 has a rounded shape. The rounded shape of the body 300 can result in air bubbles 322 forming within the interior chamber of the body 300 between the fluid in the body 300 and the outer surface 302 of the body 300. The air bubbles 322 in the body 300 can indicate flatness of the surface 302 of the body 300. For example, when the air bubbles 322 are approximately centered or centered on an upper surface of the body 300 (e.g., the portion of the body 300 that is shown), then the surface 302 of the body 300 is flat or substantially flat for purposes of printing on the surface 302. Conversely, when the air bubbles 322 are not centered, as shown in FIG. 3, then the surface 302 of the body 300 is not flat or substantially flat for purposes of printing on the surface 302.

Figure 4:
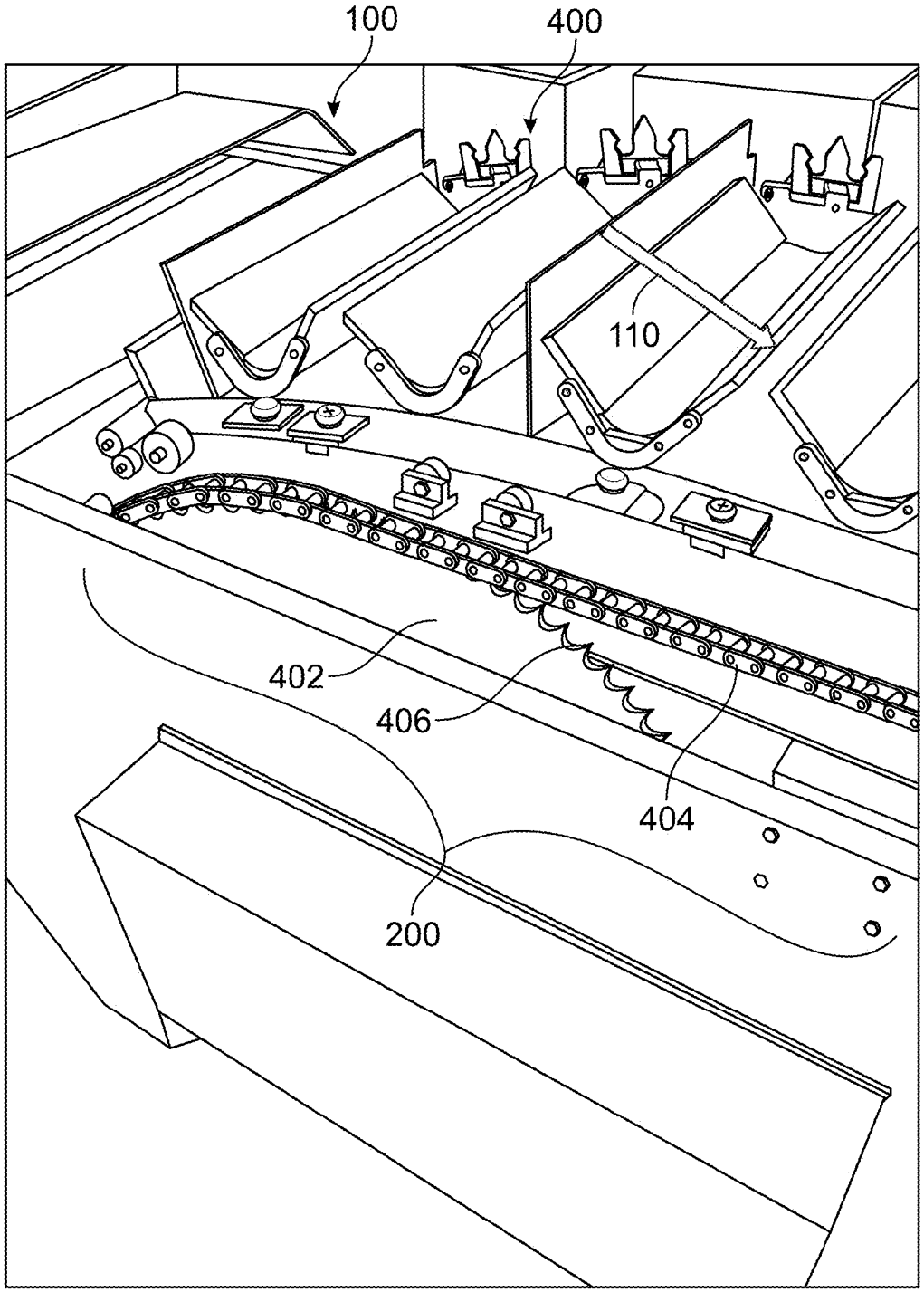
FIG. 4 is a perspective view of one embodiment of a conveyance assembly shown in FIG. 2.

FIG. 4 is a perspective view of one embodiment of the conveyance assembly 200. As described above, the conveyance assembly 200 moves carriage assemblies 400 that hold the flexible bodies 300 (shown in FIG. 3) as the flexible bodies 300 and carriage assemblies move through the printing system 100 along the direction of travel 110. Only a portion of the conveyance assembly 200 is shown in FIG. 4. The conveyance assembly 200 includes a sprocket wheel 402 and a roller chain 404 coupled with the sprocket wheel 402. The sprocket wheel 402 is joined to a motor or a shaft that is connected to the motor. The motor rotates the sprocket wheel 402 or the shaft in order to rotate the sprocket wheel 402. As the sprocket wheel 402 rotates, teeth 406 of the sprocket wheel 402 are coupled with the roller chain 404 engage and move the roller chain 404 along the direction of travel 110. The carriage assemblies 400 are joined to the roller chain 404 such that movement of the roller chain 404 causes movement of the carriage assemblies 400. The roller chain 404 may be joined to another sprocket wheel 402 or other wheel at or near an opposite end of the printing system 100 such that the roller chain 404 moves around both sprocket wheels 402 to move the carriage assemblies 400 through the printing system 100. Alternatively, the conveyance assembly 200 may include different components, such as a conveyor belt, to move the flexible bodies 300 and/or carriage assemblies through the printing system 100.

Figure 5:
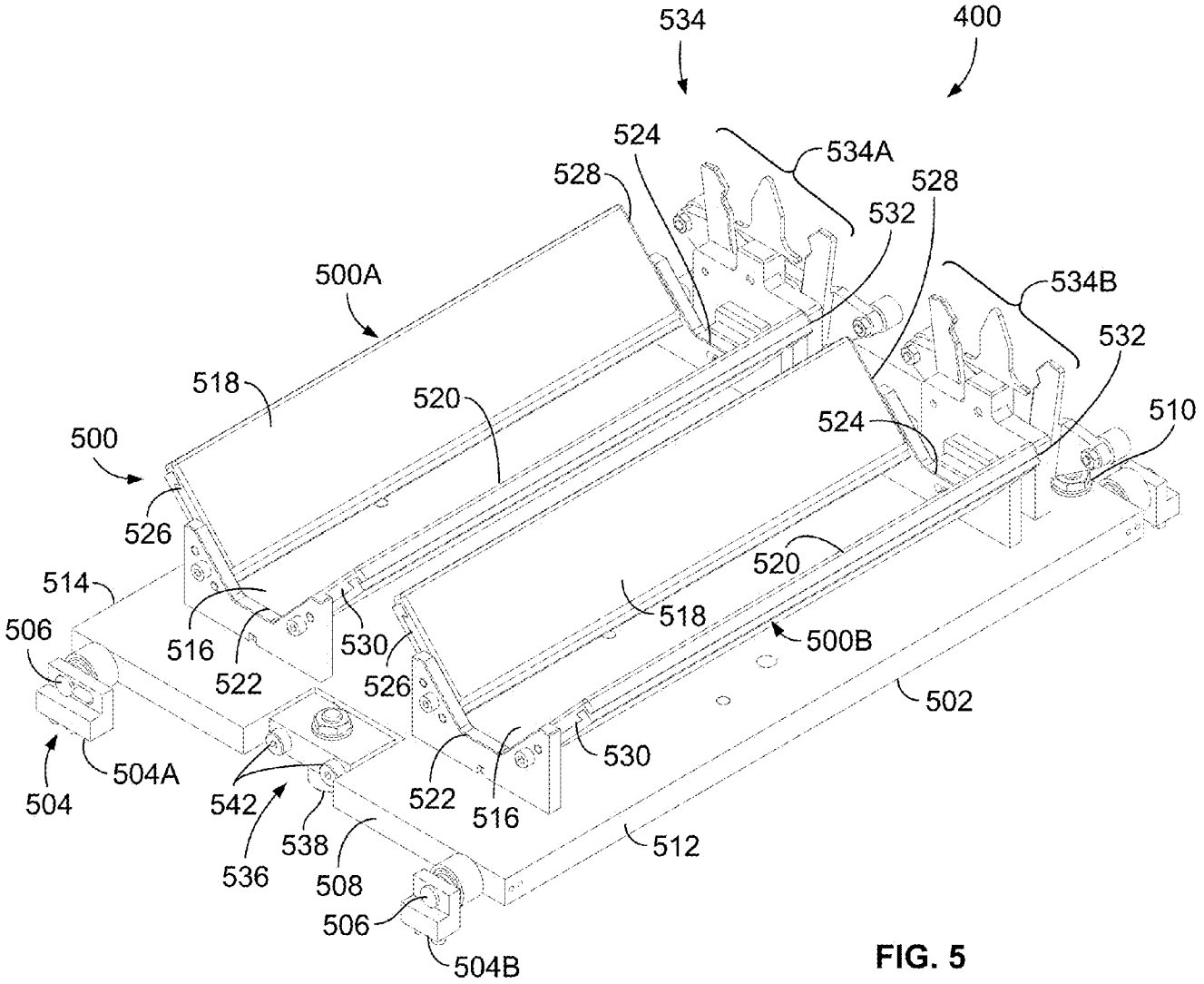
FIG. 5 is a perspective view of one embodiment of a carriage assembly shown in FIG. 4.

FIG. 5 is a perspective view of one embodiment of the carriage assembly 400. The carriage assembly 400 includes two beds 500 (e.g., beds 500A, 500B) that each holds a single flexible body 300 (shown in FIG. 3). Alternatively, the carriage assembly 400 may include a single bed 500 or more than two beds 500 and/or each bed 500 may hold more than a single flexible body 300 or a portion of a single flexible body 300.

The beds 500 are joined with a base plate 502 that extends between opposite ends 508, 510 along a first direction and between opposite ends 512, 514 along a second direction. When the carriage assembly 400 moves through the printing system 100, the first direction may be oriented perpendicular to the direction of travel 110 (shown in FIG. 1) while the second direction is parallel to the direction of travel 110. Alternatively, the first and/or second directions may be oriented differently.

The base plate 502 is coupled with the conveyance assembly 200 (shown in FIGS. 2 and 4). For example, the base plate 502 may be secured to the roller chain 404 (shown in FIG. 4)

such that the base plate 502 moves with the roller chain 404 through the printing system 100 along the direction of travel 110. Plural attachment devices 504 (e.g., attachment devices 504A, 504B) may be rotatably coupled with pins 506 joined with the opposite ends 508, 510 of the base plate 502 such that the attachment devices 504 can rotate around the pins 506 relative to the base plate 502. The attachment devices 504 also can be coupled to the conveyance device 200 (e.g., to the roller chain 404) such that the attachment devices 404 rotate relative to the base plate 502 when the roller chain 404 moves around the circumference of the roller chain 404. This rotation allows the carriage assembly 400 also to move around the outer circumference of the roller chain 404.

In the illustrated embodiment, the base 502 also is connected to positioning devices 536 at the opposite ends 508, 510. Only one positioning device 536 (e.g., joined to the end 508) is visible in FIG. 5. Alternatively, the base 502 may be connected with only a single positioning device 536 or more than two positioning devices 536. The positioning device 536 includes a downwardly protruding bearing 538 connected to a sliding plate 540. The sliding plate 540 is coupled with the base 520 by one or more resilient bodies 542, such as springs extending around posts, that resist being compressed between the sliding plate 540 and the base 520. For example, the resilient bodies 542 may impart forces on the base 502 and the sliding plate 540 that act to push the sliding plate 540 and the base 502 away from each other when the sliding plate 540 and/or the base 502 is moved toward the other. As described below in the description of the printing station 106, the positioning devices 536 help to prevent unintended or undesirable movement of the carriage assembly 500 and the flexible bodies 300 being carried thereon during printing on the flexible bodies 300.

The beds 500 include walls on which the flexible bodies 300 rest during movement through the printing system 100. For example, the flexible bodies 300 may lie on resting walls 514 of the beds 500. The resting walls 516 may be the "lowest" surfaces of the beds 500 in that the resting walls 516 are disposed closer to the floor on which the printing system 100 is disposed when the flexible bodies 300 are being carried in the beds 500. Side walls 518, 520 are disposed on opposite sides of the resting walls 516. The side walls 518, 520 are obliquely angled with respect to the resting walls 516 in the illustrated embodiment. Alternatively, the side walls 518, 520 may be disposed at another angle and/or not included in the beds 500. When the flexible bodies 300 lie on the resting walls 516, the side walls 518, 520 assist in centering the mass of the flexible bodies 300 centered between the side walls 518, 520 (e.g., near a center of each bed 500 between the side walls 518, 520). For example, the side walls 518, 520 may support and push up on outer sides of the flexible bodies 300 so that opposites sides of the flexible bodies 300 are pushed up and the air bubbles 322 (shown in FIG. 3) in the flexible bodies 300 naturally move toward the middle of the flexible bodies 300 along an upper surface 302 (shown in FIG. 3) of the flexible bodies 300 (e.g., the portion of the outer surface 302 that is opposite of the resting wall 316).

In the illustrated embodiment, the walls 516, 518, 520 are elongated between opposite ends. For example, the resting walls 516 extend between opposite ends 522, 524, the side walls 518 extend between opposite ends 526, 528, and the side walls 520 extend between opposite ends 530, 532. Fixation devices 534 (e.g., the fixation devices 534A, 534B) are disposed at or near the ends 524, 528, 532 of the walls 516, 518, 520. The fixation devices 534 secure the flexible bodies 300 in the beds 500 so that the flexible bodies 300 may not be removed from the beds and/or move relative to the beds 500 until the fixation devices 534 are unlocked. In the illustrated embodiment, no fixation devices 534 are disposed at the opposite ends 522, 526, 530 of the walls 516, 518, 520. The sides of the beds 500 represented by the ends 524, 528, 532 of the walls 516, 518, 520 may be referred to as closed sides of the beds 500 while the opposite sides of the beds 500 (e.g., at or near the opposite ends 522, 526, 530 of the walls 516, 518, 520) may be referred to as open sides of the beds 500.

Figure 6:
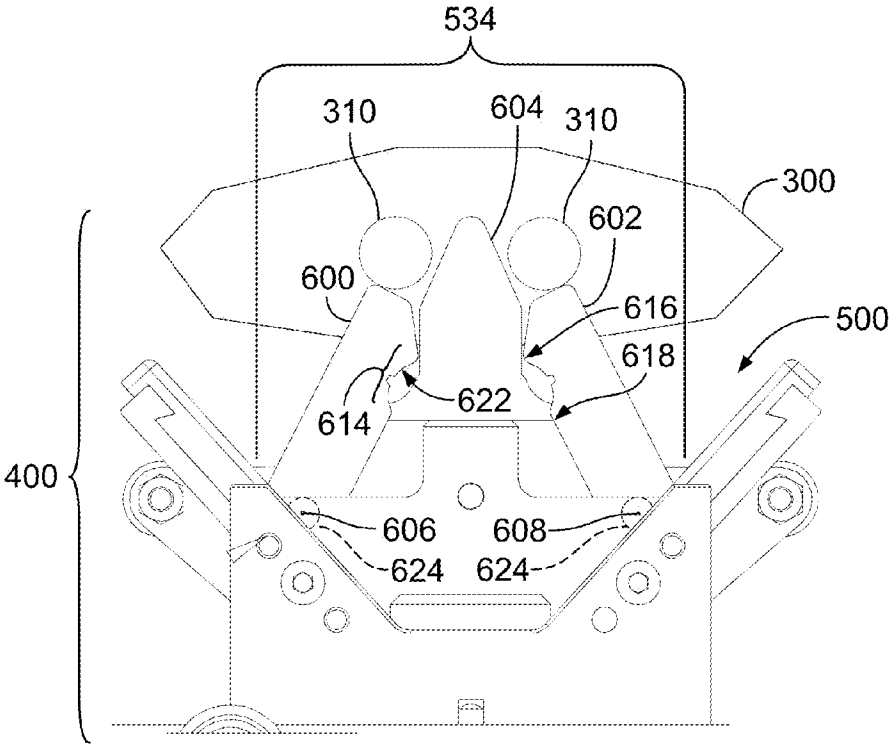
FIG. 6 is a plan view of one embodiment of a fixation device shown in FIG. 5 in an unlocked state.

FIG. 6 is a plan view of one embodiment of the fixation device 534 shown in FIG. 5 in an unlocked state. In the unlocked state, the flexible body 300 is not secured in the bed 500 of the carriage assembly 400. For example, the ports 310 of the flexible body 300 may not be engaged by the fixation device 534. The fixation device 534 includes opposing locking fingers 600, 602 on opposite sides of a center tine 604. In the unlocked state, the locking fingers 600, 602 are angled toward the center tine 604, as shown in FIG. 6. The locking fingers 600, 602 are pivotally mounted in the fixation device 534 such that the locking fingers 600, 602 can pivot about (e.g., around) respective pivot axes 606, 608 to move toward the center tine 604 and secure the ports 310 between the locking fingers 600, 602 and the center tine 604. In the embodiment shown in FIG. 6, the pivot axes 606, 608 extend normal to the plane of FIG. 6. For example, the pivot axes 606, 608 in FIG. 6 extend toward and away from the viewer of FIG. 6.

In the illustrated embodiment, the locking fingers 600, 602 include cutouts 614 along interface edges 622 of the locking fingers 600, 602 that engage the ports 310 when the ports 310 are loaded into the fixation device 534, as described below. The cutouts 614 represent recesses extending into the locking fingers 600, 602 from the edges 622 that contact the ports 310 when the ports 310 are received between the locking fingers 600, 602 and the center tine 604. The cutouts 614 may have a concave shape that is approximately complementary to an outer shape (e.g., a rounded or round shape) of the ports 310. The cutouts 614 extend along lengths of the locking fingers 600, 602 from an upper lip 616 to a lower lip 618. The lips 616, 618 represent intersections between the edges 622 and the cutouts 614. In one embodiment, the lips 616, 618 may protrude from the locking fingers 600, 602.

The locking fingers 600, 602 can be connected with resilient bodies 624 that naturally bias the locking fingers 600, 602 toward the center tine 604. By "naturally bias," it is meant that, in the absence of an opposing force, the resilient bodies 624 impart forces on the locking fingers 600, 602 that act to pivot the locking fingers 600, 602 toward the center tine 604. In the unlocked state shown in FIG. 6, however, the locking fingers 600, 602 are angled toward the center tine 604 and may engage the center tine 604 on opposite sides of the center tine 604.

Figure 7:
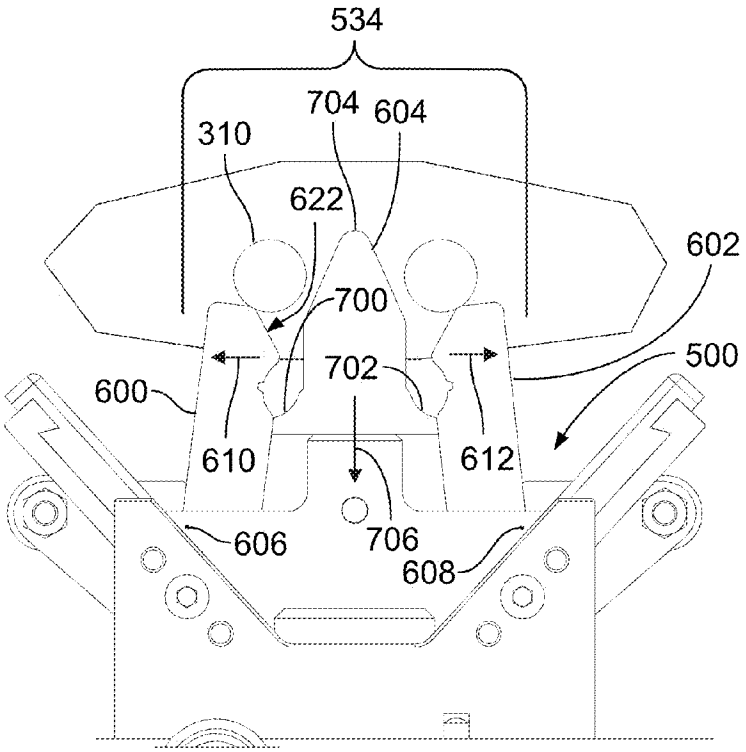
FIG. 7 is a plan view of one embodiment of the fixation device shown in FIG. 6 when a center tine is actuated to close the fixation device.

FIG. 7 is a plan view of one embodiment of the fixation device 534 shown in FIG. 6 with the ports 310 being loaded into the fixation device 534. The center tine 604 includes shoulders 700, 702 on opposite sides of an elongated protrusion 704. In order to secure the flexible body 300 in the bed 500 using the fixation device 534, the body 300 is lowered into the bed 500 such that the ports 310 of the body 300 are received between the locking fingers 600, 602 and the center tine 604. Alternatively, another part of the flexible body 300 may be secured to the fixation device 534.

The ports 310 are moved to positions where the ports 310 engage and force the locking fingers 600, 602 outward. For example, the ports 310 may be pushed in a downward direction 706 and engage the interface edges 622 of one or more of the locking fingers 600, 602. Continued downward movement of the ports 310 toward the bed 500 can cause the ports 310 to push the locking fingers 600, 602 away from the center tine 604 by pivoting the locking fingers 600, 602 about (e.g., around) the pivot axes 606, 608 in pivoting directions 610, 612. As shown in FIG. 7, the interface edges 622 can be angled away from each other to ease insertion of the ports 310 into the fixation device 534 between the locking fingers 600, 602 and the center tine 604.

Figure 8:
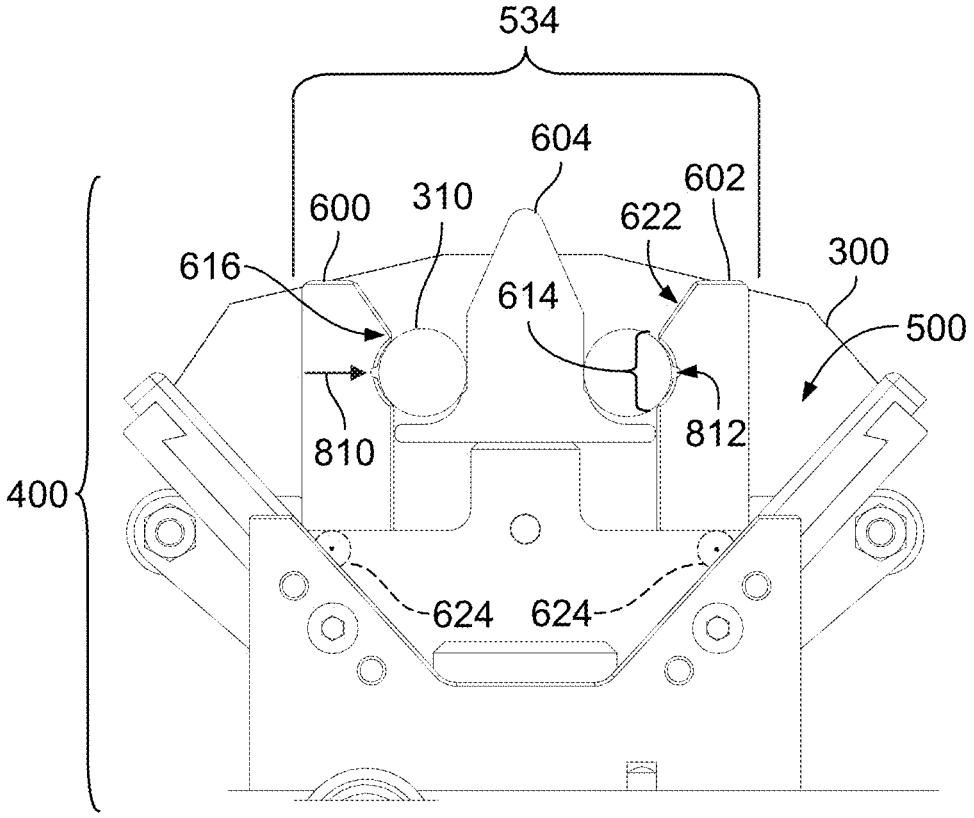
FIG. 8 is a plan view of one embodiment of the fixation device shown in FIGS. 6 and 7 in a locked state.

FIG. 8 is a plan view of one embodiment of the fixation device 534 shown in FIGS. 6 and 7 in a locked state. In the locked state, the flexible body 300 is secured in the bed 500 of the carriage assembly 400. For example, the ports 310 of the flexible body 300 may be engaged by the fixation device 534 and secured between the locking fingers 600, 602 and the center tine 604 of the fixation device 534 to secure the ports 310 in the fixation device 534.

When the ports 310 are located between the locking fingers 600, 602 and the center tine 604, the resilient bodies 624 impart locking forces 810, 812 on the ports 310. The locking forces 810, 812 cause the locking fingers 600, 602 to press up against the ports 310 to secure the ports 310 between the locking fingers 600, 602 and the center tine 604.

The flexible body 300 may be secured to the bed 500 of the carriage assembly 400 when the ports 310 are fully seated in the fixation device 534. The ports 310 may be fully seated in the fixation device 534 when the ports 310 are located within the cutouts 614 of the locking fingers 600, 602. During loading of the ports 310 in the fixation device 534, the ports 310 may travel along the edges 622 of the locking fingers 600, 602, over the upper lips 616 of the locking fingers 600, 602, and then be received in the cutouts 614 of the locking fingers 600, 602, such as to the position shown in FIG. 8. As described above, the cutouts 614 may have a complementary shape to the outer surface (e.g., the outer circumference) of the ports 310.

When the ports 310 are received into the fixation device 534 as shown in FIG. 7, the fixation device 534 can prevent the body 300 from being removed from the bed 500 along a direction that extends into the plane of FIG. 7. The tubes 314 (shown in FIG. 3) of the ports 310 may be seated between the locking fingers 600, 602 and the center tine 604 and the larger diameter features 314 (shown in FIG. 3) of the ports 310 may be prevented from moving between the locking fingers 600, 602 and the center tine 604. For example, if the opposite second end 306 of the body 300 is pulled away from the fixation device 534, the larger diameter features 314 may engage the locking fingers 600, 602 and the center tine 604 and be prevented from moving between the locking fingers 600, 602 and the center tine 604 by the natural biasing of the locking fingers 600, 602 toward the center tine 604. As a result, the ports 310 cannot be removed from the fixation device 534 by pulling on the second end 306 of the flexible body 300. In one embodiment, the body 300 can be removed from the bed 500 and the ports 310 can be removed from the fixation device 534 by lifting the body 300 and/or ports 310 from the carriage assembly 400, such as in a direction that is opposite to the direction in which the body 300 and ports 310 are lowered into the bed 500 and fixation device 534, respectively.

Figure 9:
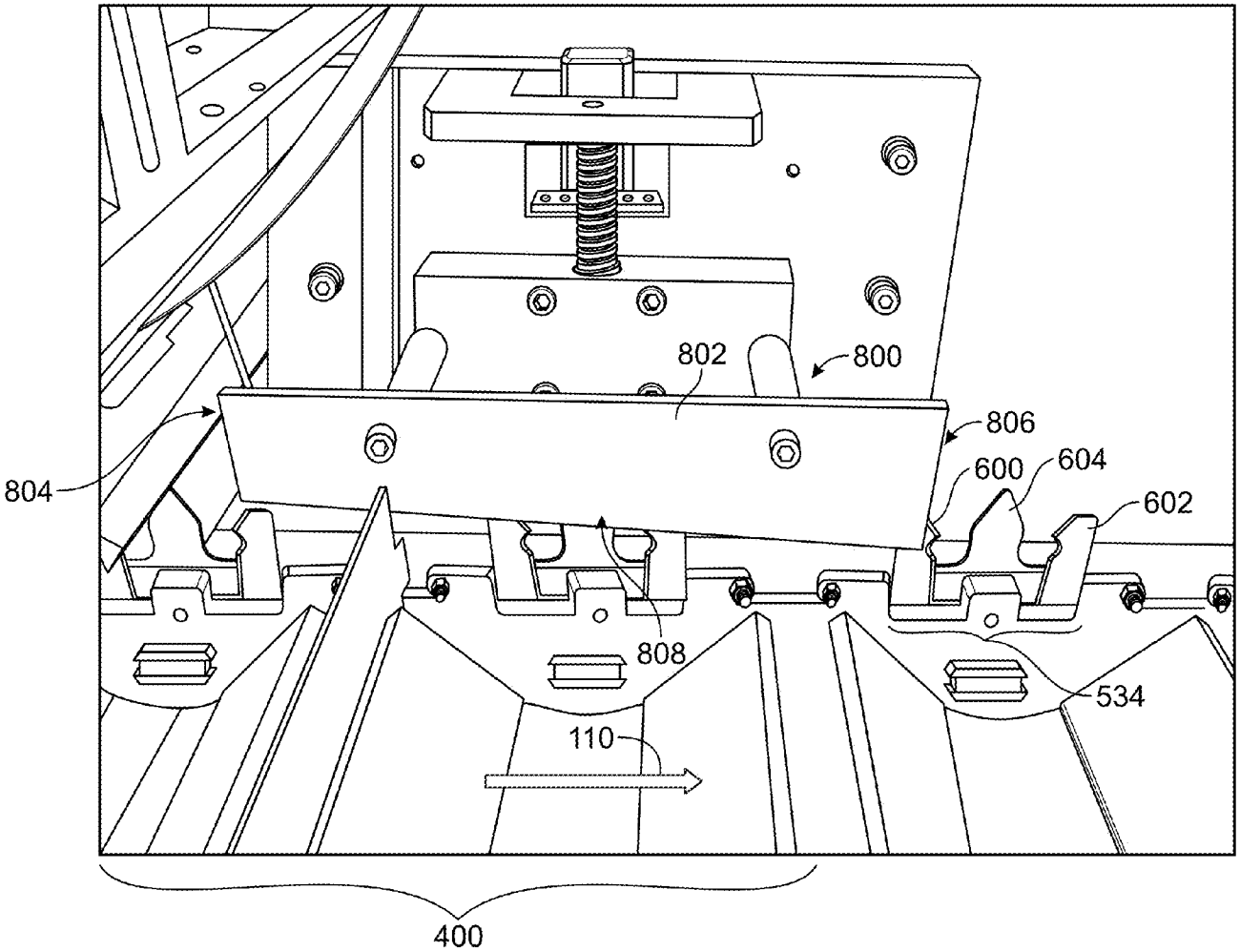
FIG. 9 is a perspective view one embodiment of a seating device.

FIG. 9 is a perspective view one embodiment of a seating device 800. The seating device 800 can be included in one or more embodiments of the printing system 100 shown in FIG. 1 to assist in fully seating the ports 310 (shown in FIG. 3) of the flexible bodies 300 (shown in FIG. 3) in the fixation devices 534 of the carriage assemblies 400. For example, the seating device 800 can be included in the loading station 102 (shown in FIG. 1) of the printing system 100. Alternatively, the printing system 100 may not include the seating device 800.

As described above, in one embodiment, in order to seat the ports 310 of the flexible bodies 300 into the fixation devices 534 between the locking fingers 600, 602 and the center tine 604, the ports 310 may be forced downward onto the shoulders 700, 702 of the center tine 604 to actuate the locking fingers 600, 602 and cause the locking fingers 600, 602 toward the center tine 604. If the ports 310 are not forced downward sufficiently far, however, the center tine 604 may not actuate the locking fingers 600, 602 and the ports 310 may not be seated between the locking fingers 600, 602 and the center tine 604.

The seating device 800 can engage and push the ports 310 of the flexible bodies 300 that are not fully seated in the fixation devices 534 in order to ensure that the ports 310 are secured in the fixation devices 534. The seating device 800 includes an elongated body 802 that extends from a leading side or edge 804 to an opposite trailing side or edge 806. The leading side or edge 804 faces the flexible bodies 300 and carriage assemblies 400 that are approaching the seating device 800 along the direction of travel 110 of the printing system 100. The body 802 includes an angled engagement edge 808 that extends from the leading side or edge 804 to the trailing side or edge 806.

The engagement edge 808 is angled with respect to the carriage assemblies 400 and fixation devices 534. For example, a leading interface between the leading side or edge 804 and the engagement edge 808 is disposed farther from the carriage assemblies 400, fixation devices 534, and/or ports 310 than a trailing interface between the trailing side or edge 806 and the engagement edge 808. As the ports 310 that are not seated in the fixation devices 534 travel below the seating device 800 along the direction of travel 110, the ports 310 may engage the engagement edge 808. For example, the ports 310 that are not seated in the fixation devices 534 may be disposed higher (e.g., farther from) the base plate 502 (shown in FIG. 5) of the carriage assemblies 400 than the ports 310 that are seated in the fixation devices 534. The ports 310 that are not seated may contact the engagement edge 808 and be forced down into the fixation devices 534 to seat the ports 310 in the fixation devices 534, as described above. For example, the angle at which the engagement edge 808 is disposed may cause the ports 310 to be gradually be forced sufficiently far into the fixation devices 534 so as to engage the center tine 604 and actuate the locking fingers 600, 602, as described above. When the ports 310 travel beneath the seating device 800 and past the trailing interface between the trailing side or edge 806 and the engagement edge 808, the ports 310 are fully seated in the fixation device 534.

In one embodiment, the seating device 800 is stationary. For example, the seating device 800 may not move upward and away from, or downward and toward the carriage assemblies 400. Alternatively, the seating device 800 may move relative to the carriage assemblies 400. For example, the seating device 800 may lower toward the carriage assemblies 400 to seat the ports 310 in the fixation device 534. Additionally or alternatively, such a moving seating device 800 may rise up and move away from the ports 310 that are already seated in the fixation devices 534.

Figure 10:
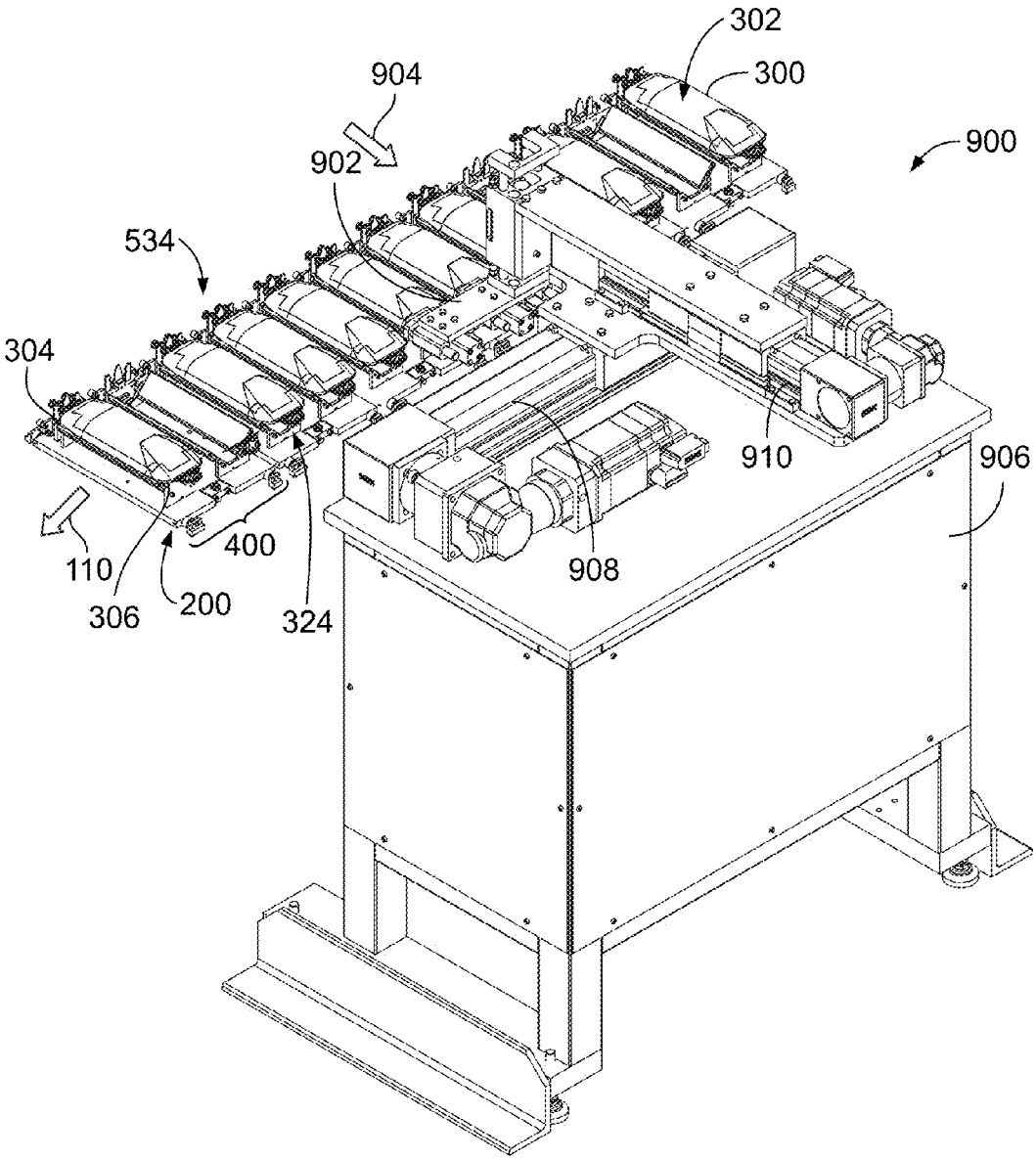
FIG. 10 is a perspective view of one embodiment of a manipulation assembly in the printing system shown in FIG. 1.

FIG. 10 is a perspective view of one embodiment of a manipulation assembly 900 in the printing system 100 shown in FIG. 1. The manipulation assembly 900 may be included in the preparation station 104 (shown in FIG. 1) of the printing system 100. The manipulation assembly 900 physically manipulates the flexible bodies 300 in order to change a shape of at least a portion of the surfaces 302 of the flexible bodies 300. For example, the manipulation assembly 900 may flatten the flexible bodies 300 so that the portion of the surfaces 302 that are to be printed on become more flat or planar that prior to being manipulated by the manipulation assembly 900.

The flexible bodies 300 are conveyed to the manipulation assembly 900 by the conveyance assembly 200 and the carriage assemblies 400 along the direction of travel 110. The manipulation assembly 900 includes a housing 906 with an arm 902 that is elongated along a direction that is parallel to the direction of travel 110 in the illustrated embodiment. As described below, the arm 902 includes plural posts that engage the flexible bodies 300 at or near the second end 306 of the flexible bodies 300. The posts can be inserted into the openings 326 (shown in FIG. 3) of the flexible bodies 300 to contact the engagement portions 324. The arm 902 and/or posts may then move to pull on the flexible bodies 300 to change the shapes of the flexible bodies 300. For example, the arm 902 and/or posts may move in a pulling direction 904 that is transverse to the direction of travel 110 in order to pull the flexible bodies 300 away from the fixation devices 534 of the carriage assemblies 400.

As described above, the first ends 304 of the flexible bodies 300 may be secured in the fixation devices 534. The pulling on the second ends 306 of the flexible bodies 300 by the arm 902 can at least temporarily change the shape of the flexible bodies 300 by elongating the flexible bodies 300. This pulling can cause the upper portions of the surfaces 302 of the flexible bodies 300 to become at least temporarily more flat or planar than prior to the manipulation assembly 900 pulling on the flexible bodies 300. In one embodiment, the air bubbles 322 (shown in FIG. 3) in the flexible bodies 300 may become more centered along the upper surfaces 302 than prior to the pulling of the flexible bodies 300. The arm 902 can move to remove the posts from the engagement portions 324 of the flexible bodies 300 to release the flexible bodies 300. In one embodiment, the release of the flexible bodies 300 by the arm 902 may allow the flexible bodies 300 to slightly change shape. However, the bubbles 322 in the flexible bodies 300 may remain more centered (e.g., be positioned approximately the same or approximately the same distances from outer edges of the flexible bodies 300) than prior to pulling on the flexible bodies 300. The centering of the bubbles 322 can provide a flatter or more planar surface 302 of the flexible body 300 on which to print, as described above.

Figure 11:
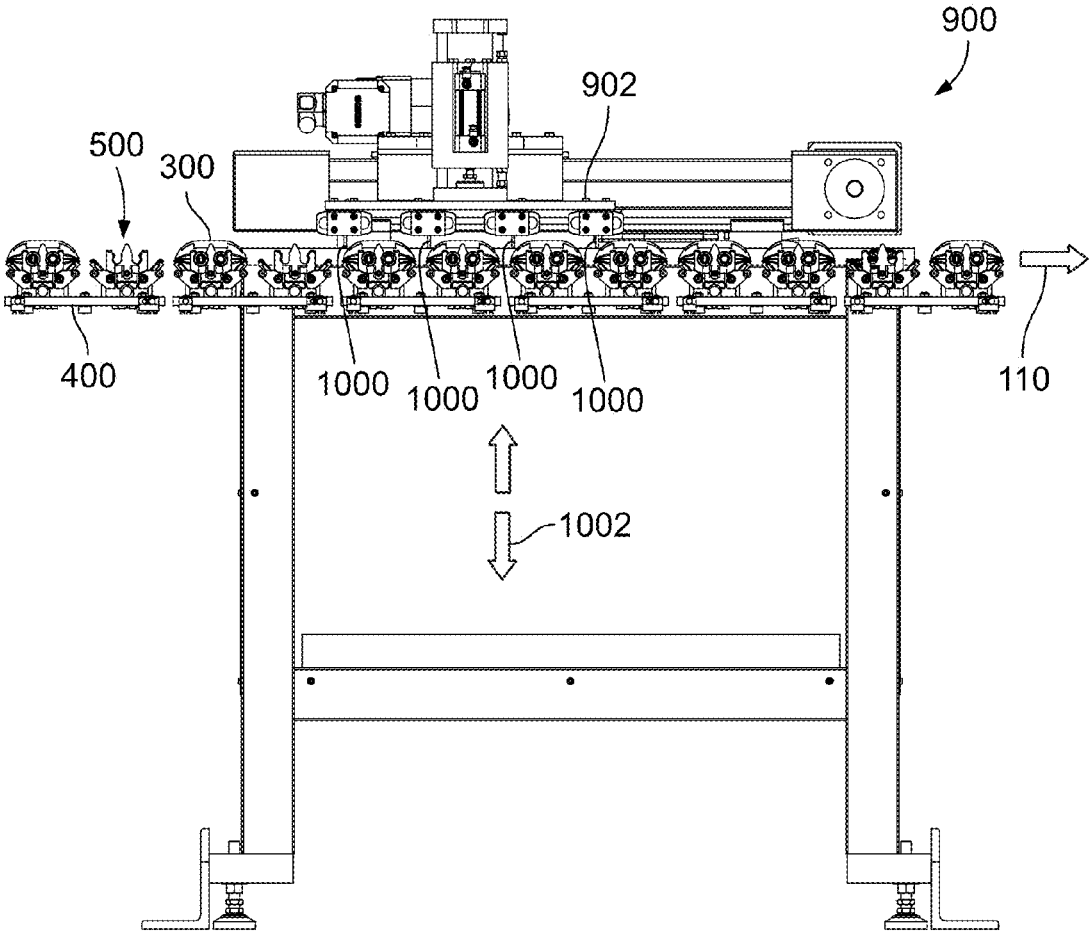
FIG. 11 is a plan view of the manipulation assembly shown in FIG. 10.

FIG. 11 is a plan view of the manipulation assembly 900 shown in FIG. 10. As shown in FIG. 10, the arm 902 of the manipulation assembly 900 includes several downwardly protruding posts 1000. By "downwardly protruding," it is meant that the posts 1000 are elongated and oriented along directions that extend from the arm 902 toward the flexible bodies 300 and carriage assemblies 400. The arm 902 moves in several opposite directions in order to position the posts 1000 in the openings 326 (shown in FIG. 3) of the flexible bodies 300, to pull on the flexible bodies 300 to flatten the flexible bodies 300, to retreat the posts 1000 from the openings 326 and release the flexible bodies 300, and to return to another position to engage and pull on additional flexible bodies 300.

In the illustrated embodiment, the arm 902 includes four posts 1000. Alternatively, the arm 902 may include a different number of posts 1000 or even a single post 1000. The number of posts 1000 connected to the arm 902 may determine the number of flexible bodies 300 that can be concurrently or simultaneously pulled by the arm 902. For example, the four posts 1000 of the arm 902 shown in the illustrated embodiment may simultaneously engage and pull on up to four flexible bodies 300. The number of flexible bodies 300 that can be engaged and pulled by the posts 1000 and arms 902 may be referred to as a set or group of flexible bodies 300.

The arm 902 may be connected to one or more motors, gears, and the like, that are disposed in the housing 906 in order to move and pull on the flexible bodies 300. In the illustrated embodiment, the housing 906 includes a first rail 908 that is elongated parallel to the direction of travel 110 and a second rail 910 that is elongated in a lateral direction (e.g., perpendicular to the direction of travel 110). During an operation of pulling on a set of flexible bodies 300, the arm 902 may begin at a starting location. In the starting location, the posts 1000 are raised above the flexible bodies 300 and carriage assemblies 400 such that outer ends of the posts 1000 are disposed above the flexible bodies 300. When a set of the flexible bodies 300 is positioned below the posts 1000 (e.g., such that the openings 326 of the flexible bodies 300 are aligned with or disposed below the posts 1000), the arm 902 can move in an insertion direction 1002. The arm 902 moves sufficiently far in the insertion direction 1002 that the posts 1000 are received in the openings 326.

During and/or subsequent to inserting the posts 1000 into the openings 326 of the flexible bodies 300, the arm 902 may move along the first rail 908 in a direction along (e.g., parallel to) the direction of travel 110. For example, because the conveyance assembly 200 may be moving the carriage assemblies 400 and the flexible bodies 300 at a designated speed along the direction of travel 110, the arm 902 also may move the posts 1000 at the same speed (or within a designated range of the speed) along the direction of travel 110 to prevent pulling the flexible bodies 300 off of the beds 500 of the carriage assemblies 400 and/or twisting the flexible bodies 300.

Figure 12:
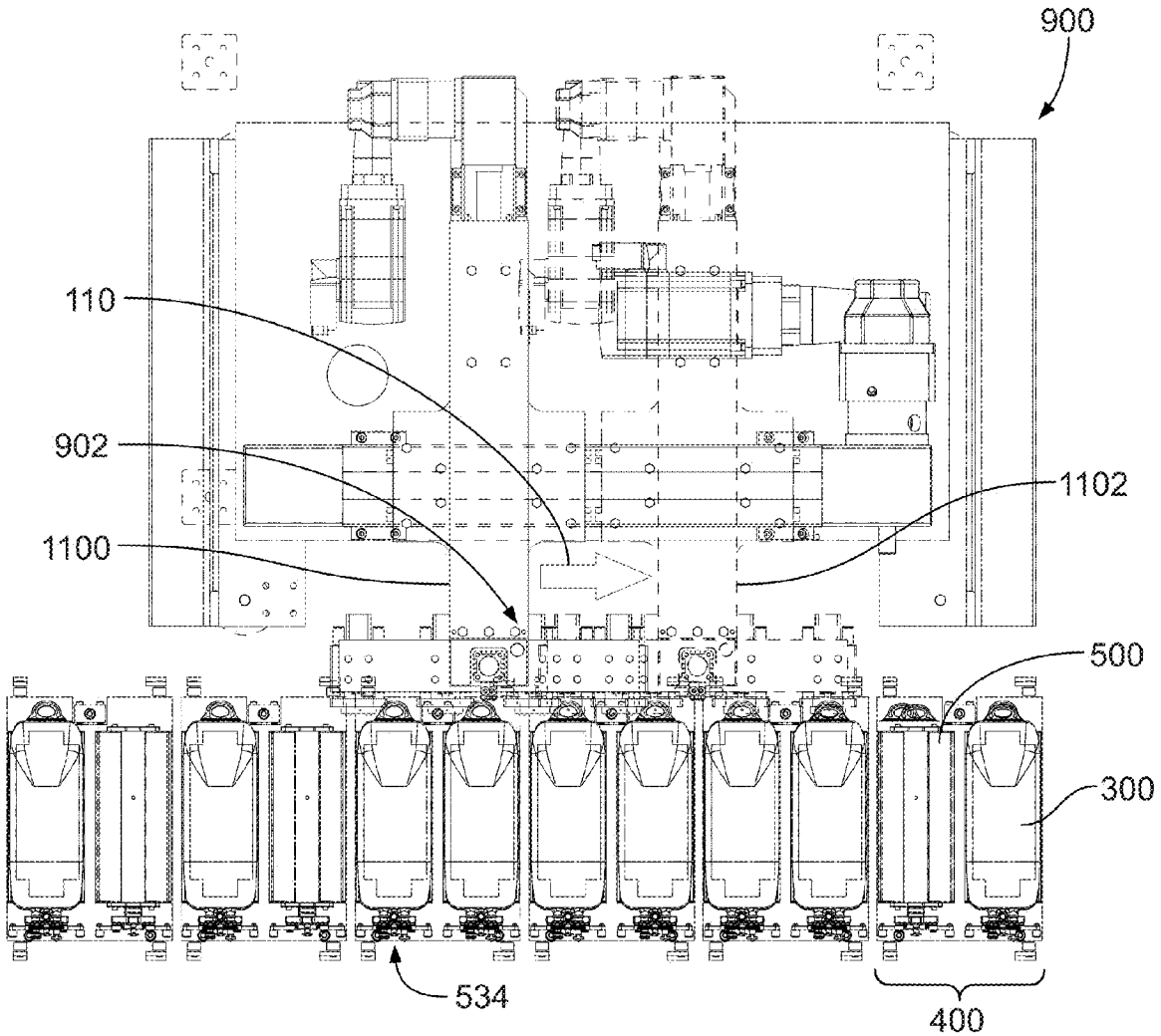
FIG. 12 illustrates a top view of the manipulation assembly with an arm at an initial position and a subsequent position during lateral movement of the arm in accordance with one embodiment.

FIG. 12 illustrates a top view of the manipulation assembly 900 with the arm 902 at an initial position 1100 and a subsequent position 1102 during lateral movement of the arm 902 in accordance with one embodiment. As described above, as the arm 902 lowers the posts 1000 (shown in FIG. 11) to engage the flexible bodies 300, the arm 902 also may laterally move along the direction of travel 110 at the same speed or approximately the same speed as the flexible bodies 300.

The arm 902 moves in a looped path or circuit to pull on the flexible bodies 300. For example, the arm 902 may move in the circuit from the initial position 1100 to the subsequent position 1102. The circuit may include the arm 902 lowering the posts 1000 to engage the flexible bodies 300, moving the posts 1000 in a direction oriented away from the fixation devices 534 to pull on the flexible bodies 300, and lifting the posts 1000 up away from the flexible bodies 300 to release the posts 1000 from the flexible bodies 300. The movement circuit may include the arm 902 moving along the direction of travel 110 from the initial position 1100 to the subsequent position 1102 for at least a portion of the circuit and then moving opposite to the direction of travel 110 from the subsequent position 1102 to the initial position 1100. As described above, movement along the direction of travel 110 from the initial position 1100 to the subsequent position 1102 can avoid twisting the flexible bodies 300 and/or pulling the flexible bodies 300 off of the beds 500 in the carriage assemblies 400.

Figure 13:
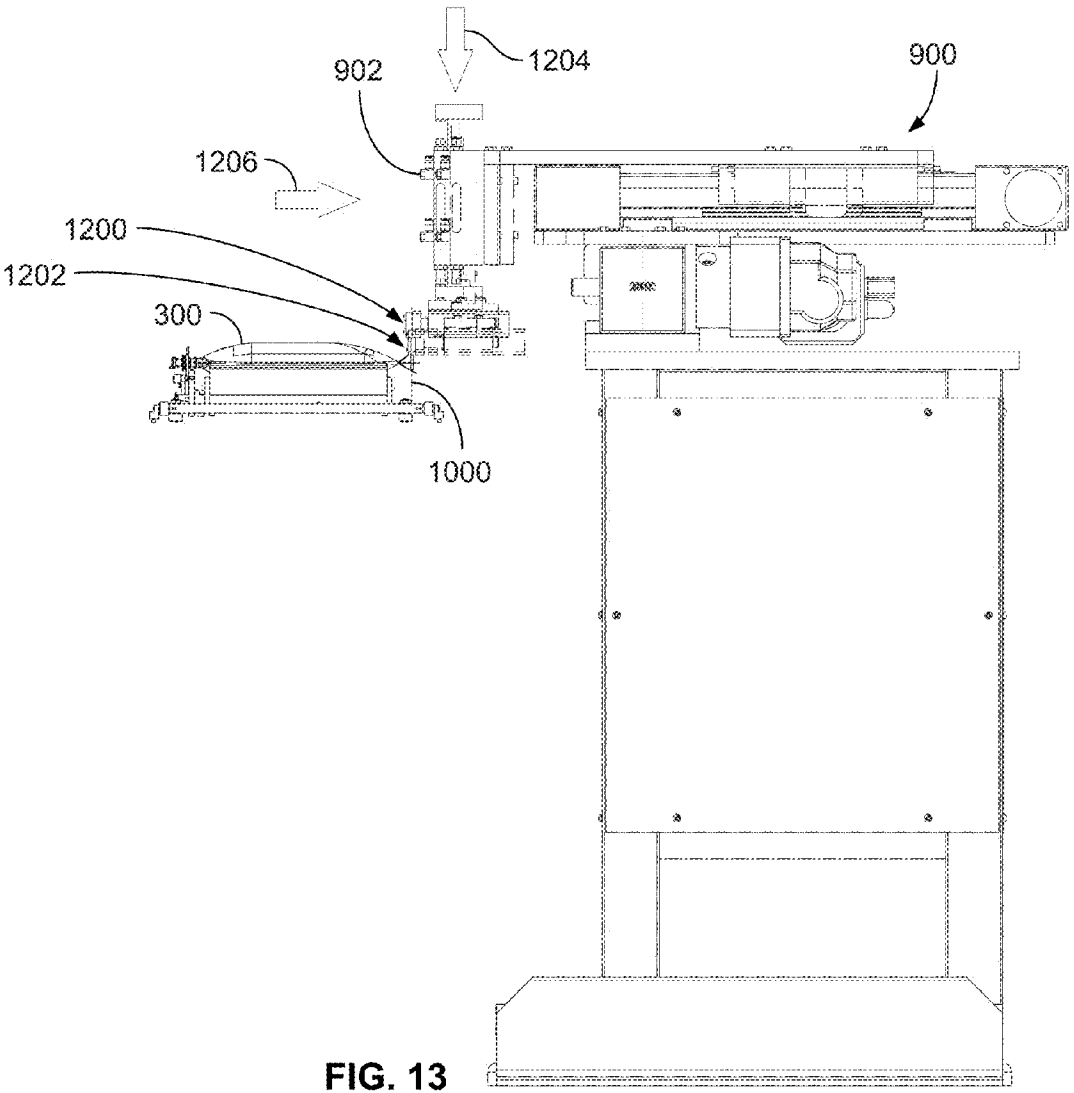
FIG. 13 illustrates a side view of the manipulation assembly with the arm at an initial position and a subsequent position during vertical movement in accordance with one embodiment.

FIG. 13 illustrates a side view of the manipulation assembly 900 with the arm 902 at an initial position 1200 and a subsequent position 1202 during vertical movement in accordance with one embodiment. As described above, the arm 902 can move in a movement circuit to pull on and flatten the flexible bodies 300. This circuit can include moving the arm 902 and posts 1000 along a lowering direction 1204 from the initial position 1200 to the subsequent position 1202 to lower the posts 1000 to engage the flexible bodies 300. The arm 902 also may move along the second rail 910 in a pulling direction 1206 to pull the flexible bodies 300 away from the fixation devices 534. After pulling on the flexible bodies 300, the arm 902 may rise in a direction that is opposite of the lowering direction 1204 to lift the posts 1000 out of the openings 326 (shown in FIG. 3) of the flexible bodies 300.

During movement of the arm 902 and posts 1000 as shown in FIGS. 11 through 13, the arm 902 and posts 1000 may simultaneously or concurrently move in longitudinal directions (e.g., along the direction of travel 110 as shown in FIG. 12) so that the posts 1000 engaged with the flexible bodies 300 move with the bodies 300, in vertical directions (e.g., perpendicular to the direction of travel 110 as shown in FIG. 13) so that the posts 1000 can be lowered into the openings 326 in the flexible bodies 300 to engage the flexible bodies 300 and/or so that the posts 1000 can be lifted out of the openings 326 to disengage from the flexible bodies 300, and/or in lateral directions (e.g., perpendicular to the direction of travel 110 and to the vertical directions as shown in FIG. 13) so that the posts 1000 pull on the flexible bodies 300.

Figure 25:
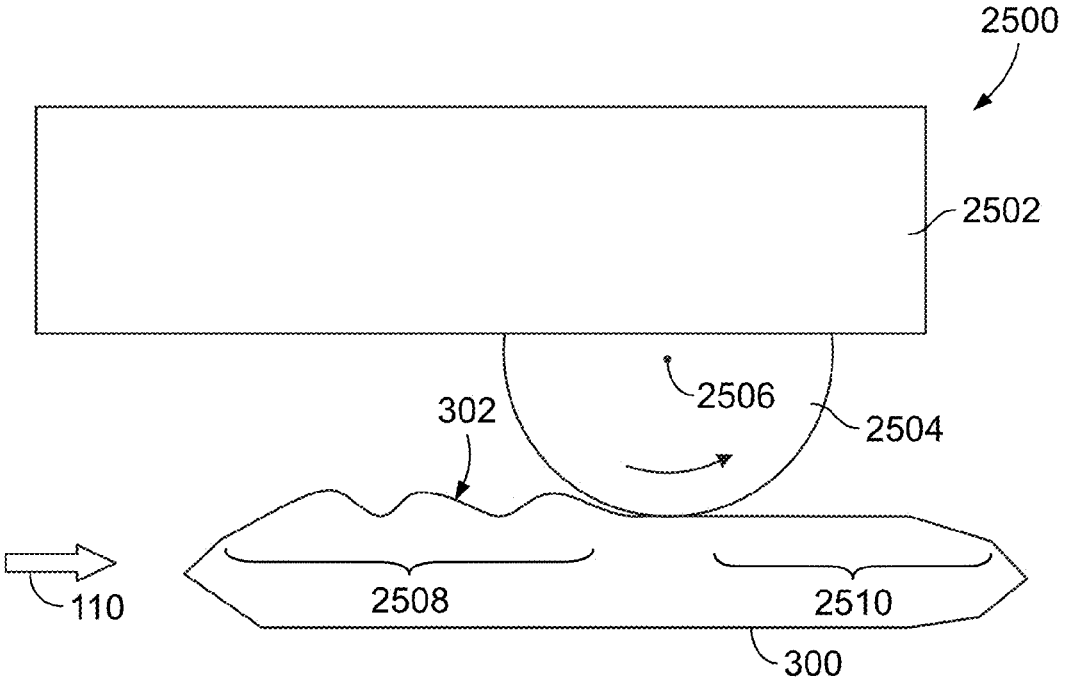
FIG. 25 is a schematic diagram of a manipulation assembly that may be included in the printing system shown in FIG. 1 in accordance with another embodiment.

FIG. 25 is a schematic diagram of a manipulation assembly 2500 that may be included in the printing system 100 shown in FIG. 1 in accordance with another embodiment. Similar to the manipulation assembly 900 (shown in FIG. 10), the manipulation assembly 2500 may be included in the preparation station 104 (shown in FIG. 1) of the printing system 100. The manipulation assembly 2500 physically manipulates the flexible bodies 300 in order to change a shape of at least a portion of the surfaces 302 of the flexible bodies 300. For example, the manipulation assembly 2500 may flatten the flexible bodies 300 so that the portion of the surfaces 302 that are to be printed on become more flat or planar that prior to being manipulated by the manipulation assembly 2500.

The flexible bodies 300 are conveyed to the manipulation assembly 2500 by the conveyance assembly 200 and the carriage assemblies 400 (not shown in FIG. 25) along the direction of travel 110. The manipulation assembly 2500 includes a housing 2502 with a roller body 2504 joined thereto. The roller body 2504 includes a cylindrical, round, or other shaped component that rotates about (e.g., around) an axis 2506. In the illustrated embodiment, the axis 2506 extends into and out of the plane of FIG. 25 (e.g., toward and away from the viewer of FIG. 25). The roller body 2504 may rotate in a counter-clockwise direction, as shown in FIG. 25, or in the opposite clockwise direction. The roller body 2504 may be joined to one or more pulleys, chains, and the like, to cause the rotation of the roller body 2504.

As the flexible bodies 300 move below the manipulation assembly 2500, the roller body 2504 engages the surfaces 302 and rolls along the surfaces 302. The rolling of the roller body 2504 on the surface 302 of a flexible body 300 at least partially flattens the surface 302, as shown in FIG. 25. For example, a leading portion 2510 of the surface 302 that moved beneath the roller body 2504 may be made more flat or planar than a trailing portion 2508 of the surface 302 that has not yet passed beneath the roller body 2504. Once the entire flexible body 300 has moved beneath the roller body 2504, the surface 302 may be more flat than prior to the flexible body 300 moving beneath the roller body 2504. While only a single roller body 2504 is shown, the manipulation assembly 2500 may include a greater number of roller bodies 2504 positioned such that the flexible body 300 sequentially moves below a series of the roller bodies 2504 to "flatten" the surface 302 (e.g., make more flat than before).

Figure 14:
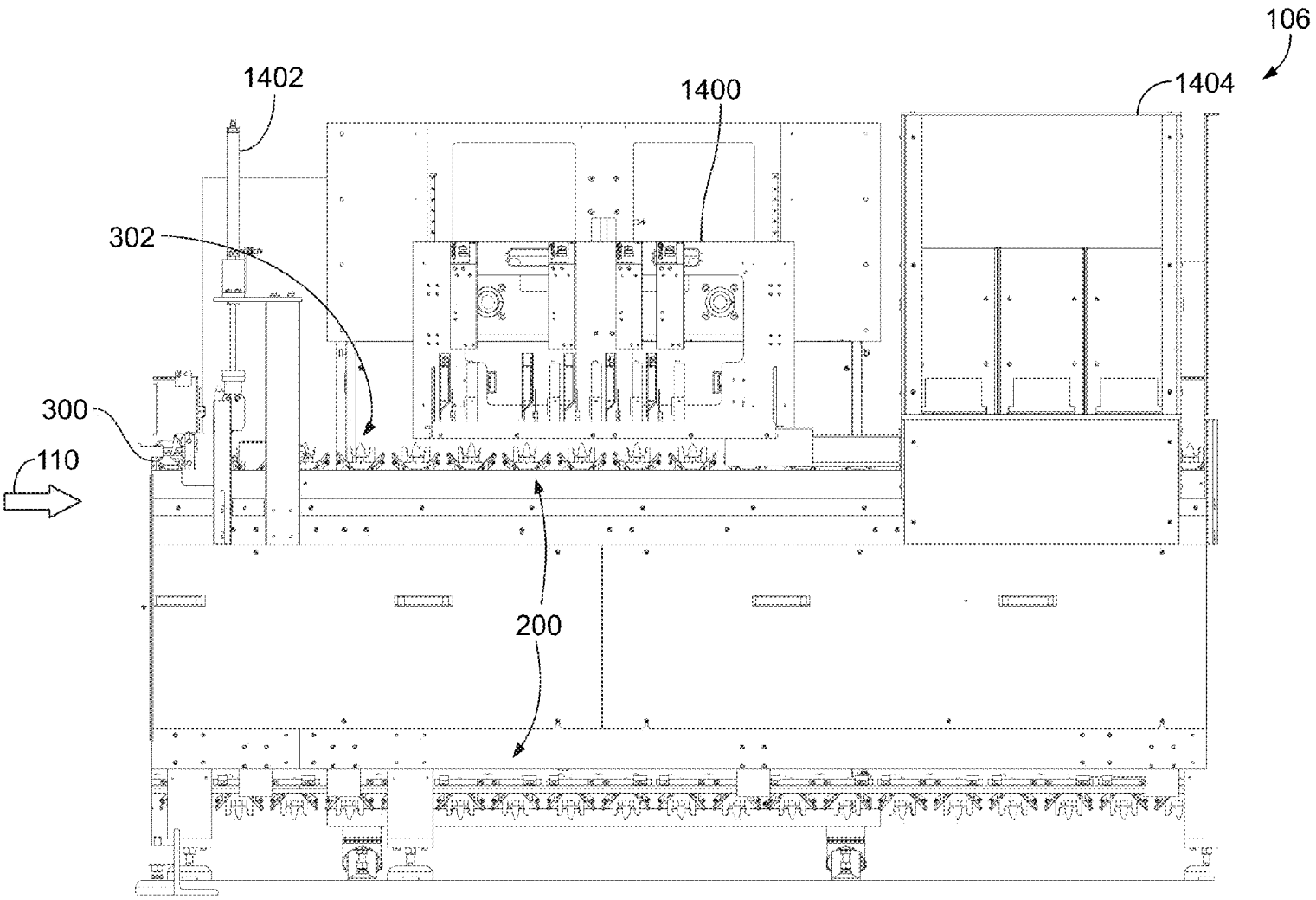
FIG. 14 is a plan view of one embodiment of a printing station shown in FIG. 1.

FIG. 14 is a plan view of one embodiment of the printing station 106 shown in FIG. 1. The printing station 106 that receives the flexible bodies 300 from the preparation station 104 (shown in FIG. 1) once the preparation station 104 has at least partially flattened upper printing surfaces 302 of the flexible bodies 300. The conveyance assembly 200 feeds the flattened flexible bodies 300 into the printing station 106 along the direction of travel 110.

The printing station 106 includes a printing assembly 1400 that deposits ink onto the surfaces 302 of the flexible bodies 300 to form the images 316 (shown in FIG. 3). In one embodiment the printing assembly 1400 includes one or more inkjet printers. The printing assembly 1400 may be a stationary device that prints on the flexible bodies 300 as the flexible bodies 300 move below and/or relative to the printing assembly 1400. Alternatively, the printing assembly 1400 may include another type of printing device, such as a pad printing system that transfers ink from a cliché plate to the flexible bodies 300 using a deformable pad. In another embodiment, another type of printing system may be used.

As described above, the conveyance assembly 200 moves the carriage assemblies 400 that hold the flexible bodies 300 through the printing station 106 so the printing station 106 can print on the flexible bodies 300. The conveyance assembly 300 may include relatively large sprocket wheels 402 (shown in FIG. 4) and/or relatively large roller chains 404 in order to reduce an amount of slippage of the carriage assemblies 400 (e.g., unintended or undesired movement of the carriage assemblies 400) when the printing station 106 is printing on the flexible bodies 300. For example, the sprocket wheels 402 may have relatively large diameters and/or teeth (e.g., several orders of magnitude larger than the resolution size of the images being printed on the flexible bodies 300) to reduce slippage. Additionally or alternatively, the roller chains 404 may include ball bearings or other mechanisms for causing the chains 404 to more easily roll around the sprocket wheels 402 to reduce slippage.

The printing station 106 illustrated in FIG. 14 includes a pre-treatment assembly 1402 located upstream of the printing assembly 1400 along the direction of travel 110. For example, the flexible bodies 300 may travel through or below the pre-treatment assembly 1402 prior to traveling through or below the printing assembly 1400 along the direction of travel 110. The pre-treatment assembly 1402 can change an electrical and/or chemical characteristic of the surfaces 302 of the bodies 300 to improve or enable the surfaces 302 to receive the ink used to form the images 316. For example, the bodies 300 may be formed from a polymer material to which the ink may not adhere. In order to cause the ink to better adhere to the surfaces 302 of the bodies 300, the pre-treatment assembly 1402 can change electrical and/or chemical characteristics of the surfaces 302.

In one embodiment, the pre-treatment assembly 1402 exposes the surfaces 302 of the bodies 300 to heat, such as by generating a flame or heated volume through which the surfaces 302 to be printed upon pass under or through. The heat can change chemical properties of the surfaces 302 such that the ink better adheres to the surfaces 302 than prior to exposing the surfaces 302 to the heat. Additionally or alternatively, the pre-treatment assembly 1402 may generate an electric field or other electric energy through which the surfaces 302 pass in order to discharge static electricity from the printing surfaces 302 of the bodies 300. Removing the static electricity can improve adhesion of ink to the surfaces 302.

The printing station 106 shown in FIG. 14 includes a post-treatment assembly 1404 disposed downstream from the printing assembly 1400 with respect to the direction of travel 110 of the flexible bodies 300. The post-treatment assembly 1404 can treat the ink and/or printed surfaces 302 of the flexible bodies 300 in order to prevent smearing of the images formed on the flexible bodies 300. For example, the post-treatment assembly 1404 can include an energy source that exposes the printed surfaces 302 of the bodies 300 to energy in order to cure the ink. The energy to which the printed surfaces 302 are exposed can include light of a designated wavelength or range of wavelengths (such as ultraviolet light), heat, electric current, electric fields, and the like. The energy can cure the ink to prevent the ink from smearing, blurring, and the like, during subsequent handling of the bodies 300.

Figure 26:
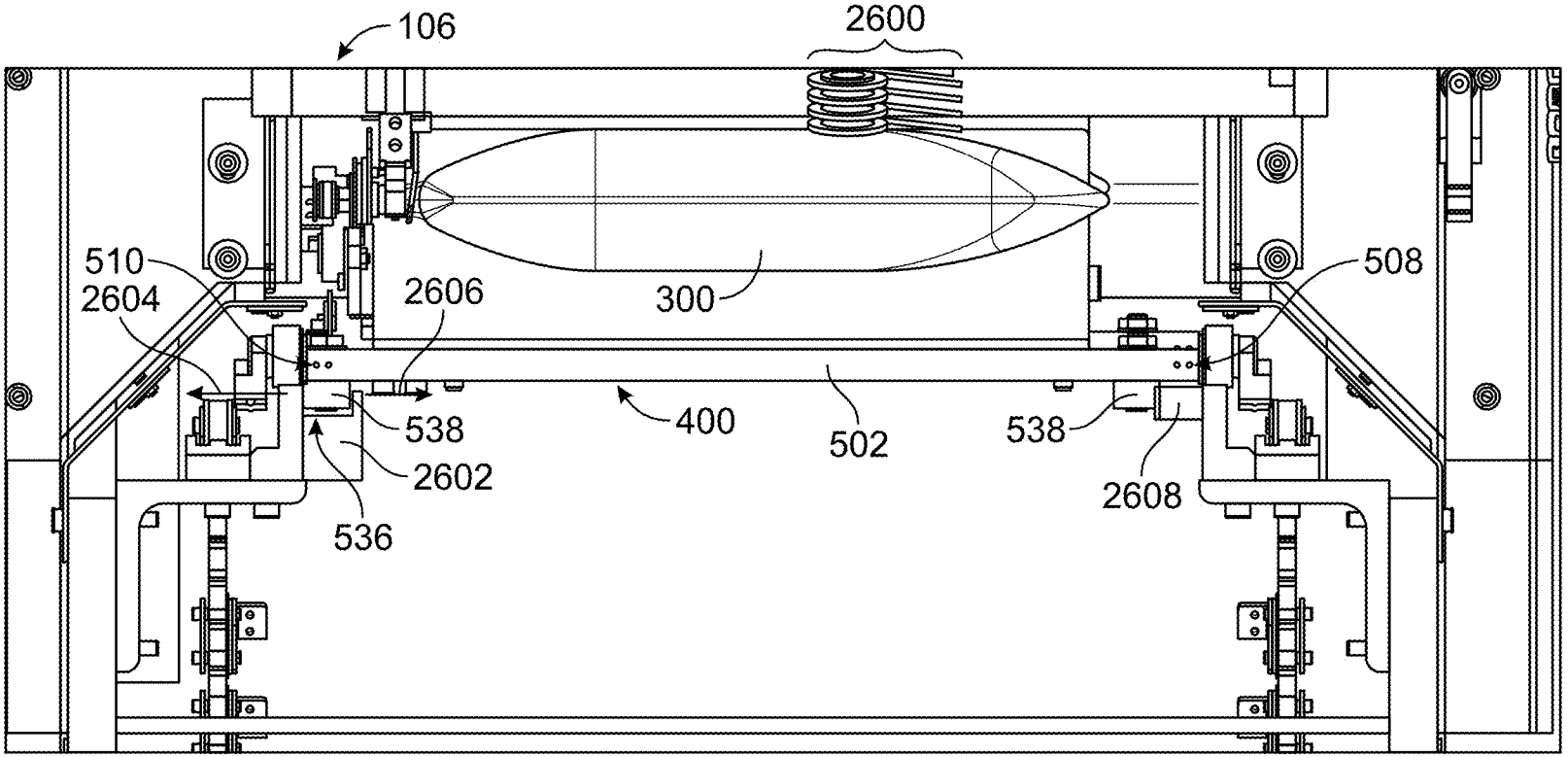
FIG. 26 is a plan view of a lower portion of the printing station in accordance with one embodiment.

FIG. 26 is a plan view of a lower portion of the printing station 106 in accordance with one embodiment. The portion of the printing station 106 shown in FIG. 26 shows the position of the carriage assembly 400 and a flexible body 300 beneath a print head 2600 of the printing station 106. The beds 500 of the carriage assembly 400 are not shown in FIG. 26. The printing station 106 includes a rail 2602 that is elongated along the direction of travel 110 (shown in FIG. 1) and that receives one of the bearings 538 of the carriage assembly 400. The rail 2602 may extend through the print station 106 below locations where the flexible body 300 is printed upon. The rail 2602 restricts lateral movement of the bearing 538 (e.g., movement along either lateral direction 2604, 2606 that is not along the direction of travel 110) as the carriage assembly 400 moves beneath the print head 2600 of the printing station 106. The print head 2600 represents the component of the printing station 106 that prints the images and/or text on the flexible body 300, such as an ink jet nozzle, printing pad, and the like. The restriction of lateral movement of the bearing 538 also restricts lateral movement of the carriage assembly 400 and flexible body 300 in the directions 2604, 2606 during the printing on the flexible body 300. In the illustrated embodiment, the printing station 106 includes another elongated rail 2608 that engages the bearing 538 on the opposite side of the carriage assembly 400. The elongated rails 2602, 2608 may be laterally spaced apart from each other such that the bearings 528 on the opposite ends 508, 510 are compressed toward each other. This compression also may compress the resilient bodies 542 (shown in FIG. 5) of the positioning devices 536 of the carriage assembly 400. For example, the positioning devices 536 on the opposite ends 508, 510 of the base plate 502 in the carriage assembly 400 may be forced toward each other and toward the base plate 502. The resilient bodies 542 may be compressed and apply forces that center the base plate 502 between the rails 2602, 2608 and/or maintain a lateral position of the base plate 502 between the rails 2602, 2608. The resilient bodies 542 can assist in maintaining the lateral position of the carriage assembly 400 and the flexible body 300 as the flexible body 300 is printed upon. For example, the compression of the resilient bodies 542 can reduce or eliminate movement of the flexible body 300 in either lateral direction 2604, 2606.

Figure 15:
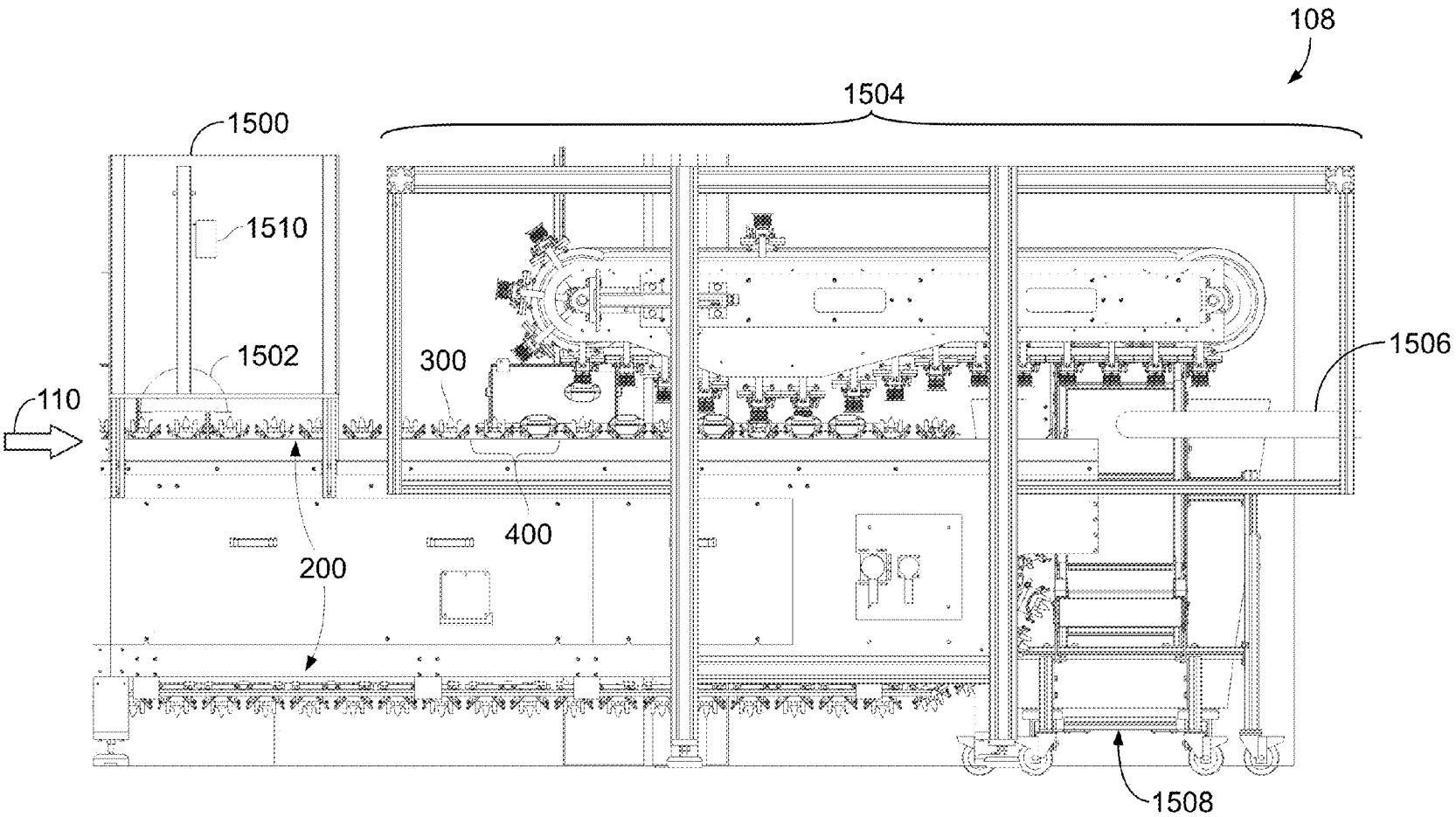
FIG. 15 is a plan view of one embodiment of a selection station shown in FIG. 1.

FIG. 15 is a plan view of one embodiment of the selection station 108 in the printing system 100 shown in FIG. 1. The selection station 108 receives the flexible bodies 300 from the printing station 106. The selection station 108 can examine the images 316 (shown in FIG. 3) printed on the flexible bodies 300 and determine whether the images 316 are acceptable or unacceptable. In the illustrated embodiment, the selection station 108 includes an examination assembly 1500 that examines the images 316 on the flexible bodies 300. The examination assembly 1500 may include a machine vision device 1502 that optically examines the images 316. The vision device 1502 can obtain a picture or video of the images 316 (referred to herein as optical inspection data) as the bodies 300 move below the vision device 1502 and compare the optical inspection data to designated inspection data. The designated inspection data represents what the image 316 should look like, such as what graphics should be included in the image 316, the locations of the graphics, the text that should be included in the image 316, the information conveyed by the text, the relative arrangement (e.g., positions) of the graphics and text, and the like.

The vision device 1502 can compare the optical inspection data with the designated inspection data and identify differences between the optical inspection data and the designated inspection data. These differences may be the result of an image 316 being partially formed on a flexible body 300, an image 316 being misaligned (e.g., askew) on the body 300, an image 316 including the wrong graphics and/or text, an image 316 being smeared or otherwise not clear, and the like. In one embodiment, the vision device 1502 includes or represents a control unit 1510, such as a processor, controller, or the like, and associated instructions, such as software and/or hard-wired instructions, that control operations of the vision device 1502 and/or selection station 108. For example, such a control unit can determine which flexible bodies 300 are acceptable or unacceptable and control which flexible bodies 300 are removed from the carriage assemblies 400, as described below.

The selection station 108 includes a gripping assembly 1504 that grips and removes selected ones of the flexible bodies 300 from the carriage assemblies 400. For example, responsive to the vision device 1502 identifying which flexible bodies 300 have acceptable images 316 (e.g., those images that match the designated inspection data) and/or which flexible bodies 300 have unacceptable images 316 (e.g., those images that do not match the designated inspection data), the gripping assembly 1504 may remove some of the flexible bodies 300 from the carriage assemblies 400 while the other flexible bodies 300 remain on the carriage assemblies. In one embodiment, the gripping assembly 1504 grips and removes the flexible bodies 300 having acceptable images 316 and takes the removed flexible bodies 300 to a collection location 1506, such as a conveyance assembly. The collection location 1506 can transport the removed flexible bodies 300 to another location, such as a packaging location for packing and transport of the flexible bodies to a consumer. The flexible bodies 300 having unacceptable images 316 may remain in the carriage assemblies 400 and be conveyed by the conveyance assembly 200 to a collection location 1508. The collection location 1508 can include a receptacle or other conveyance assembly to receive the flexible bodies 300 with the unacceptable images 316. These flexible bodies 300 may then be discarded or have the unacceptable images 316 removed. Alternatively, if the flexible bodies 300 with acceptable images 316 are conveyed to the collection location 1508, then the flexible bodies 300 can be collected at the location 1508 for packaging and transmittal to consumers or distributors, for example.

Figure 16:
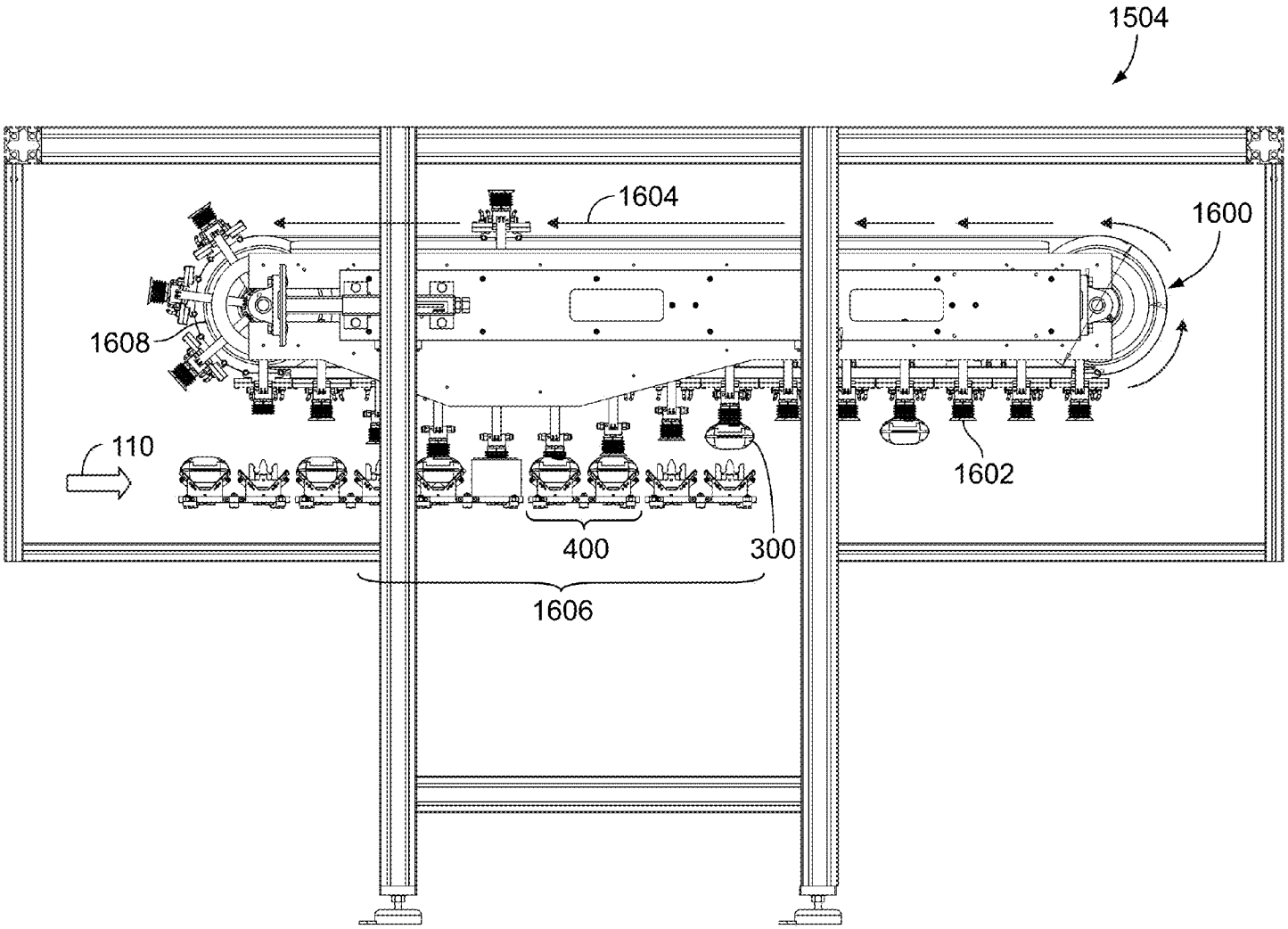
FIG. 16 is a plan view of one embodiment of a gripping assembly of the selection station shown in FIG. 15.

FIG. 16 is a plan view of one embodiment of the gripping assembly 1504 of the selection station 108 shown in FIG. 15. The illustrated gripping assembly 1504 includes a carousel device 1600 that moves several gripping devices 1602 around a looped path 1604. In the illustrated embodiment, the looped path 1604 is generally oval in shape, but alternatively, another shape may be used. The gripping devices 1602 may be coupled with a chain, conveyor, or other assembly of the carousel device 1600 (e.g., a belt 1608) that is moved by a motor or other device to move the gripping devices 1602 along the looped path 1604 in the illustrated direction.

Additional gripping devices 1602 than those shown in FIG. 16 may be provided. For example, more gripping devices 1602 may be connected with the carousel device 1600 and spaced apart from each other to correspond with the spacing between the flexible bodies 300. The gripping devices 1602 may be spaced apart from each other by the same or similar distance that separates the flexible bodies 300 along the direction of travel 110 of the flexible bodies 300 (the conveyance assembly 200 that moves the flexible bodies 300 on the carriage assemblies 400 is not shown in FIG. 16). The gripping devices 1602 may be moved around the looped path 1604 at the same or approximately the same speed at which the flexible bags 300 and carriage assemblies 400 move along the direction of travel 110. As a result, each gripping device 1602 can grip and remove a different flexible body 300 from the carriage assemblies 400 with adjacent or neighboring flexible bodies 300 being removed by different gripping devices 1602.

In the illustrated embodiment, the carousel device 1600 moves the gripping devices 1602 in a downward direction toward the flexible bodies 300 on the carriage assemblies 400 in an engagement portion 1606 of the looped path 1604. During the engagement portion 1606, the gripping devices 1602 lower to engage the flexible bodies 300. The gripping devices 1602 may engage the printed surfaces 302 of the flexible bodies 300. Alternatively or additionally, the gripping devices 1602 may engage other parts of the flexible bodies 300.

The gripping devices 1602 may lower and engage each of the flexible bodies 300 in one embodiment. The gripping devices 1602 can grip one or more of the flexible bodies 300 (referred to herein as selected flexible bodies 300) while not gripping one or more other flexible bodies 300 (referred to herein as other flexible bodies 300). As described above, in one embodiment, the selected flexible bodies 300 are the bodies 300 having acceptable images 316 while the other flexible bodies 300 have unacceptable images 316 or are otherwise unacceptable for use. Alternatively, the selected flexible bodies 300 can be the bodies 300 having unacceptable images 316 or otherwise being unacceptable for use while the other flexible bodies 300 have acceptable images 316.

When the gripping devices 1602 are lowered to engage the flexible bodies 300, the gripping devices 1602 that engage the selected flexible bodies 300 grip the flexible bodies 300 using suction pressure. For example, a vacuum or partial vacuum (e.g., a pressure that is lower than atmospheric pressure) may be generated between the gripping device 1602 and the flexible body 300 such that the flexible body 300 remains engaged to the gripping device 1602 when the gripping device 1602 moves away from the carriage assemblies 400 as the gripping device 1602 moves along the looped path 1604. In the illustrated embodiment, the gripping devices 1602 move away from the carriage assemblies 400 at or near the right side of the engagement portion 1606 of the looped path 1604.

The vacuum or partial vacuum may be maintained between the gripping device 1602 and the flexible body 300 as the carousel device 1600 continues to move the gripping device 1602 along the looped path 1604 and the conveyance assembly 200 continues to move the carriage assembly 400 that previously held the flexible body 300 in the direction of travel 110. When the gripping device 1602 that has gripped and lifted a flexible body 300 off of the carriage assembly 400 reaches a location where the flexible body 300 is to be released (e.g., when the flexible body 300 and gripping device 1602 are above the collection location 1506 (shown in FIG. 15), then the vacuum or partial vacuum between the gripping device 1602 and the flexible body 300 may be released (e.g., destroyed or removed) so that the gripping device 1602 releases the flexible body 300. The flexible body 300 may then fall onto the collection location 1506 to be taken to another location, as described above.

The flexible bodies 300 that are not gripped and removed from the carriage assemblies 400 by the gripping devices 1602 may continue to travel on the carriage assemblies 400 toward the collection location 1508. As shown in FIG. 15, in one embodiment, the conveyance assembly 200 may turn around a sprocket wheel that is similar to the sprocket wheel 402 shown in FIG. 4 downstream of the engagement portion 1606 of the looped path 1604 along the direction of travel 110. The conveyance assembly 200 may turn around the wheel and return to the opposite end of the printing system 100 (shown in FIG. 1) below the various stations of the printing system 100. As the conveyance assembly 200 turns around the wheel, the flexible bodies 300 that remain in the carriage assemblies 400 (e.g., those flexible bodies 300 that were not removed by the gripping devices 1602) may be released from the carriage assemblies 400. For example, the weight of the flexible bodies 300 may force the ports 310 (shown in FIG. 3) out of engagement with the fixation devices 534 (shown in FIG. 5). The forces applied to the ports 310 by the locking fingers 600, 602 in the fixation devices 534 may be insufficient to hold the ports 310 in the fixation devices 534 and, as a result, the flexible bodies 300 may be released and fall onto the collection location 1508. Alternatively or additionally, a releasing device may be used to disengage the flexible bodies 300 from the fixation devices 534, as described below.

Figure 17:
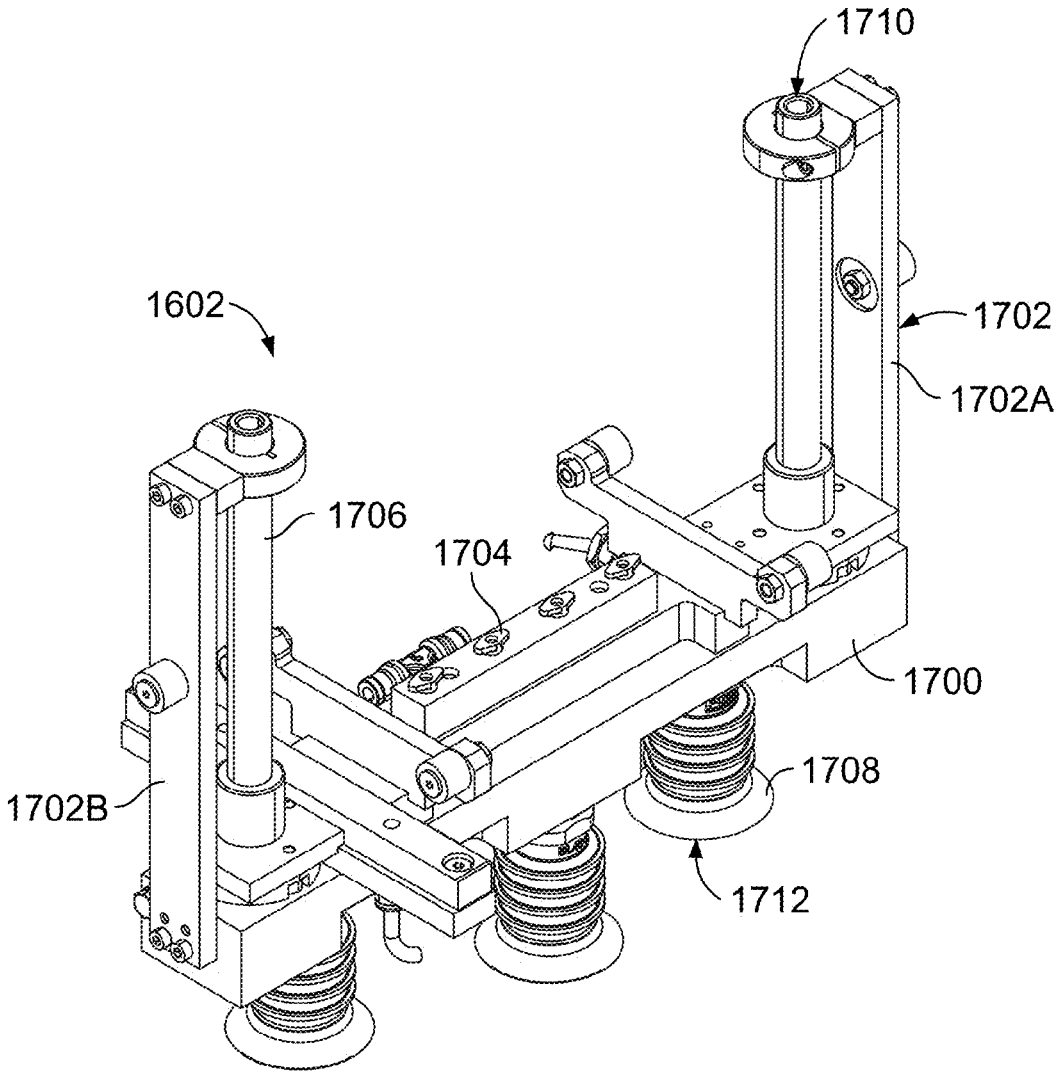
FIG. 17 is a perspective view of one embodiment of a gripping device shown in FIG. 16.
Figure 18:
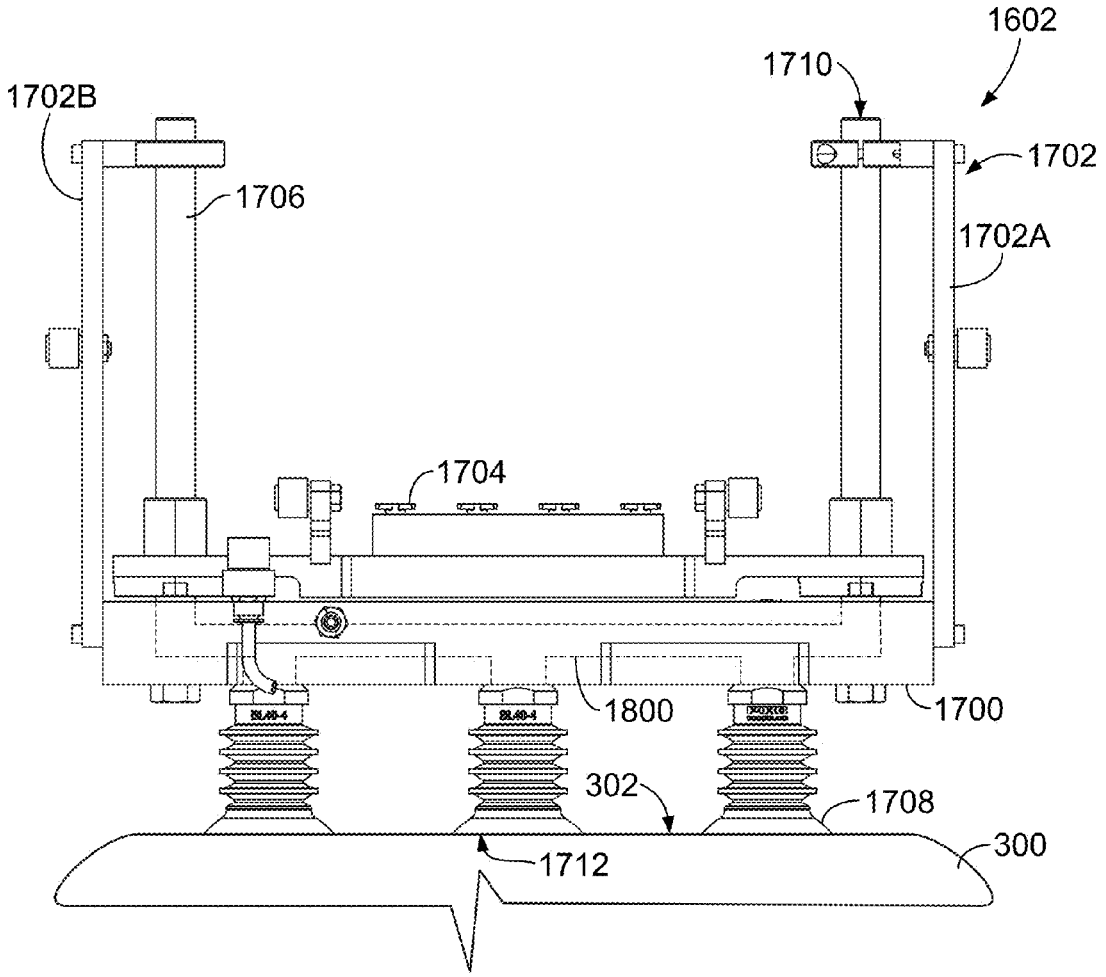
FIG. 18 is a plan view of the gripping device shown in FIG. 17.

FIG. 17 is a perspective view of one embodiment of one of the gripping devices 1602 shown in FIG. 16. FIG. 18 is a plan view of the gripping device 1602 shown in FIG. 17. The gripping device 1602 includes a manifold block member 1700 that is joined with elongated plates 1702 (e.g., plates 1702A, 1702B) joined to opposite ends of the manifold block member 1700. Several connectors 1704 are provided on the manifold block member 1700 to secure the gripping device 1602 to the belt 1608 (shown in FIG. 16) of the carousel device 1600 (shown in FIG. 16). Alternatively, another device may be used to secure the gripping device 1602 to the belt 1608. Two conduits 1706 extend along the elongated plates 1702 and are joined to the manifold block member 1700. While two conduits 1706 are shown, alternatively, a single conduit 1706 or more than two conduits 1706 may be provided. The conduits 1706 are fluidly coupled with an interior space of the manifold block member 1700. For example, the manifold block member 1700 may include one or more interior channels, chambers, conduits, and the like, that are fluidly coupled with the conduits 1706. One example of such an interior space is schematically shown in FIG. 18 as an interior chamber 1800. The illustrated interior chamber 1800 is merely one example and may take other shapes, arrangements, and the like.

The gripping device 1602 includes engagement members 1708 connected with the manifold block member 1700. The engagement members 1708 contact and grip the flexible bodies 300. In the illustrated embodiment, several suction cups represent the engagement members 1708. Alternatively, other devices may be used, such as robotically controlled fingers, hooks, and the like. The engagement members 1708 can represent flexible members that engage the flexible bodies 300 (shown in FIG. 3), as described above. For example, the engagement members 1708 may be suction cups made of a flexible material. The engagement members 1708 are fluidly coupled with the interior chamber 1800 of the manifold block member 1700. A vacuum or partial vacuum can be created in a volume that is bounded by the conduits 1706, the interior chamber 1800 of the manifold block member 1700, and the cups 1708. As described below, open ends 1710 of the conduits 1706 may be fluidly coupled with a pump that reduces the air pressure in the conduits 1706, the interior chamber 1800 of the manifold block member 1700, and in the engagement members 1708. When open ends 1712 of the engagement members 1708 are engaged to the surface 302 of the flexible body 300, as shown in FIG. 18, the vacuum or partial vacuum in the engagement members 1708, interior chamber 1800, and conduits 1706 can apply a suction force to the flexible body 300. As a result, the flexible body 300 may be coupled with the engagement members 1708 and lifted from the carriage assembly 400 (shown in FIG. 4), as described above. In order to release the flexible body 300 from the engagement members 1708, the vacuum or partial vacuum may be released, such as by increasing the pressure inside the volume that is defined by the engagement members 1708, the interior chamber 1800 of the manifold block member 1700, the conduits 1706, and the surface 302 of the flexible body 300.

Figure 19:
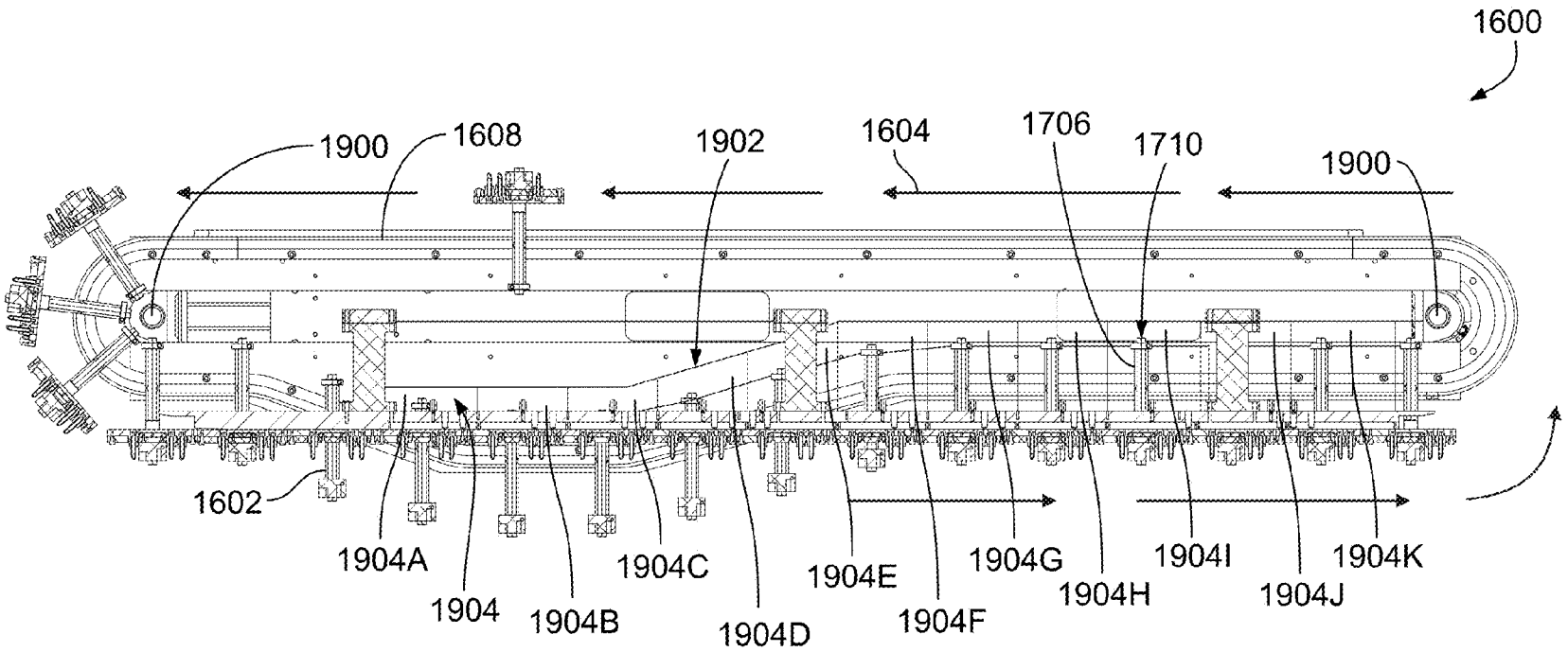
FIG. 19 is a cross-sectional view of one embodiment of a carousel device shown in FIG. 16.

FIG. 19 is a cross-sectional view of one embodiment of the carousel device 1600 shown in FIG. 16. The carousel device 1600 includes pulleys 1900 around which the belt 1608 is rotated to move the gripping devices 1602 around the looped path 1604. Disposed inside the carousel device 1600 is a vacuum manifold 1902 of the gripping assembly that is fluidly coupled with the vacuum pump 112 (shown in FIG. 1) by the conduit 114 (also shown in FIG. 1). The vacuum pump 112 can draw a vacuum or partial vacuum inside the vacuum manifold 1902. In one embodiment, the vacuum manifold 1902 includes a series of cells 1904 (e.g., cells 1904A-K) that are separately connected with the vacuum pump 112. Although eleven cells 1904 are shown, alternatively, a different number of cells 1904 may be provided.

The open ends 1710 of the conduits 1706 in the gripping devices 1602 may be fluidly coupled with the cells 1904. For example, the conduits 1706 of the gripping devices 1602 may be sealed against the cells 1904 so that the vacuum or partial vacuum that is created in the cells 1904 of the vacuum manifold 1902 also is created in the gripping devices 1602 to allow gripping of the flexible bodies 300, as described above.

Figure 20:
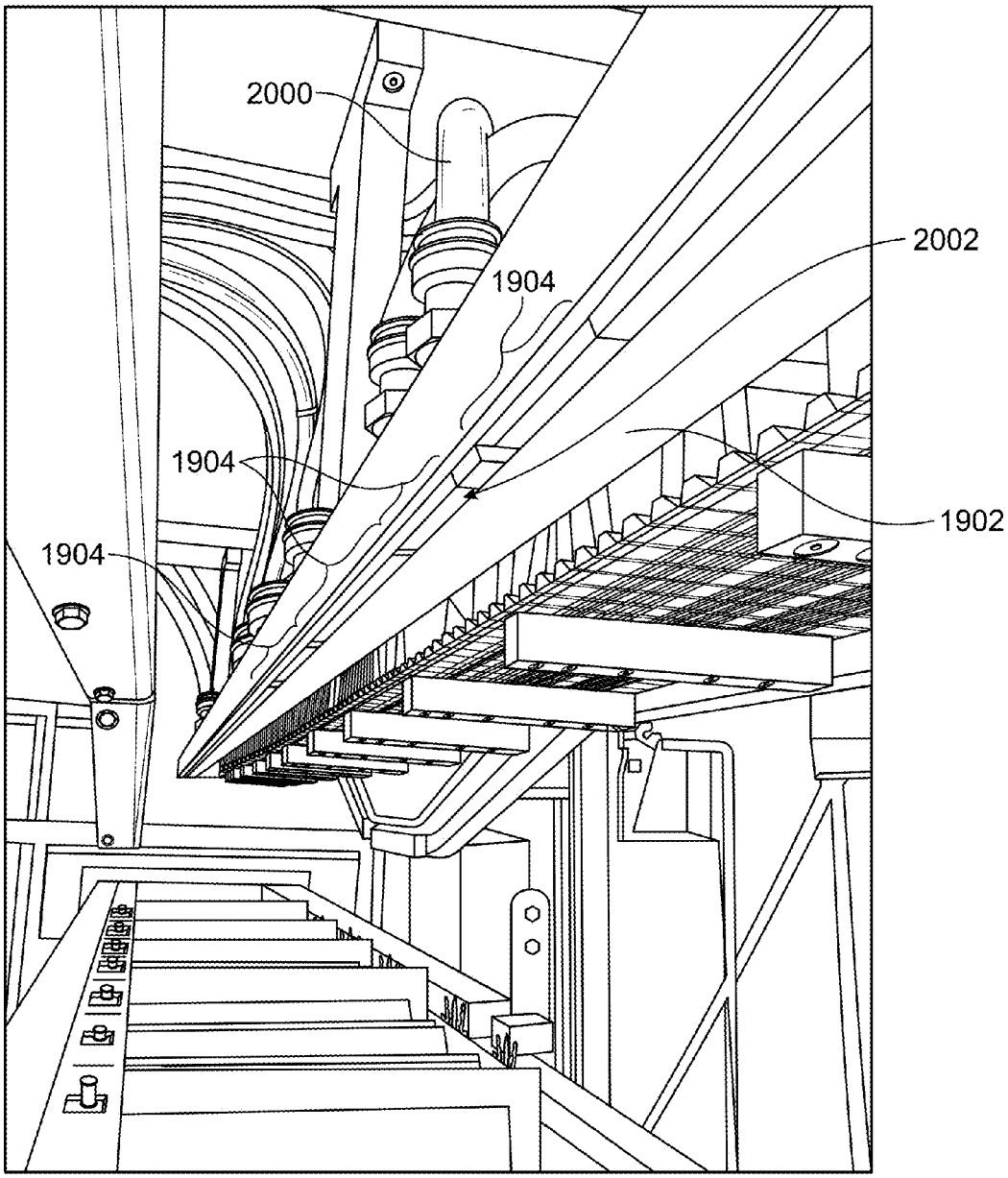
FIG. 20 is a perspective view of one embodiment of a vacuum manifold of the carousel device shown in FIG. 19.

With continued reference to the carousel device 1600 shown in FIG. 19, FIG. 20 is a perspective view of one embodiment of the vacuum manifold 1902 of the carousel device 1600 shown in FIG. 19. In the illustrated embodiment, the vacuum manifold 1902 is an elongated body that includes the cells 1904 linearly aligned with each other in series. The cells 1904 include outlets 2002, such as elongated slots, to which the open ends 1710 (shown in FIG. 17) of the conduits 1706 (shown in FIG. 17) in the gripping devices 1602 (shown in FIG. 16) may be fluidly coupled. The outlets 2002 of the cells 1904 are aligned with each other along the direction in which the open ends 1710 of the gripping devices 1602 move when the gripping devices 1604 move along the looped path 1604 (shown in FIG. 16) of the carousel device 1600. As a result, the open ends 1710 of the gripping devices 1602 move along the vacuum manifold 1902 sequentially through the cells 1904. The conduits 1706 of the gripping devices 1602 become sealed to and fluidly coupled with the cells 1904 as the open ends 1710 move through the cells 1904.

The control unit 1510 (shown in FIG. 15) or other processing device can individually control which of the cells 1904 are drawing a vacuum or partial vacuum and when the cells 1904 are drawing the vacuum or partial vacuum in order to individually control which of the gripping devices 1602 is gripping a flexible body 300 (shown in FIG. 3). The cells 1904 may not be fluidly coupled with each other. For example, when a vacuum or partial vacuum is drawn in a first cell 1904A, the same vacuum may not be drawn in the neighboring cell 1904B (or another cell 1904) unless the neighboring cell 1904B also is drawing a vacuum. Individually controllable timing elements 2000, such as valves, hoses, and the like, may be opened or closed based on control signals generated by the control unit to determine when each of the cells 1904 is drawing a vacuum or partial vacuum. In one embodiment, each cell 1904 is associated with a separate timing element 2000 that opens or closes based on commands from the control unit to allow the vacuum system 112 (shown in FIG. 1) to draw a vacuum or release a vacuum in the cell 1904, respectively.

In order to cause a gripping device 1602 that is moving in the carousel device 1600 to grip a flexible body 300, lift, and carry the flexible body 300, the control unit 1510 can direct a sequence of cells 1904 through which the gripping device 1602 is fluidly coupled as the gripping device 1602 moves in the looped path 1604 to draw vacuums at times when the gripping device 1602 is fluidly coupled with the different cells 1904. For example, if the gripping device 1602 is fluidly coupled with the cells 1904A-K as the gripping device 1602 moves to grip and move a flexible body 300, then the cell 1904A may be controlled to first draw a vacuum during the time period that the gripping device 1602 is fluidly coupled with the cell 1904A, then the cell 1904B may be controlled to draw a vacuum during the time period that the gripping device 1602 is fluidly coupled with the cell 1904B, then the cell 1904C may be controlled to draw a vacuum during the time period that the gripping device 1602 is fluidly coupled with the cell 1904C, and so on. When the gripping device 1602 is no longer coupled with a cell 1904, the vacuum that is being drawn in that cell 1904 can be destroyed (e.g., no longer established). However, if a subsequent gripping device 1602 enters the same cell 1904 that a previous gripping device 1602 left, and both the previous and subsequent gripping devices 1602 are gripping flexible bodies 300, then the vacuum in that cell 1904 may continue to be drawn after the previous gripping device 1602 leaves the cell 1904 so that the flexible body 300 carried by the subsequent gripping device 1602 is not dropped.

Figure 21:
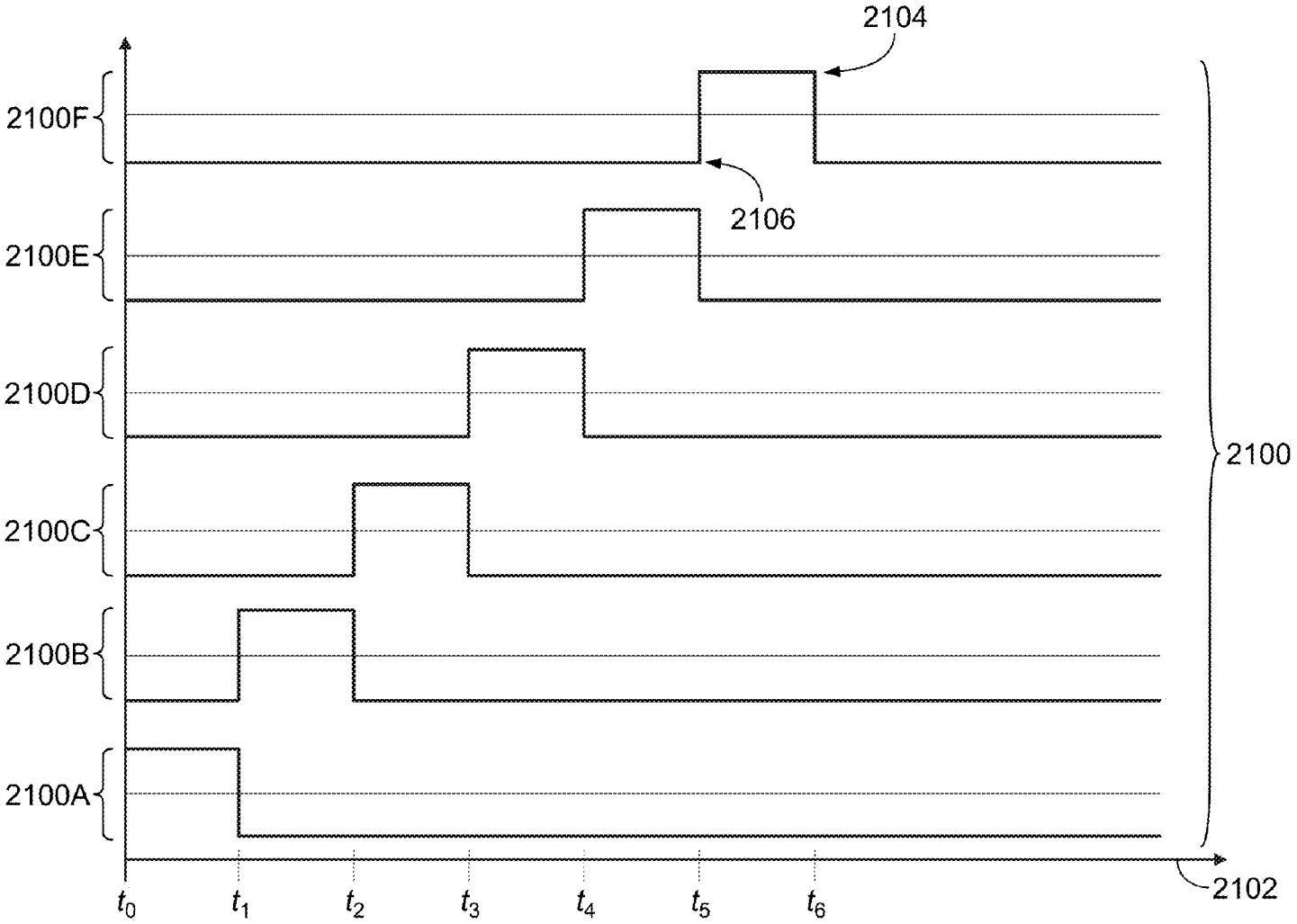
FIG. 21 illustrates timing diagrams for controlling when a vacuum or partial vacuum is drawn in cells of the vacuum manifold shown in FIG. 19 according to one example.

FIG. 21 illustrates timing diagrams 2100 (e.g., timing diagrams 2100A-F) for controlling when a vacuum or partial vacuum is drawn in the cells 1904 shown in FIG. 19 according to one example. The timing diagrams 2100 represent when the timing elements 2000 (shown in FIG. 20) of the cells 1904A-F (shown in FIG. 19) are opened to create a vacuum in a gripping device 1602 that is fluidly coupled with the cell 1904 and when the timing elements 2000 are closed to terminate the vacuum (e.g., when the gripping device 1602 is no longer coupled with the cell 1904). The first timing diagram 2100A corresponds to the first cell 1904A, the second timing diagram 2100B corresponds to the second cell 1904B, and so on.

The timing diagrams 2100 are shown alongside a horizontal axis 2102 representative of time. Each timing diagram 2100 alternates between a high value 2104 and a low value 2106. The high values 2104 represent the time periods during which the corresponding cell 1904 is drawing a vacuum and the low values 2106 represent the time periods during which the corresponding cell 1904 is not drawing a vacuum. The timing diagrams 2100 of FIG. 21 can be used to enable a single gripping device 1602 to grip a flexible body 300 and move the flexible body 300 through the cells 1904A-F along the looped path 1604. Additional timing diagrams 2100 may be provided for additional cells 1904.

In the illustrated example, during a first time period (e.g., from time $t_0$ to subsequent time $t_1$), the gripping device 1602 is fluidly coupled with the first cell 1904A and a vacuum is drawn in the first cell 1904A. As a result, the gripping device 1602 is able to grip a flexible body 300, as described above. The remaining cells 1904B-F may not be drawing a vacuum. Consequently, the gripping devices 1602 that are fluidly coupled with the cells 1904B-F may not establish a vacuum to grip flexible bodies 300.

During a subsequent second time period (e.g., from time $t_1$ to subsequent time $t_2$), the gripping device 1602 is fluidly coupled with the second cell 1904B and is no longer coupled with the first cell 1904A. A vacuum is drawn in the second cell 1904B and, as a result, the gripping device 1602 is able to continue gripping the flexible body 300. The remaining cells 1904A and 1904C-F may not be drawing a vacuum. For example, the vacuum that was being drawn by the first cell 1904A may no longer be drawn. Consequently, the gripping devices 1602 that are fluidly coupled with the cells 1904A and 1904C-F may not establish a vacuum to grip flexible bodies 300.

During a subsequent third time period (e.g., from time $t_2$ to subsequent time $t_3$), the gripping device 1602 is fluidly coupled with the third cell 1904C and is no longer coupled with the second cell 1904B. A vacuum is drawn in the third cell 1904C and, as a result, the gripping device 1602 is able to continue gripping the flexible body 300. The remaining cells 1904A-B and 1904D-F may not be drawing a vacuum. Consequently, the gripping devices 1602 that are fluidly coupled with the cells 1904A-B and 1904D-F may not establish a vacuum to grip flexible bodies 300.

Subsequent cells 1904D-F may draw vacuums during the corresponding time periods shown in the timing diagrams 2100 similar to as described above. As a result, the selection station 108 (shown in FIG. 1) is able to individually control the gripping device 1602 to grip and carry the flexible body 300 as the gripping device 1602 moves by individually controlling when vacuums are drawn in different cells 1904 of the vacuum manifold 1902 (shown in FIG. 19).

Figure 22:
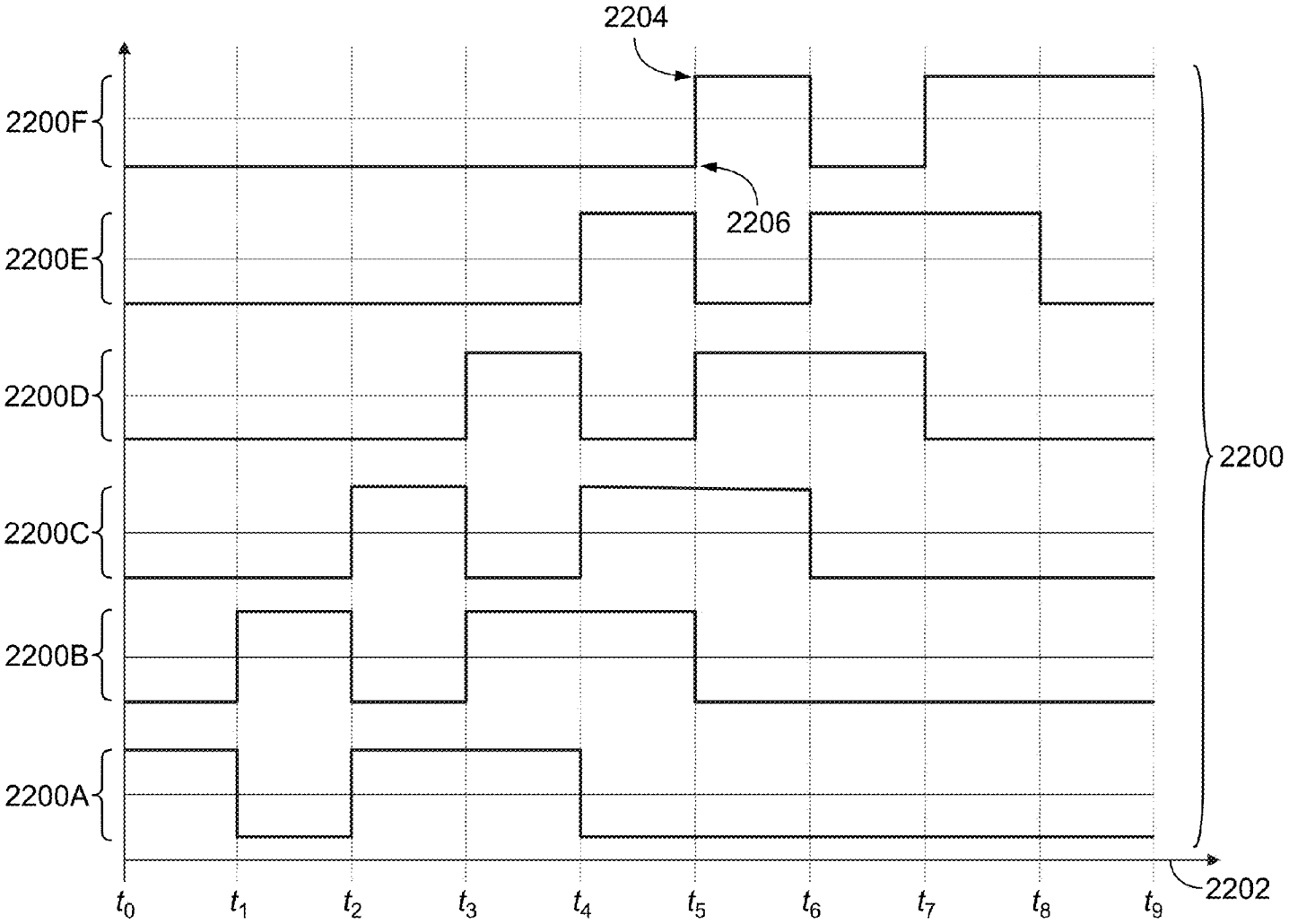
FIG. 22 illustrates timing diagrams for controlling when a vacuum or partial vacuum is drawn in the cells of the vacuum manifold shown in FIG. 19 according to another example.

FIG. 22 illustrates timing diagrams 2200 (e.g., timing diagrams 2200A-F) for controlling when a vacuum or partial vacuum is drawn in the cells 1904 shown in FIG. 19 according to another example. The timing diagrams 2200 represent when the timing elements 2000 (shown in FIG. 20) of the cells 1904A-F (shown in FIG. 19) are opened to create a vacuum in several gripping devices 1602 that are fluidly coupled with the cells 1904 and when the timing elements 2000 are closed to terminate the vacuum in the cells 1904. The first timing diagram 2200A corresponds to the first cell 1904A, the second timing diagram 2200B corresponds to the second cell 1904B, and so on.

The timing diagrams 2200 are shown alongside a horizontal axis 2202 representative of time. Each timing diagram 2200 alternates between a high value 2204 and a low value 2206. The high values 2204 represent the time periods during which the corresponding cell 1904 is drawing a vacuum and the low values 2206 represent the time periods during which the corresponding cell 1904 is not drawing a vacuum. The illustrated timing diagrams 2200 represent control of the cells 1904A-F for a sequential series of six gripping devices 1602. Based on inspection of the flexible bodies 300, the control unit 1510 (shown in FIG. 15) determines that a first gripping device 1602 in the series is to grip and remove a first flexible body 300 from the carriage assemblies 400 (shown in FIG. 4), a subsequent second gripping device 1602 in the series (e.g., that follows the first gripping device 1602 along the direction of travel 110 shown in FIG. 1) is to not grip a subsequent second flexible body 300 and allow the second flexible body 300 to remain in the carriage assembly 400, subsequent third and fourth gripping devices 1602 in the series are to grip and remove third and fourth flexible bodies 300, respectively, and fifth and sixth gripping devices 1602 in the series are to not grip or remove fifth and sixth flexible bodies 300, respectively. The table below summaries which gripping devices 1602 are to grip the flexible bodies 300 moving below the gripping devices 1602, as described above:

| Flexible Body in series of flexible bodies along direction of travel | Select flexible body? | Gripping device in series of gripping devices that will engage the flexible body | Grip and remove flexible body from carriage assembly? |
|---|---|---|---|
| First | Yes | First | Yes |
| Second | No | Second | No |
| Third | Yes | Third | Yes |
| Fourth | Yes | Fourth | Yes |
| Fifth | No | Fifth | No |
| Sixth | No | Sixth | No |

In the illustrated example, during a first time period (e.g., from time $t_0$ to subsequent time $t_1$), the first gripping device 1602 is fluidly coupled with the first cell 1904A and a vacuum is drawn in the first cell 1904A. As a result, the gripping device 1602 is able to grip the first flexible body 300, as described above. The remaining cells 1904B-F may not be drawing a vacuum. Consequently, any gripping devices 1602 that are fluidly coupled with the cells 1904B-F may not establish a vacuum to grip flexible bodies 300.

During a subsequent second time period (e.g., from time $t_1$ to subsequent time $t_2$), the first gripping device 1602 is fluidly coupled with the second cell 1904B and is no longer coupled with the first cell 1904A. In order to keep gripping the first flexible body 300 with the first gripping device 1602, a vacuum is drawn in the second cell 1904B and, as a result, the first gripping device 1602 is able to continue gripping the first flexible body 300. The second gripping device 1602B is fluidly coupled with the first cell 1904A, but is not to grip the second flexible body 300. As a result, no vacuum is generated in the first cell 1904A and the second gripping device 1602 does not engage and grip the second flexible body 300 using a vacuum.

During a subsequent third period (e.g., from time $t_2$ to subsequent time $t_3$), the first gripping device 1602 has moved to be fluidly coupled with the third cell 1904C, the second gripping device 1602 has moved to be fluidly coupled with the second cell 1904B, and the third gripping device 1602 has moved to be fluidly coupled with the first cell 1904A. In order to keep the first gripping device 1602 gripping the first flexible body 300, a vacuum is drawn in the third cell 1904C and, as a result, the first gripping device 1602 is able to continue gripping the first flexible body 300. The second gripping device 1602B is fluidly coupled with the second cell 1904B, but because the second gripping device 1602B is not gripping a flexible body 300, no vacuum is drawn in the second cell 1904B. The third gripping device 1602C is to grip the third flexible body 300 so a vacuum is drawn in the first cell 1904A to cause the third gripping device 1602C to engage and grip the third flexible body 300.

During a subsequent fourth time period (e.g., from time $t_3$ to subsequent time $t_4$), the first gripping device 1602 has moved to be fluidly coupled with the fourth cell 1904D, the second gripping device 1602 has moved to be fluidly coupled with the third cell 1904C, the third gripping device 1602 has moved to be fluidly coupled with the second cell 1904B, and the fourth gripping device 1602 has moved to be fluidly coupled with the first cell 1904A. In order to keep the first gripping device 1602 gripping the first flexible body 300, the third gripping device 1602 gripping the third flexible body 300, and the fourth gripping device 1602 gripping the fourth flexible body 300, a vacuum is drawn in the fourth, second, and first cells 1904D, 1904B, 1904A. No vacuum is drawn in the third cell 1904C to which the second gripping device 1602B is fluidly coupled as the second gripping device 1602B is not to grip any flexible body 300.

During a subsequent fifth time period (e.g., from time $t_4$ to subsequent time $t_5$), the first gripping device 1602 has moved to be fluidly coupled with the fifth cell 1904E, the second gripping device 1602 has moved to be fluidly coupled with the fourth cell 1904D, the third gripping device 1602 has moved to be fluidly coupled with the third cell 1904C, the fourth gripping device 1602 has moved to be fluidly coupled with the second cell 1904B, and the fifth gripping device 1602 has moved to be fluidly coupled with the first cell 1904A. In order to keep the first gripping device 1602 gripping the first flexible body 300, the third gripping device 1602 gripping the third flexible body 300, and the fourth gripping device 1602 gripping the fourth flexible body 300, a vacuum is drawn in the fifth, third, and second cells 1904E, 1904C, and 1904B. No vacuum is drawn in the fourth cell 1904D to which the second gripping device 1602B is fluidly coupled or in the first cell 1904A to which the fifth gripping device 1602 is coupled as the second gripping device 1602B and the fifth gripping device 1602 are not to grip any flexible bodies 300.

The cells 1904 can continued to be sequentially "activated" (e.g., when a vacuum is drawn in the cell 1904) and "deactivated" (e.g., when no vacuum is drawn in the cell 1904) as the gripping devices 1602 move through the series of cells 1904 to either maintain a vacuum in the gripping devices 1602 that are gripping flexible bodies 300 or to not establish a vacuum in the gripping devices 1602 that are not gripping flexible bodies 300, as shown in FIG. 22. After the gripping devices 1602 have gripped the flexible bodies 300 and placed the flexible bodies 300 onto the collection location 1506 (shown in FIG. 15), the gripping devices 1602 and the other gripping devices 1602 that do not grip the flexible bodies 300 continue to move around the looped path 1604 (shown in FIG. 16) of the carousel device 1600 (shown in FIG. 16) to return to positions to pick up additional flexible bodies 300, if needed.

In one embodiment, a release device is provided in the printing system 100 (shown in FIG. 1) to assist in releasing the flexible bodies 300 from the fixation devices 534 (shown in FIG. 5). Such a release device can push up on the flexible bodies 300 to overcome the locking forces 810, 812 (shown in FIG. 8) that secure the ports 310 (shown in FIG. 3) of the flexible bodies 300 in the fixation devices 534. Once the ports 310 are released from the fixation device 534, the flexible bodies 300 can more easily be lifted from the carriage assemblies 400 (shown in FIG. 4).

Figure 23:
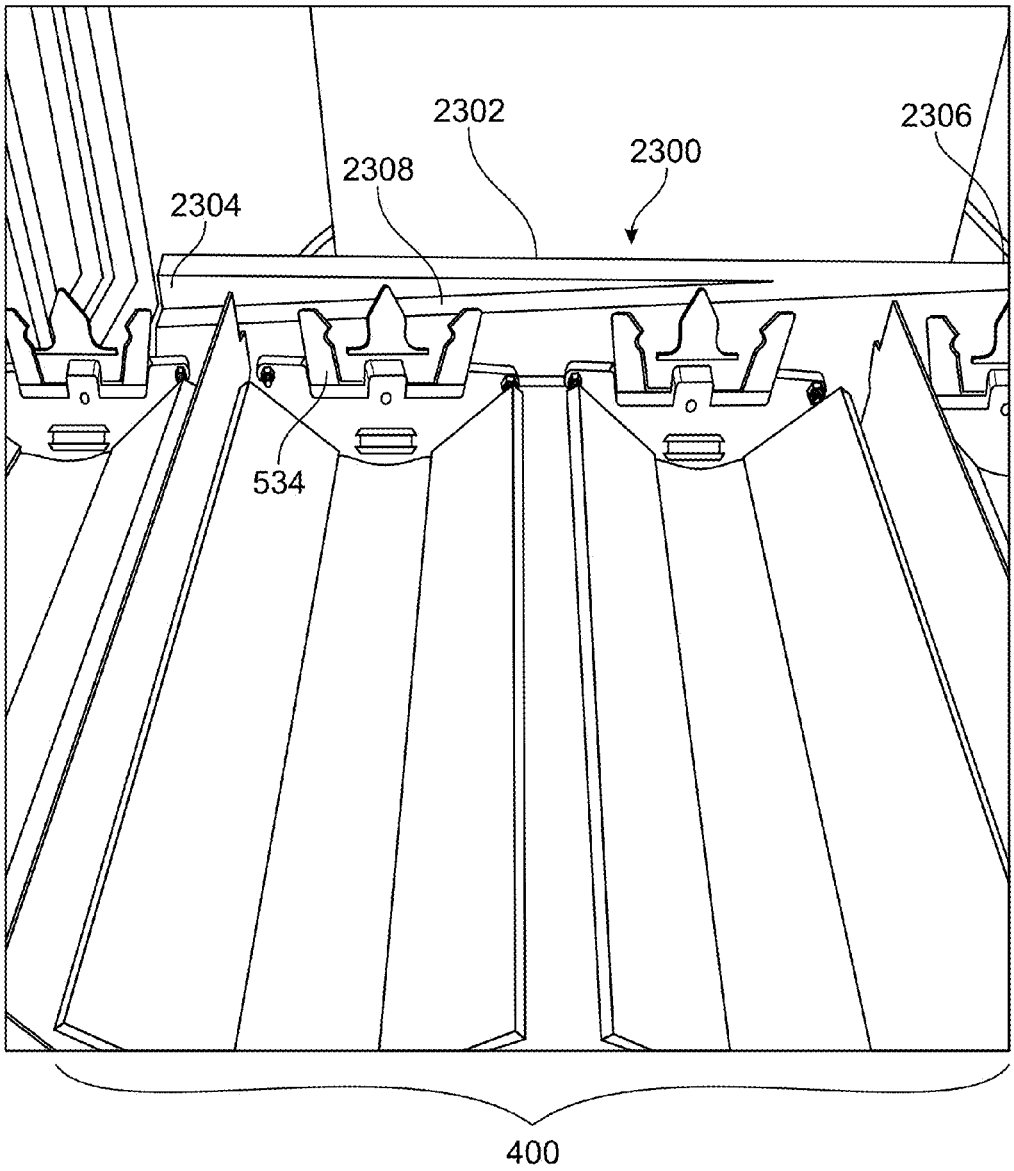
FIG. 23 is a perspective view one embodiment of a release device.

FIG. 23 is a perspective view one embodiment of a release device 2300. The release device 2300 can be included in one or more embodiments of the printing system 100 shown in FIG. 1 to assist in releasing the ports 310 (shown in FIG. 3) of the flexible bodies 300 (shown in FIG. 3) from the fixation devices 534 of the carriage assemblies 400. The release device 2300 can be included in the printing system 100 downstream from the printing station 108 (shown in FIG. 1).

As described above, in one embodiment, in order to release the ports 310 of the flexible bodies 300 from the fixation devices 534, the ports 310 may be forced upward and out from between the locking fingers 600, 602 and the center tine 604. The release device 2300 can engage and push the ports 310 of the flexible bodies 300 upward. The release device 2300 includes an elongated body 2302 that extends from a leading side or edge 2304 to an opposite trailing side or edge 2306. The leading side or edge 2304 faces the flexible bodies 300 and carriage assemblies 400 that are approaching the release device 2300 along the direction of travel 110 of the printing system 100. The body 2302 includes an angled engagement edge 2308 that extends from the leading side or edge 2304 to the trailing side or edge 2306.

The engagement edge 2308 is angled with respect to the carriage assemblies 400 and fixation devices 534. For example, a leading interface between the leading side or edge 2304 and the engagement edge 2308 is disposed closer to the carriage assemblies 400, fixation devices 534, and/or ports 310 than a trailing interface between the trailing side or edge 2306 and the engagement edge 2308. As the flexible bodies 300 travel below the release device 2300 along the direction of travel 110, the ports 310 may engage the engagement edge 2308. The angle at which the engagement edge 2308 is disposed may cause the ports 310 to be gradually be forced sufficiently far upward and out of the fixation devices 534 so as to overcome the locking forces 810, 812 (shown in FIG. 8) that are imparted on the ports 310. When the ports 310 travel above the release device 2300 and past the trailing interface between the trailing side or edge 2306 and the engagement edge 2308, the ports 310 may be lifted up and removed from (e.g., unseated from) between the locking fingers 800, 802 and the center tine 804 of the fixation device 534.

In one embodiment, the release device 2300 is stationary. For example, the release device 2300 may not move upward and away from, or downward and toward the carriage assemblies 400. Alternatively, the release device 2300 may move relative to the carriage assemblies 400. For example, the release device 2300 may rise up in a direction away from the carriage assemblies 400 to remove the ports 310 from the fixation device 534.

Figure 24:
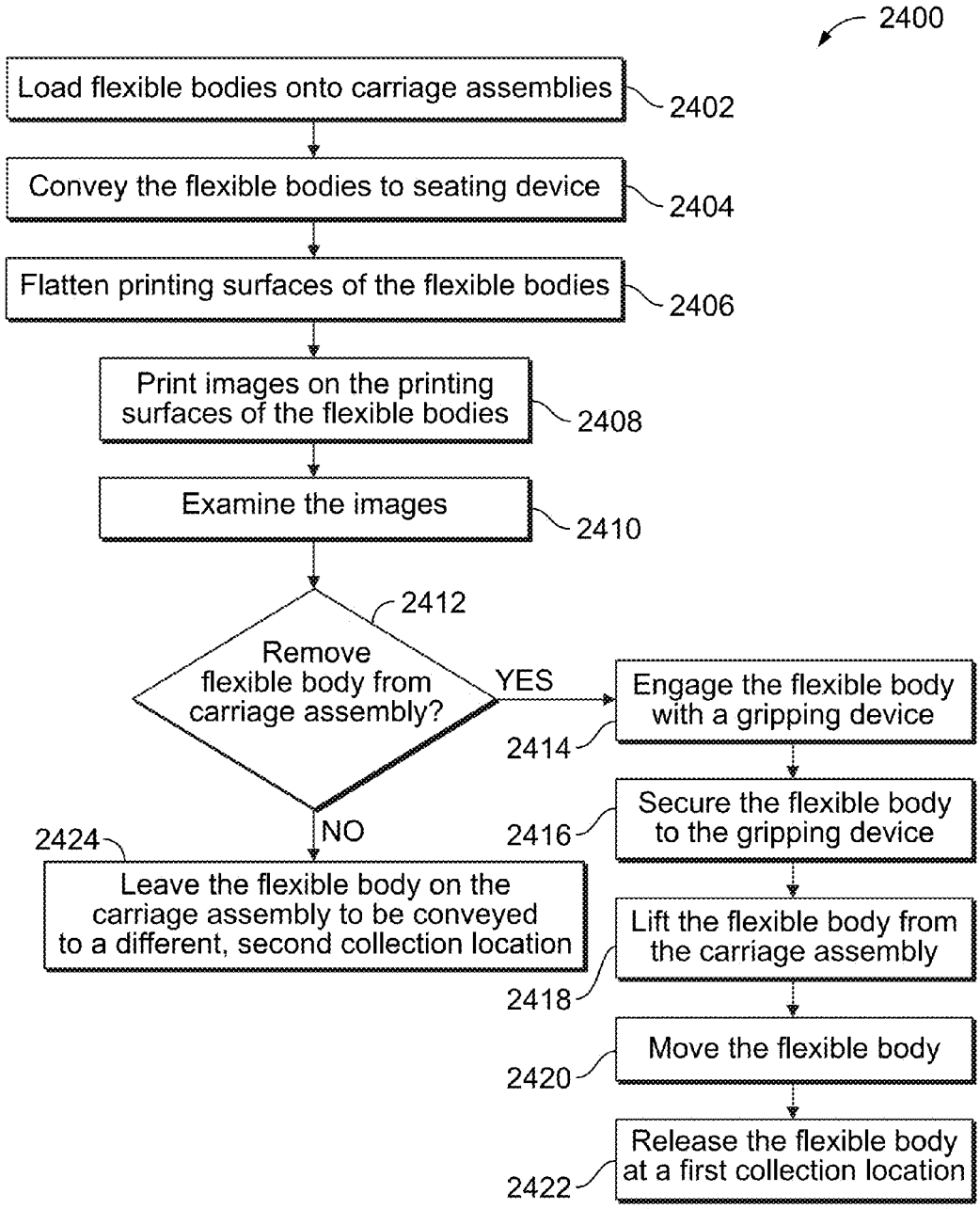
FIG. 24 is a flowchart of one embodiment for a method for printing on flexible bodies.

FIG. 24 is a flowchart of one embodiment for a method 2400 for printing on flexible bodies. The method 2400 may be used in conjunction with the printing system 100 (shown in FIG. 1) to print on the flexible bodies 300 (shown in FIG. 3) or other flexible bodies. While the description of the method 2400 includes reference to the illustrated embodiments described above, at least one embodiment of the method 2400 may be used with one or more other flexible bodies and/or printing systems.

At 2402, flexible bodies are loaded into carriage assemblies that are connected with a conveyance assembly. For example, the flexible bodies 300 may be loaded into the beds 500 (shown in FIG. 5) of the carriage assemblies 400 (shown in FIG. 4). The carriage assemblies 400 can be coupled with the conveyance assembly 200 (shown in FIG. 2) that move the flexible bodies 300 on the carriage assemblies 400 along the direction of travel 110 (shown in FIG. 1), as described above. The flexible bodies 300 may be manually or autonomously placed onto the beds 500 of the conveyance assemblies 400. As described above, the flexible bodies can include flexible sealed bags or containers that have been pre-filled (e.g., previously filled prior to printing) with a fluid.

At 2404, the flexible bodies are conveyed to a seating device to secure the flexible bodies in the carriage assemblies and/or to ensure that the flexible bodies are secured in the carriage assemblies. For example, the conveyance assembly 200 may move the carriage assemblies 400 beneath the seating device 800 (shown in FIG. 9) to secure the flexible bodies 300 in the fixation devices 534 (shown in FIG. 5) of the carriage assemblies 400. As described above, the seating device 800 can engage the ports 310 (shown in FIG. 3) or other components of the flexible bodies 300 to force the ports 310 down into the fixation devices 534 and lock the fixation devices 534 onto the ports 310. Alternatively, the seating device may not be used and the method 2400 may skip 2404 and proceed to 2406.

At 2406, printing surfaces of the flexible bodies are flattened, or made more flat. In one embodiment, the printing surfaces of flexible bodies that are pre-filled with a fluid can be made more flat when bubbles inside the flexible bodies are centered or more centered than before. The bubbles may be more centered when the bubbles are moved to positions that are closer to a center of the printing surface than before. In one embodiment, the surfaces 302 (shown in FIG. 3) of the flexible bodies 300 are made to be more flat or planar by pulling on one end of a flexible body 300 while an opposite end of the flexible body 300 is secured in the fixation device 534. Alternatively, both ends of the flexible body 300 may be pulled in opposite directions. In another embodiment, the top surface 302 of the flexible body 300 may be pushed downward.

At 2408, one or more images are printed on the flattened surfaces of the flexible bodies. For example, the printing assembly 1400 (shown in FIG. 14) may deposit ink on the flattened surfaces 302 of the flexible bodies 300 as the flexible bodies 300 move through the printing assembly 1400. In one embodiment, the surfaces 302 may be pre-treated by exposing the surfaces 302 to energy, such as thermal energy and/or electric energy, to change chemical and/or electric properties of the surfaces 302 prior to printing on the surfaces 302, as described above. Additionally or alternatively, the surfaces 302 may be exposed to energy, such as light, after printing to assist in curing the ink on the surfaces 302.

At 2410, the flexible bodies are examined to determine if the images were printed on the surfaces of the flexible bodies. For example, the examination assembly 1500 (shown in FIG. 15) may optically scan or examine the surfaces 302 of the flexible bodies 300 and determine if the images are acceptable, as described above.

At 2412, a determination is made as to whether a flexible body is to be removed from the carriage assembly. For example, a determination may be made for each flexible body 300 as to whether the flexible body 300 is to be removed from the carriage assembly 400 for packaging or left on the carriage assembly 400 to be discarded, as described above. Alternatively, if the flexible body 300 is to be discarded, the flexible body 300 may be removed from the carriage assembly 400 in another embodiment. This determination may be based on the examination of the image at 2410. For example, if the image on the flexible body 300 is acceptable, then the flexible body 300 may need to be removed from the carriage assembly 400 so the flexible body 300 can be packaged and/or transported to a consumer. As a result, flow of the method 2400 proceeds to 2414. On the other hand, if the image on the flexible body 300 is unacceptable, then the flexible body 300 may not need to be removed from the carriage assembly 400 so that the flexible body 300 can proceed to a collection location 1508 (shown in FIG. 15) to be discarded, as described above. As a result, flow of the method 2400 proceeds to 2424.

At 2414, the flexible body that is to be removed from the carriage assembly is engaged by a gripping device. For example, the gripping device 1602 (shown in FIG. 16) may lower to engage the upper surface 302 of the flexible body 300. Engagement members 1708 (shown in FIG. 17) of the gripping device 1602 may contact the flexible body 300. Alternatively, another mechanism or assembly of the tripping device 1602, such as a clamp, hook, and the like, may grip or otherwise engage the flexible body 300.

At 2416, a vacuum is generated in the gripping device in order to secure the flexible body to the gripping device. As described above, a vacuum may be established in the cell 1904 (shown in FIG. 19) of the vacuum manifold 1902 (shown in FIG. 19) to which the gripping device 1602 is fluidly coupled when the gripping device 1602 engages the flexible body 300. This vacuum can cause the flexible body 300 to be secured to the gripping device 1602, as described above.

At 2418, the flexible body is lifted from the carriage assembly. For example, the gripping device 1602 may move away from the carriage assembly 400 such that the flexible body 300 is lifted off of the carriage assembly 400.

At 2420, the gripping device maintains a grip on the flexible body as the gripping device moves the flexible body. For example, the gripping device 1602 may move along the series of cells 1904 and be fluidly coupled with different cells 1904 during different, sequential time periods. As the gripping device 1602 moves along the cells 1904, the cell 1904 to which the gripping device 1602 is fluidly coupled maintains the vacuum in the gripping device 1602 so that the gripping device 1602 maintains a grip on the flexible body 300, as described above.

At 2422, the gripping device releases the flexible body. For example, the gripping device 1602 may release the grip of the flexible body 300 so that the flexible body 300 can be placed onto the collection location 1506 (shown in FIG. 15). As described above, the collection location 1506 can then transfer the flexible body 300 to a location for packaging and/or delivery to a consumer.

At 2424, the flexible body that is not gripped by the gripping device remains on the carriage assembly and travels to a collection location. For example, the flexible body 300 may not be gripped and lifted from the carriage assembly 400 and may instead travel to the collection location 1508. The flexible body 300 may be released from the carriage assembly 400 and fixation device 534 when the flexible body 300 reaches the collection location 1508 so that the flexible body 300 falls or is placed into the collection location 1508.

The method 2400 may return from 2422 and/or 2424 to one or more previous operations to proceed in a loop-wise manner to secure, flatten, print upon, examine, and grip or not grip additional flexible bodies, as described above. For example, following 2422 and/or 2424, the method 2400 may return one or more of 2402 through 2420 to repeat the operations for additional flexible bodies.

Figure 27:
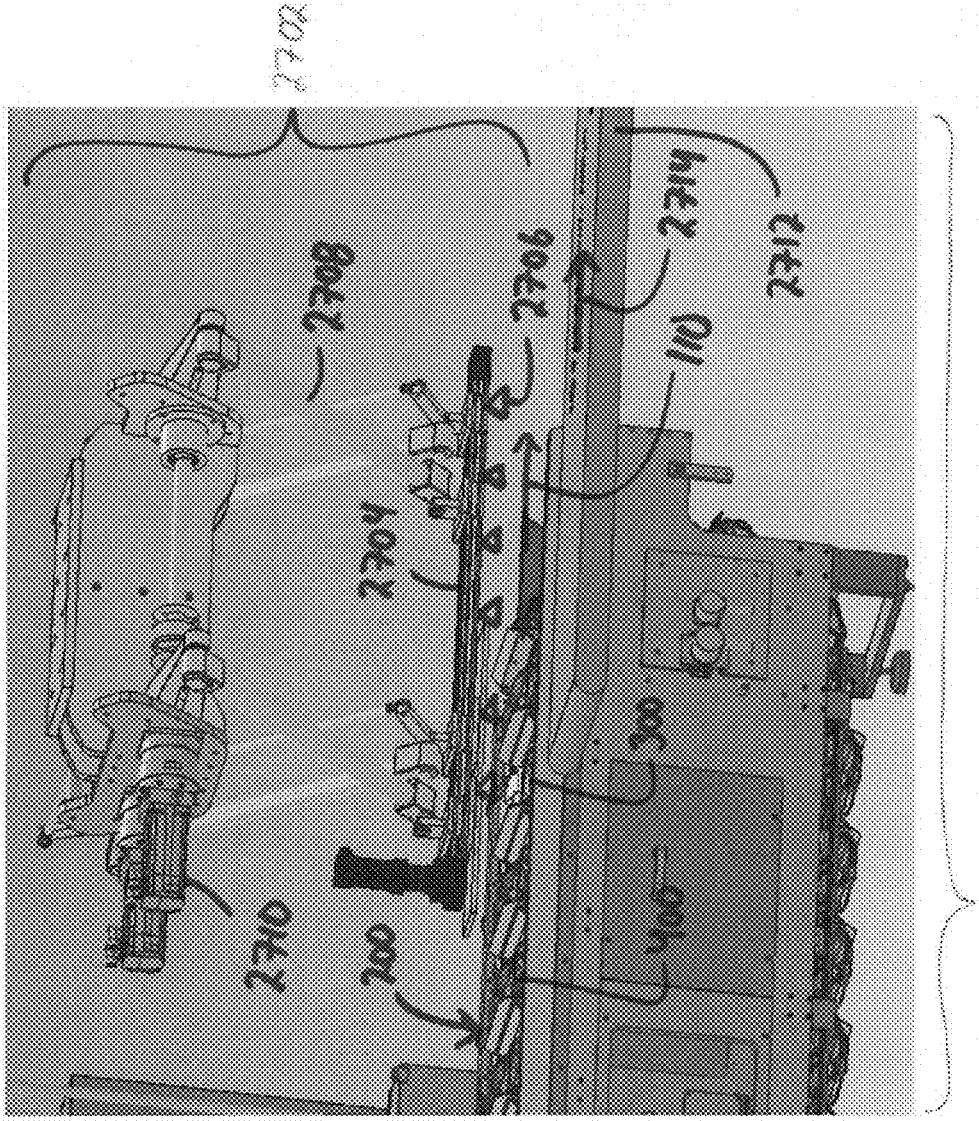
FIG. 27 illustrates a perspective view of a selection station according to another embodiment.

FIG. 27 illustrates a perspective view of a selection station 2700 according to another embodiment. The selection station 2700 can represent an alternative embodiment of the selection station 108. For example, instead of including the selection station 108 in the printing system 100 shown in FIG. 1, the selection station 2700 may be included in the printing system 100.

The selection station 2700 receives the flexible bodies 300 from the printing station 106 along the conveyance assembly 200. The selection station 2700 includes a gripping assembly 2702 that grips and removes selected ones of the flexible bodies 300 from the carriage assemblies 400. The gripping assembly 2702 includes a slide plate 2704 that is connected with several gripping devices 2706. The slide plate 2704 is connected with articulating arms 2708. The articulating arms 2708 are connected with motors 2710 that rotate the arms 2708 to cause the arms 2708 to raise or lower the slide plate 2704 away from or toward the flexible bodies 300 on the conveyance assembly 200. The arms 2708 also are moved by the motors 2710 in lateral directions between the conveyance assembly 200 and a collection conveyance assembly 2712. The collection conveyance assembly 2712 is oriented parallel or substantially parallel to the conveyance assembly 200, and includes a conveyor (e.g., a belt) that moves to move the bodies 300 placed onto the collection conveyance assembly 2712 along an exit direction of travel 2714. In the illustrated embodiment, the exit direction of travel 2714 is parallel or substantially parallel to the direction of travel 110. Alternatively, the exit direction of travel 2714 may be oriented in another direction.

The gripping devices 2706 can represent suction cups or other devices that are able to engage and remove the bodies 300 from the carriage assemblies 400. The gripping devices 2706 may be fluidly coupled with a vacuum source (e.g., a device capable of reducing pressure in the volume between a gripping device 2706 and a surface of a body 300). In operation, the arms 2708 move to lower the slide plate 2704 such that the gripping devices 2706 engage the upper surfaces (e.g., printing surfaces) of the flexible bodies 300 in the carriage assemblies 400 on the conveyance assembly 200. A suction force may be generated via the gripping devices 2706 to cause the gripping devices 2706 to couple with the flexible bodies 300. The slide plate 2704 is connected with the arms 2708 in a manner that allows the slide plate 2704 to move along the direction of travel 110 with the flexible bodies 300. For example, the slide plate 2704 may move along a rail, slot, or other mechanical attachment in the direction of travel 110 at the same or substantially same speed that the flexible bodies 300 move in the direction of travel 110.

The arms 2708 may then lift the slide plate 2704 and gripping devices 2706 that are connected with the flexible bodies 300. This motion may lift the flexible bodies 300 out of the corresponding carriage assemblies 400. The arms 2708 can move the slide plate 2704, gripping devices 2706, and the flexible bodies 300 laterally from above the conveyance assembly 200 to above the collection conveyance assembly 2712. The slide plate 2704 may continue to move in a direction that is parallel or substantially parallel to the exit direction of travel 2714, such as at the same or substantially same speed at which the conveyance assembly 2712 is moving along the direction of travel 2714. The arms 2708 may then lower the flexible bodies 300 toward or onto the conveyance assembly 2712. The suction force exerted on the flexible bodies 300 by the gripping devices 2706 may then be released so that the flexible bodies 300 may be carried away by the conveyance assembly 2712.

Figure 28:
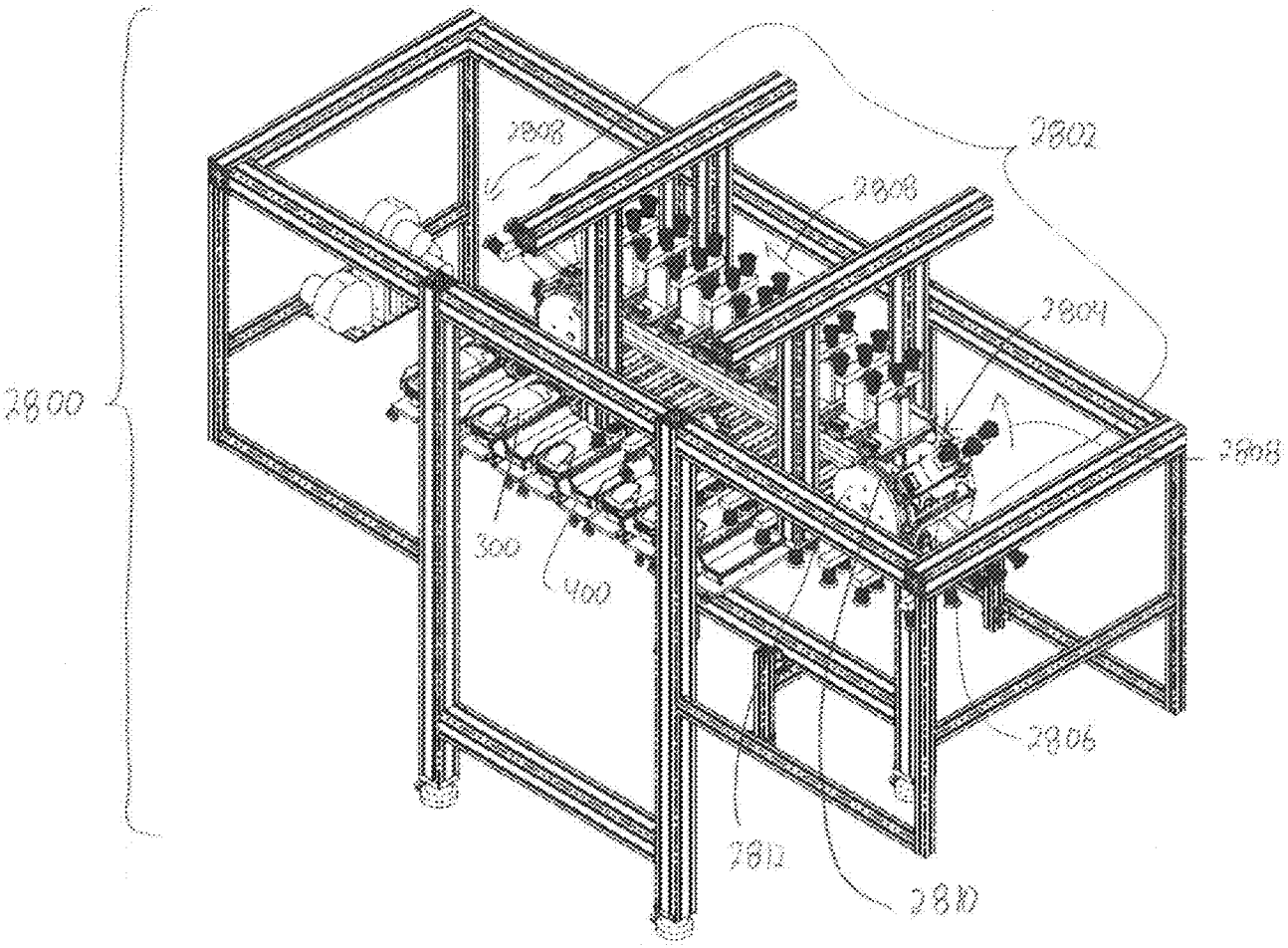
FIG. 28 illustrates a perspective view of a selection station according to another embodiment.
Figure 29:
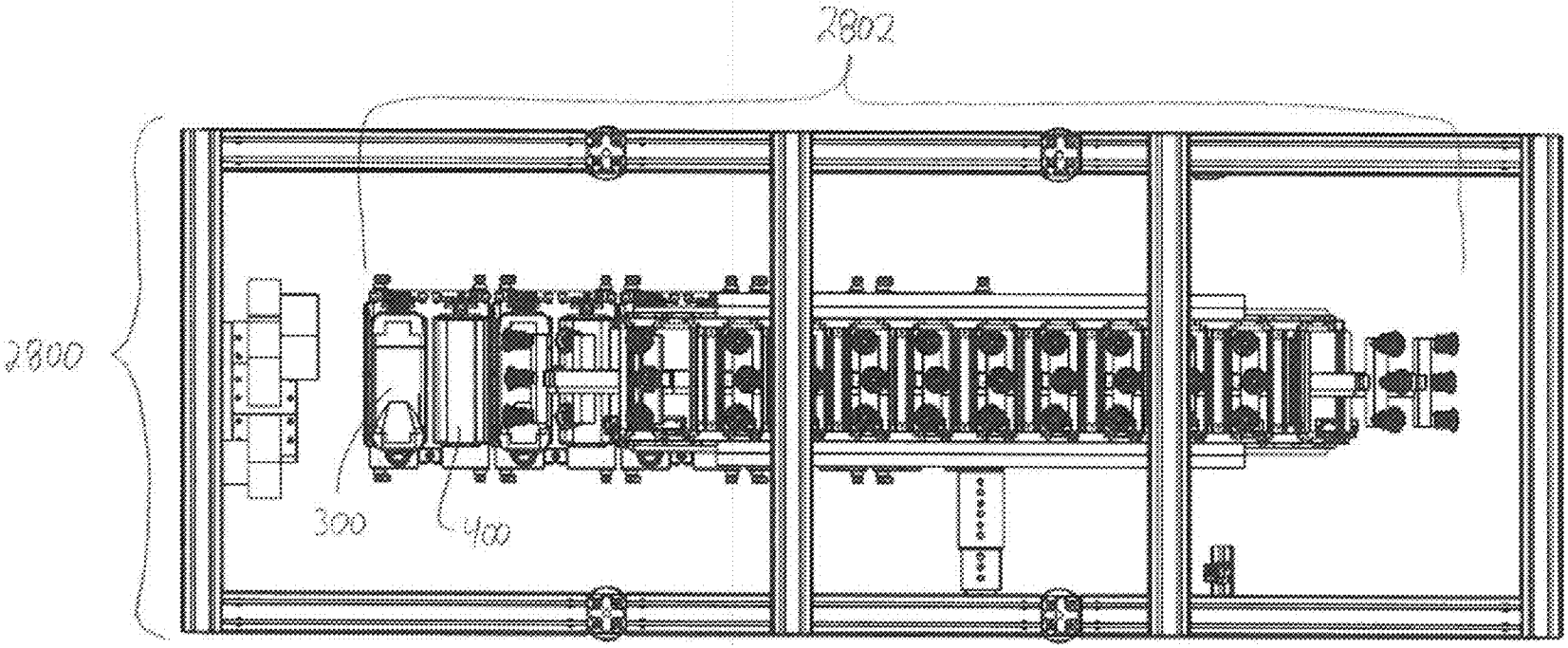
FIG. 29 illustrates a top view of the selection station shown in FIG. 28.
Figure 30:
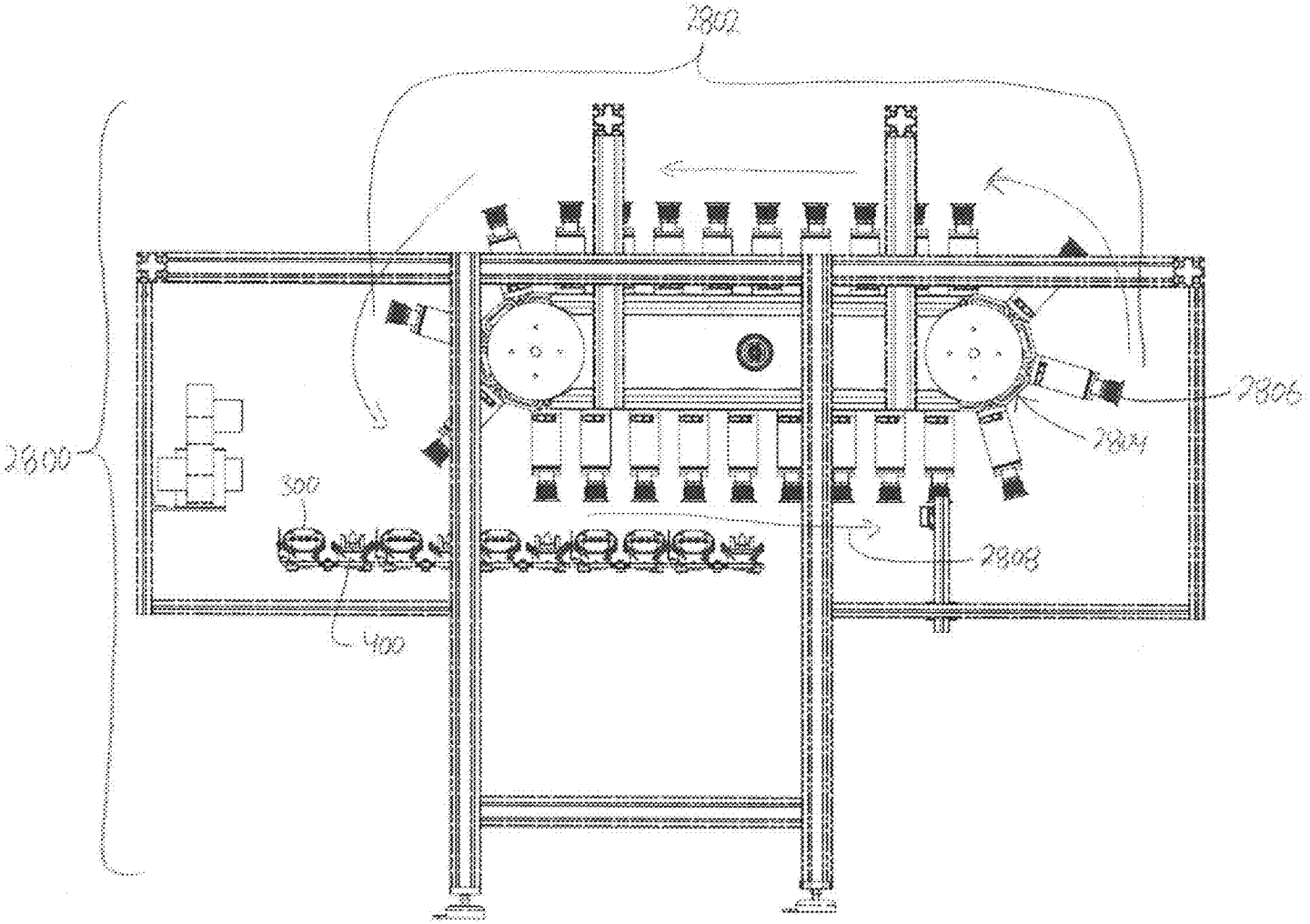
FIG. 30 illustrates a plan view of the selection station shown in FIG. 28.
Figure 31:
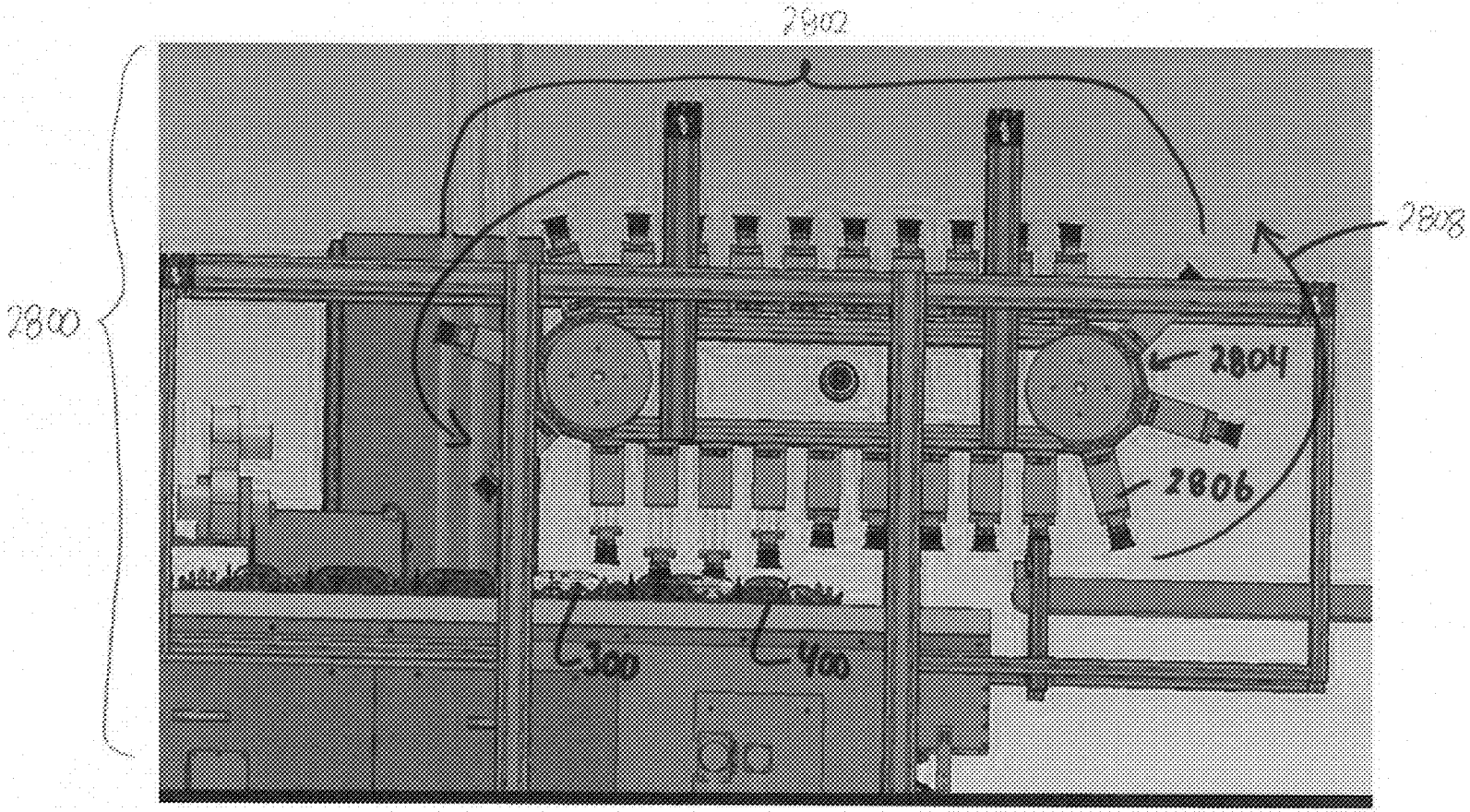
FIG. 31 illustrates another plan view of the selection station shown in FIG. 28 during operation of the selection station.

FIGS. 28 through 31 illustrate views of another embodiment of a selection station 2800. FIG. 28 illustrates a perspective view of the selection station 2800, FIG. 29 illustrates a top view of the selection station 2800, FIG. 30 illustrates a plan view of the selection station 2800, and FIG. 31 illustrates another plan view of the selection station 2800 during operation of the selection station 2800. The selection station 2800 can represent an alternative embodiment of the selection station 108 and/or 2700. For example, instead of including the selection station 108 and/or 2700 in the printing system 100 shown in FIG. 1, the selection station 2800 may be included in the printing system 100.

The selection station 2800 receives the flexible bodies 300 from the printing station 106. An examination assembly (as described herein) can examine the images 316 on the flexible bodies 300 to determine which of the bodies 300 are to be removed from the carriages 400 by the selection station 2800.

The selection station 2800 includes a gripping assembly 2802 that grips and removes selected ones of the flexible bodies 300 from the carriage assemblies 400. The gripping assembly 2802 includes a carousel device 2804 that moves several gripping devices 2806 around a looped path 2808. In the illustrated embodiment, the looped path 2808 is generally oval in shape, but alternatively, another shape may be used. The gripping devices 2806 may be coupled with a chain, conveyor, or other assembly of the carousel device 2804 that is moved by a motor or other device to move the gripping devices 2806 along the looped path 2808 in the illustrated direction.

The gripping devices 2806 may be spaced apart from each other by the same or similar distance that separates the flexible bodies 300 along the direction of travel of the flexible bodies 300. The gripping devices 2806 may be moved around the looped path 2808 at the same or approximately the same speed at which the flexible bodies 300 and carriage assemblies 400 move along the direction of travel. As a result, each gripping device 2806 can grip and remove a different flexible body 300 from the carriage assemblies 400 with adjacent or neighboring flexible bodies 300 being removed by different gripping devices 2806.

In the illustrated embodiment, the carousel device 2804 moves the gripping devices 2806 in a downward direction toward the flexible bodies 300 on the carriage assemblies 400. The gripping devices 2806 lower to engage the flexible bodies 300, as shown in FIG. 31. The gripping devices 2806 can lower to the bodies 300 by increasing the length of the gripping devices 2806. The gripping devices 2806 may engage the printed surfaces 302 of the flexible bodies 300. Alternatively or additionally, the gripping devices 2806 may engage other parts of the flexible bodies 300.

The gripping devices 2806 may lower and engage each of the flexible bodies 300 in one embodiment. The gripping devices 2806 can grip one or more of the flexible bodies 300 (referred to herein as selected flexible bodies 300) while not gripping one or more other flexible bodies 300 (referred to herein as other flexible bodies 300).

When the gripping devices 2806 are lowered to engage the flexible bodies 300, the gripping devices 2806 that engage the selected flexible bodies 300 can grip the flexible bodies 300 using suction pressure. For example, a vacuum or partial vacuum (e.g., a pressure that is lower than atmospheric pressure) may be generated between the gripping device 2806 and the flexible body 300 such that the flexible body 300 remains engaged to the gripping device 2806 when the gripping device 2806 moves away from the carriage assemblies 400 as the gripping device 2806 moves along the looped path 2808.

The vacuum or partial vacuum may be maintained between the gripping device 2806 and the flexible body 300 as the carousel device 2804 continues to move the gripping device 2806 along the looped path 2808 and the conveyance assembly 200 continues to move the carriage assembly 400 that previously held the flexible body 300 in the direction of travel 110. When the gripping device 2806 that has gripped and lifted a flexible body 300 off of the carriage assembly 400 reaches a location where the flexible body 300 is to be released, then the vacuum or partial vacuum between the gripping device 2806 and the flexible body 300 may be released (e.g., destroyed or removed) so that the gripping device 2806 releases the flexible body 300. The flexible body 300 may then fall onto a collection location to be taken to another location, as described above.

Similar to the carousel device 1600 of the selection station 108 shown in FIGS. 15-16 and 19, the carousel device 2804 includes pulleys 2812 around which a belt or chain 2810 is rotated to move the gripping devices 2806 around the looped path 2808. The gripping devices 2806 are connected with the chain 2810 (e.g., a C-chain or other type of belt or chain) such that movement of the chain 2810 causes movement of the gripping devices 2806.

In contrast to the carousel device 1600 shown in FIGS. 15-16 and 19, the carousel device 2804 shown in FIGS. 28-31 does not include a vacuum manifold that is fluidly coupled with several different gripping devices 2806. Instead, each of the gripping devices 2806 can separately reduce pressure in order to grasp a different flexible body 300. The gripping devices 2806 may include vacuum pumps disposed within the gripping devices 2806 and/or fluidly coupled with the gripping devices 2806 so that each gripping device 2806 can generate a vacuum or low pressure area to grasp a body 300 independent and separately from the other gripping devices 2806.

In operation and as shown in FIG. 31, gripping devices 2806 can rotate around the carousel assembly 2804 along the direction 2808. When a gripping device 2806 is to grasp and remove a flexible body 300 from a carriage assembly 400, the gripping device 2806 may telescope outward such that the length of the gripping device 2806 is increased, as shown in FIG. 28. A reduced pressure or vacuum volume may be generated between the gripping device 2806 and the body 300. The length of the gripping device 2806 can then be reduced (e.g., by the gripping device 2806 telescoping inward) so that the body 300 is removed from the carriage assembly 400. The gripping device 2806 can release the grasp on the body 300 once the body 300 is held above a collection location. The gripping device 2806 may then continue along the loop 2808 until the gripping device 2806 can grasp and remove another body 300. The continuous motion of the carousel assembly 2804 and the carriage assemblies 400 moving the bodies 300 beneath the gripping devices 2806 can result in a fast process for removing the bodies 300 from the carriage assemblies 400 (relative to picking up individual bodies 300 in a batch or non-continuous process).

In one embodiment, a printing system includes carriage assemblies, a preparation station, a printing station, and a selection station. The carriage assemblies are configured to receive flexible bodies and are coupled to a conveyance assembly that is configured to move the carriage assemblies and the flexible bodies along a direction of travel. The preparation station is configured for receiving the flexible bodies from the loading station and for manipulating the flexible bodies to at least partially flatten printing surfaces of the flexible bodies. The printing station is configured for printing images on the printing surfaces of the flexible bodies that are at least partially flattened. The selection station is configured for examining the images on the printing surfaces of the flexible bodies and for selecting one or more of the flexible bodies based on the images that are examined. The selection station also is configured to individually grip and remove the one or more of the flexible bodies that are selected from the carriage assemblies and to convey the one or more of the flexible bodies that are selected to a first collection location while the flexible bodies that remain on the carriage assemblies are conveyed to a different, second collection location.

In another aspect, the flexible bodies are three dimensional bodies that are pre-filled with a fluid prior to the printing station printing the images on the flexible bodies.

In another aspect, the carriage assemblies include fixation devices that lock onto the flexible bodies to prevent the flexible bodies from being pulled off of the carriage assemblies along a lateral direction that is transverse to the direction of travel.

In another aspect, the flexible bodies are locked into the fixation devices when the flexible bodies are forced down into the fixation devices, and the system also includes a seating device disposed upstream of the preparation station. The seating device includes an angled engagement edge that engages the flexible bodies to force the flexible bodies down into the fixation devices to lock the fixation devices onto the flexible bodies.

In another aspect, the fixation devices include locking fingers that pivot to lock onto the flexible bodies.

In another aspect, the preparation station includes a manipulation assembly that manipulates the flexible bodies to at least partially flatten the printing surfaces of the flexible bodies by pulling the flexible bodies in a direction oriented away from the fixation devices.

In another aspect, the preparation station includes a manipulation assembly that manipulates the flexible bodies to at least partially flatten the printing surfaces of the flexible bodies by pulling the flexible bodies along a lateral direction that is transverse to the direction of travel.

In another aspect, the manipulation assembly includes an arm configured to engage one or more of the flexible bodies, move along the direction of travel with the one or more flexible bodies that are engaged and concurrently pull on the flexible bodies along the lateral direction to at least partially flatten the printing surfaces of the one or more flexible bodies.

In another aspect, the printing station includes an inkjet printer that deposits ink onto the printing surfaces of the flexible bodies to print the images.

In another aspect, the selection station includes a carousel device having plural gripping devices and a vacuum manifold. The carousel device is configured to move the gripping devices to engage the one or more of the flexible bodies that are selected. The gripping devices that are engaged with the one or more of the flexible bodies that are selected are configured to grip the one or more of the flexible bodies by fluidly coupling with the vacuum manifold in order to draw at least a partial vacuum to grip the one or more of the flexible bodies.

In another aspect, the vacuum manifold includes a series of cells and the gripping devices are configured to move along the series of cells to be fluidly coupled with the cells in a sequence. The cells are individually controllable to draw the at least a partial vacuum to control which of the gripping devices grip the flexible bodies.

In another aspect, the series of cells are linearly aligned with each other.

In one embodiment, a printing method includes positioning flexible bodies on carriage assemblies that are coupled to a conveyance assembly that moves the carriage assemblies and the flexible bodies along a direction of travel, manipulating the flexible bodies to at least partially flatten printing surfaces of the flexible bodies, printing images on the printing surfaces of the flexible bodies that are at least partially flattened, examining the images on the printing surfaces of the flexible bodies, and selecting one or more of the flexible bodies based on the images that are examined by individually gripping and removing the one or more of the flexible bodies that are selected from the carriage assemblies. The one or more of the flexible bodies that are selected are conveyed to a first collection location while the flexible bodies that remain on the carriage assemblies are conveyed to a different, second collection location.

In another aspect, the flexible bodies are three dimensional bodies that are pre-filled with a fluid prior to printing the images on the flexible bodies.

In another aspect, positioning the flexible bodies on the carriage assemblies includes locking the flexible bodies into fixation devices of the carriage assemblies to prevent the flexible bodies from being pulled off of the carriage assemblies along a lateral direction that is transverse to the direction of travel.

In another aspect, locking the flexible bodies into the fixation devices includes pivoting locking fingers of the fixation devices onto the flexible bodies.

In another aspect, manipulating the flexible bodies includes pulling the flexible bodies in a direction oriented away from the fixation devices.

In another aspect, manipulating the flexible bodies includes pulling the flexible bodies along a lateral direction that is transverse to the direction of travel.

In another aspect, manipulating the flexible bodies includes engaging one or more of the flexible bodies with a moveable arm, moving the arm along the direction of travel with the one or more flexible bodies that are engaged with the arm and concurrently pulling on the flexible bodies along the lateral direction to at least partially flatten the printing surfaces of the one or more flexible bodies.

In another aspect, printing the images includes using an inkjet printer to deposit ink onto the printing surfaces of the flexible bodies.

In another aspect, selecting the one or more flexible bodies includes engaging the one or more flexible bodies with one or more gripping devices, fluidly coupling the one or more gripping devices with a vacuum manifold, and drawing at least a partial vacuum in the one or more gripping devices to grip the one or more of the flexible bodies.

In another aspect, fluidly coupling the one or more gripping devices with the vacuum manifold includes moving the one or more gripping devices along a series of cells of the vacuum manifold to fluidly couple the one or more gripping devices with the cells in a sequence and individually controlling which of the cells draws the at least a partial vacuum to control which of the one or more gripping devices grips the flexible bodies.

In one embodiment, a carriage assembly of a printing system includes a bed and a fixation device. The bed is configured to receive a flexible body and extends along a first direction from a fixation end to an open end. The fixation device is disposed proximate to the fixation end of the bed. The fixation device is configured to engage a first end of the flexible body to prevent the flexible body from being removed from the bed when an opposite second end of the flexible body is pulled along the first direction to at least partially flatten a printing surface of the flexible body.

In another aspect, the fixation device includes plural locking fingers that are biased toward each other to engage the first end of the flexible body.

In another aspect, the fixation device includes a center tine disposed between the locking fingers. The locking fingers can be configured to secure the first end of the flexible body between one or more of the locking fingers and the center tine when the first end of the flexible body is placed onto the bed.

In another aspect, the center tine includes an elongated protrusion and the locking fingers are configured to engage the first end of the flexible body between the elongated protrusion and the locking fingers when the first end of the flexible body is moved between the elongated protrusion and the locking fingers.

In another aspect, the bed includes a resting wall and angled walls disposed on opposite sides of the resting wall.

In another aspect, the flexible body is an intravenous bag that is pre-filled with a fluid prior to positioning the flexible body on the bed. The fixation device includes plural locking fingers and a center tine. The locking fingers are configured to pivot toward the center tine to secure ports of the intravenous bag between the locking fingers and the center tine.

In another aspect, the fixation device is configured to be actuated to lock onto the first end of the flexible body when the first end is lowered into the fixation device. The fixation device also is configured to release the first end of the flexible body when the first end is lifted from the fixation device.

In another embodiment, a method for securing a flexible body in carriage assembly of a printing system is provided. The method includes providing a bed configured to receive a flexible body. The bed extends along a first direction from a fixation end to an open end. The method also includes positioning a fixation device proximate to the fixation end of the bed and securing a first end of the flexible body into the fixation device by placing the first end of the flexible body into the fixation device. The fixation device prevents the flexible body from being removed from the bed when an opposite second end of the flexible body is pulled along the first direction to at least partially flatten a printing surface of the flexible body.

In another aspect, securing the first end of the flexible body includes pivoting plural locking fingers toward each other to engage the first end of the flexible body.

In another aspect, the fixation device includes a center tine disposed between the locking fingers, and securing the first end of the flexible body includes biasing the locking fingers toward the center tine to cause the locking fingers to pivot toward the center tine and secure the first end between the locking fingers and the center tine.

In another aspect, the flexible body is an intravenous bag that is pre-filled with a fluid prior to receiving the flexible body on the bed, and securing the first end of the flexible body includes pivoting locking fingers of the fixation device toward a center tine of the fixation device to secure ports of the intravenous bag between the locking fingers and the center tine.

In another aspect, securing the first end of the fixation device includes lowering the first end of the flexible body into the fixation device. The method can also include releasing the first end of the flexible body from the fixation device by lifting the first end of the flexible bag from the fixation device.

In another embodiment, a manipulation assembly of a printing system includes a housing and a moving arm. The housing is configured to be disposed proximate to a conveyance assembly that moves carriage assemblies carrying flexible bodies along a direction of travel. The moveable arm is connected with the housing and is configured to engage the flexible bodies as the flexible bodies move along the direction of travel and to pull the flexible bodies in a pulling direction that differs from the direction of travel to at least partially flatten printing surfaces of the flexible bodies prior to the flexible bodies entering a printing assembly to have images printed on the printing surfaces.

In another aspect, the arm is configured to concurrently engage a plurality of the flexible bodies and to move in the direction of travel while engaged with the plurality of the flexible bodies.

In another aspect, the arm includes downwardly protruding posts configured to simultaneously enter into openings of a plurality of the flexible bodies. The arm is configured to move in the pulling direction to cause the posts in the openings of the plurality of the flexible bodies to pull on the plurality of the flexible bodies.

In another aspect, the arm is configured to move in a looped path to at least partially flatten the printing surfaces, where the arm moves in the looped path by lowering from a home position to engage a first set of the flexible bodies, moving along the direction of travel, pulling on the flexible bodies in the first set to at least partially flatten the printing surfaces of the flexible bodies in the first set, raising to release the flexible bodies in the first set, and moving in a direction that is opposite of the direction of travel to return to the home position for moving in the looped path for a different, second set of the flexible bodies.

In another aspect, the flexible bodies include three dimensional bodies that are filled with a fluid prior to the arm engaging the flexible bodies.

In another aspect, the flexible bodies include sealed enclosures that are at least partially filled with a fluid and one or more bubbles. The arm is configured to engage and pull the flexible bodies such that the flexible bodies are at least temporarily elongated along the pulling direction so that the one or more bubbles are more centered on the printing surfaces of the flexible bodies relative to prior to the arm pulling on the flexible bodies.

In another aspect, the pulling direction in which the flexible bodies are pulled by the arm is perpendicular to the direction of travel.

In another embodiment, a method for manipulating flexible bodies for being printed upon by a printing system includes engaging the flexible bodies having printing surfaces as the flexible bodies move in carriage assemblies along a direction of travel, pulling the flexible bodies in a pulling direction that differs from the direction of travel, and releasing the flexible bodies subsequent to pulling the flexible bodies and prior to the flexible bodies entering a printing assembly that prints images on the printing surfaces. Pulling the flexible bodies at least partially flattens the printing surfaces of the flexible bodies prior to the printing assembly printing the images on the printing surfaces.

In another aspect, engaging the flexible bodies includes engaging a first set of the flexible bodies, pulling the flexible bodies includes pulling the flexible bodies in the first set, and releasing the flexible bodies includes releasing the flexible bodies in the first set. The method also can include engaging, pulling, and releasing a second set of the flexible bodies that differs from the first set after releasing the flexible bodies in the first set in order to at least partially flatten the printing surfaces of the flexible bodies in the second set.

In another aspect, engaging and pulling the flexible bodies is performed by a mechanical arm that concurrently moves along the direction of travel with the flexible bodies while the flexible bodies are engaged by the mechanical arm.

In another aspect, pulling the flexible bodies is performed by the arm concurrently moving along the direction of travel and the pulling direction while engaged with the flexible bodies.

In another aspect, engaging the flexible bodies includes simultaneously inserting posts into openings of the flexible bodies and pulling the flexible bodies includes moving the posts in the pulling direction.

In another aspect, the flexible bodies include three dimensional bodies that are filled with a fluid prior to engaging, pulling, and releasing the flexible bodies.

In another aspect, the flexible bodies include sealed enclosures that are at least partially filled with a fluid and one or more bubbles. Pulling the flexible bodies causes at least a temporarily elongation of the flexible bodies along the pulling direction so that the one or more bubbles are more centered on the printing surfaces of the flexible bodies relative to prior to pulling on the flexible bodies.

In another aspect, the pulling direction is perpendicular to the direction of travel.

In another embodiment, a gripping assembly of a printing system includes a gripping device and a vacuum manifold. The gripping device includes one or more engagement members configured to move and contact a surface of a flexible body as the flexible body moves in a direction of travel. The gripping device includes a conduit that is fluidly coupled with the one or more engagement members. The vacuum manifold is configured to be fluidly coupled with a vacuum pump and with the conduit of the gripping device. The vacuum manifold includes several vacuum cells in which at least a partial vacuum is generated by the vacuum pump. The gripping device is configured to move along the vacuum manifold as the flexible body moves in the direction of travel such that the conduit of the gripping device is fluidly coupled with different ones of the vacuum cells at different times while the one or more engagement members of the flexible body remain engaged with the surface of the flexible body. The vacuum cells of the vacuum manifold are configured to be individually controlled as to when the at least a partial vacuum is established in the vacuum cells, the at least a partial vacuum established in the cells to which the conduit of the gripping device is fluidly coupled as the gripping device moves along the vacuum manifold to cause the flexible body to remain secured to the one or more engagement members by the at least a partial vacuum.

In another aspect, the gripping device is configured to lower toward the flexible body that is being carried in a carriage assembly along the direction of travel to engage the one or more engagement members with the surface of the flexible body. The gripping device also is configured to lift the flexible body from the carriage assembly as the gripping device continues to move in the direction of travel.

In another aspect, each of the vacuum cells of the vacuum manifold is configured to be temporally controlled to establish the at least a partial vacuum in the vacuum cell during a time when the conduit of the gripping device is fluidly coupled with the vacuum cell.

In another aspect, the one or more engagement members include one or more suction cups.

In another aspect, the flexible body includes a three dimensional sealed enclosure that is at least partially filed with a fluid.

In another aspect, at least one of the vacuum cells is configured to terminate the at least a partial vacuum in the at least one of the vacuum cells so that the gripping device releases the flexible body when the conduit of the gripping device is fluidly coupled with the at least one of the vacuum cells.

In another aspect, the vacuum cells are sequentially arranged such that the vacuum cells are configured to sequentially establish the at least a partial vacuum in the vacuum cells as the gripping device moves along the vacuum cells.

In another aspect, the assembly also includes individually controllable timing elements fluidly coupled with the vacuum pump and the vacuum cells. The timing elements are configured to control when the at least a partial vacuum is established in each of the vacuum cells.

In another aspect, the timing elements are configured to be controlled by a control unit that directs the timing elements when to establish the at least a partial vacuum in one or more of the vacuum cells when the gripping device is fluidly coupled with the one or more of the vacuum cells based on an inspection of a printed image on the flexible body.

In another embodiment, another gripping assembly of a printing system is provided. The gripping assembly includes a carousel device, and a vacuum manifold. The carousel device includes plural gripping devices that are configured to move along a path of the carousel device proximate to a conveyance assembly that moves plural flexible bodies along a direction of travel. The carousel device is configured to move the gripping devices to contact surfaces of the flexible bodies as the flexible bodies move in the direction of travel. The vacuum manifold is configured to be fluidly coupled with a vacuum pump and with the gripping devices as the gripping devices move through at least a portion of the looped path of the carousel device. The vacuum manifold includes a sequence of vacuum cells that are configured to be individually controlled as to when at least a partial vacuum is generated by the vacuum pump in each of the vacuum cells in the sequence of the vacuum cells. The carousel device is configured to move the gripping devices along the vacuum manifold as the flexible bodies move in the direction of travel such that the gripping devices engage the flexible bodies and the gripping devices are fluidly coupled with different ones of the vacuum cells during different time periods. The vacuum cells of the vacuum manifold are configured to be individually controlled as to when the at least a partial vacuum is established in the vacuum cells. The at least a partial vacuum is established in the vacuum cells during time periods at which selected ones of the gripping devices are fluidly coupled with the vacuum cells such that the selected ones of the gripping devices draw the at least a partial vacuum on the flexible bodies to secure selected ones of the flexible bodies to the gripping devices.

In another aspect, the carousel device is configured to be disposed above the conveyance assembly and to lower the gripping devices toward the flexible bodies that are being carried in carriage assemblies along the direction of travel and to lift the gripping devices away from the carriage assemblies after the gripping devices contact the surfaces of the flexible bodies.

In another aspect, the selected ones of the gripping devices are configured to engage the surfaces of the flexible bodies, grip the flexible bodies using the at least a partial vacuum provided by the vacuum cells to which the selected ones of the gripping devices are fluidly coupled, and lift the flexible bodies out of the carriage assemblies using the at least a partial vacuum.

In another aspect, the gripping devices other than the selected ones of the gripping devices are configured to be lowered by the carousel device, engage the surfaces of the flexible bodies, and release from the flexible bodies without gripping and lifting the flexible bodies.

In another aspect, the vacuum cells to which the gripping devices other than the selected ones of the gripping devices are fluidly coupled do not establish the at least a partial vacuum in order to prevent the gripping devices other than the selected ones of the gripping devices from gripping and lifting the flexible bodies.

In another aspect, each of the vacuum cells of the vacuum manifold is configured to be temporally controlled to establish the at least a partial vacuum in the vacuum cell during time periods when the selected ones of the gripping devices are fluidly coupled with the vacuum cell.

In another aspect, each of the vacuum cells of the vacuum manifold is configured to be temporally controlled to not establish the at least a partial vacuum in the vacuum cell during time periods when the gripping devices other than the selected ones of the gripping devices are fluidly coupled with the vacuum cell.

In another aspect, the gripping devices include suction cups that engage the surfaces of the flexible bodies.

In another aspect, the flexible bodies include three dimensional sealed enclosures that are at least partially filed with fluid.

In another aspect, the vacuum cells are sequentially arranged such that the vacuum cells are configured to sequentially establish the at least a partial vacuum in the vacuum cells as the selected ones of the gripping devices move along the vacuum cells.

In another aspect, the assembly also includes individually controllable timing elements fluidly coupled with the vacuum pump and the vacuum cells. The timing elements are configured to control when the at least a partial vacuum is established in each of the vacuum cells.

In another aspect, the timing elements are configured to be controlled by a control unit that directs the timing elements when to establish the at least a partial vacuum in one or more of the vacuum cells when the gripping devices are fluidly coupled with the one or more of the vacuum cells based on inspection of printed images on the flexible bodies.

In another embodiment, a method for gripping flexible bodies in a printing system is provided. The method includes moving a gripping device having one or more engagement members to contact a surface of a flexible body as the flexible body moves in a direction of travel. The gripping device includes a conduit that is fluidly coupled with the one or more engagement members. The method also includes translating the gripping device along a vacuum manifold configured to be fluidly coupled with a vacuum pump and having several vacuum cells in which at least a partial vacuum is generated by the vacuum pump. The gripping device moves along the vacuum manifold as the flexible body moves in the direction of travel such that the conduit of the gripping device is fluidly coupled with different ones of the vacuum cells at different times while the one or more engagement members of the flexible body remain engaged with the surface of the flexible body. The method further includes individually controlling when the at least a partial vacuum is established in the vacuum cells such that the at least a partial vacuum established in the cells to which the conduit of the gripping device is fluidly coupled as the gripping device moves along the vacuum manifold to cause the flexible body to remain secured to the one or more engagement members by the at least a partial vacuum.

In another aspect, moving the gripping device includes lowering the gripping device toward the flexible body that is being carried in a carriage assembly along the direction of travel to engage the one or more engagement members with the surface of the flexible body. The method also can include lifting the gripping device in order to lift the flexible body from the carriage assembly as the gripping device is translated along the vacuum manifold.

In another aspect, individually controlling when the at least a partial vacuum is established in the vacuum cells includes establishing the at least a partial vacuum in each of the vacuum cells during a time period when the conduit of the gripping device is fluidly coupled with the vacuum cell.

In another aspect, the flexible body includes a three dimensional sealed enclosure that is at least partially filed with a fluid.

In another aspect, the method also includes terminating the at least a partial vacuum in the at least one of the vacuum cells so that the gripping device releases the flexible body when the conduit of the gripping device is fluidly coupled with the at least one of the vacuum cells.

In another aspect, individually controlling when the at least a partial vacuum is established in the vacuum cells includes sequentially establishing the at least a partial vacuum in the vacuum cells as the gripping device moves along the vacuum cells.

In another aspect, individually controlling when the at least a partial vacuum is established in the vacuum cells includes establishing the at least a partial vacuum in order to grip and carry the flexible body in one or more of the vacuum cells when the gripping device is fluidly coupled with the one or more of the vacuum cells based on an inspection of a printed image on the flexible body.

In another embodiment, another method for gripping flexible bodies in a printing system includes moving plural gripping devices along a path disposed proximate to a conveyance assembly that moves plural flexible bodies along a direction of travel. The gripping devices are moved to contact surfaces of the flexible bodies as the flexible bodies move in the direction of travel. The method also includes translating the gripping devices along a vacuum manifold that is fluidly coupled with a vacuum pump and the gripping devices. The vacuum manifold includes a sequence of vacuum cells that are arranged such that the gripping devices are fluidly coupled with different ones of the vacuum cells during different time periods as the gripping devices are translated along the vacuum manifold. The method also includes individually controlling when at least a partial vacuum is established in each of the vacuum cells. The at least a partial vacuum is established in the vacuum cells during time periods at which selected ones of the gripping devices are fluidly coupled with the vacuum cells such that the selected ones of the gripping devices draw the at least a partial vacuum on the flexible bodies to secure selected ones of the flexible bodies to the gripping devices.

In another aspect, moving the gripping devices includes lowering the gripping devices toward the flexible bodies that are being carried in carriage assemblies along the direction of travel and lifting the gripping devices away from the carriage assemblies after the gripping devices contact the surfaces of the flexible bodies.

In another aspect, the at least a partial vacuum is established in the vacuum cells that are fluidly coupled with the gripping devices that are engaged to the surfaces of the flexible bodies. The method also can include gripping the flexible bodies using the at least a partial vacuum provided by the vacuum cells to which the selected ones of the gripping devices are fluidly coupled and lifting the flexible bodies out of the carriage assemblies using the at least a partial vacuum.

In another aspect, moving the gripping devices includes lowering the gripping devices other than the selected ones of the gripping devices to engage the surfaces of the flexible bodies and releasing from the flexible bodies without gripping and lifting the flexible bodies.

In another aspect, individually controlling when the at least a partial vacuum is established includes not establishing the at least a partial vacuum in the vacuum cells to which the gripping devices other than the selected ones of the gripping devices are fluidly coupled in order to prevent the gripping devices other than the selected ones of the gripping devices from gripping and lifting the flexible bodies.

In another aspect, individually controlling when the at least a partial vacuum is established includes temporally controlling when to establish the at least a partial vacuum in the each of the vacuum cells during time periods when the selected ones of the gripping devices are fluidly coupled with the vacuum cell.

In another aspect, the flexible bodies include three dimensional sealed enclosures that are at least partially filed with fluid.

In another aspect, individually controlling when the at least a partial vacuum is established in the vacuum cells includes establishing the at least a partial vacuum in one or more of the vacuum cells when the gripping devices are fluidly coupled with the one or more of the vacuum cells based on inspection of printed images on the flexible bodies.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A system comprising:

a carriage assembly having a supporting surface configured to support a flexible body along a first direction, the carriage assembly also configured to grasp a first end of opposite ends of the flexible body; and a preparation station configured to at least partially flatten a printing surface of the flexible body by engaging a second end of the opposite ends of the flexible body and moving the second end of the flexible body in a second direction oriented away from the first end of the flexible body that is grasped by the carriage assembly and oriented transverse to the first direction during a time period that the first end of the flexible body is grasped by the carriage assembly, wherein the preparation station is configured to at least partially flatten the printing surface of the flexible body prior to printing an image on the printing surface of the flexible body.

2. The system of claim 1, further comprising a conveyance assembly configured to be coupled with the carriage assembly and to move the carriage assembly along a third direction that is transversely oriented with respect to the first and second directions.

3. The system of claim 1, wherein the flexible body is a three dimensional body that is pre-filled with a fluid prior to the preparation station at least partially flattening the printing surface of the flexible body.

4. The system of claim 1, wherein the first direction is a vertical direction and the second direction is a horizontal direction.

5. The system of claim 1, wherein the carriage assembly includes a fixation device that grasps onto the first end of the flexible body to prevent the flexible body from being pulled off of the carriage assembly along a lateral direction that is transverse to the direction of travel.

6. The system of claim 5, wherein the fixation device includes two or more fingers that move toward each other to grasp onto the first end of the flexible body responsive to the first end of the flexible body being moved downward along the first direction between the two or more fingers.

7. The system of claim 6, further comprising a seating device having an angled edge that engages the flexible body to force the first end of the flexible body down into the fixation device.

8. The system of claim 1, wherein the preparation station includes an arm configured to engage the second end of the flexible body and to pull on the second end of the flexible body along the second direction to at least partially flatten the printing surface of the flexible body.

9. The system of claim 1, further comprising an inkjet printer that deposits ink onto the printing surface of the flexible body to print the image.

10. The system of claim 1, further comprising a selection station having a carousel device with plural gripping devices, the carousel device configured to move the gripping devices along a looped path to engage the flexible body with at least one of the gripping devices, wherein the at least one of the gripping devices is configured to reduce air pressure between the flexible body and the at least one of the gripping devices in order to remove the flexible body from the carriage assembly.

11. A system comprising:

a carriage assembly having a supporting surface configured to support a three dimensional flexible body that is at least partially filled with a fluid;

a conveyance assembly configured to be coupled with the carriage assembly and to move the carriage assembly in a direction of travel that is parallel with the supporting surface of the carriage assembly; and a preparation station configured to engage at least one end of the flexible body and to at least partially flatten a surface of the flexible body by pulling on the at least one end of the flexible body in a second direction that is oriented parallel to the supporting surface of the carriage assembly and perpendicular to the direction of travel.

12. The system of claim 11, further comprising a printing station configured to print an image on the surface of the flexible body subsequent to the preparation station at least partially flattening the surface of the flexible body.

13. The system of claim 11, wherein the carriage assembly includes a fixation device that grasps onto a first end of the flexible body and the preparation station includes an arm configured to engage an opposite, second end of the flexible body, wherein the preparation station is configured to at least partially flatten the surface of the flexible body by pulling the second end of the flexible body away from the first end of the flexible body.

14. The system of claim 13, wherein the fixation device includes two or more fingers that move toward each other to grasp onto the first end of the flexible body responsive to the first end of the flexible body being moved downward between the two or more fingers, and further comprising a seating device having an angled edge that engages the flexible body to force the first end of the flexible body down into the fixation device.

15. The system of claim 1, further comprising a selection station having a carousel device with plural gripping devices, the carousel device configured to move the gripping devices along a looped path to engage the flexible body with at least one of the gripping devices, wherein the at least one of the gripping devices is configured to reduce air pressure between the flexible body and the at least one of the gripping devices in order to remove the flexible body from the carriage assembly.

16. A system comprising:

a preparation station configured to at least partially flatten printing surfaces of flexible bodies that are transported in carriage assemblies and that are at least partially filled with a fluid prior to the printing surfaces being at least partially flattened;

a printing station configured to print one or more images onto the printing surfaces of the flexible bodies subsequent to the preparation station at least partially flattening the printing surfaces; and a selection station configured to engage one or more of the flexible bodies and remove the one or more flexible bodies from the carriage assemblies subsequent to the printing station printing the one or more images onto the printing surfaces of the flexible bodies, the selection station including gripping devices configured to move along a looped path while the flexible bodies move beneath the gripping devices.

17. The system of claim 16, wherein the gripping devices are configured to grasp the one or more of the flexible bodies via reduced air pressure generated between the gripping devices and the one or more flexible bodies.

18. The system of claim 16, wherein the gripping devices are configured to increase in length in order to reach and engage the printing surfaces of the one or more flexible bodies as the gripping devices move above the flexible bodies.

19. The system of claim 16, further comprising a preparation station configured to engage at least one end of the flexible body and to at least partially flatten a surface of the flexible body by pulling on the at least one end of the flexible body.

20. The system of claim 16, wherein the printing station is configured to print the one or more images onto the printing surfaces of the flexible bodies after the flexible bodies are at least partially filled with the fluid.

* * * * *